US008127865B2

(12) United States Patent
Watson et al.

(10) Patent No.: US 8,127,865 B2
(45) Date of Patent: Mar. 6, 2012

(54) METHOD OF DRILLING FROM A SHAFT FOR UNDERGROUND RECOVERY OF HYDROCARBONS

(75) Inventors: John David Watson, Evergreen, CO (US); Michael Helmut Kobler, Sebastopol, CA (US); Dana Brock, Sebastopol, CA (US)

(73) Assignee: OSUM Oil Sands Corp., Calgary, Alberta, CA (US)

( * ) Notice: Subject to any disclaimer, the term of this patent is extended or adjusted under 35 U.S.C. 154(b) by 0 days.

(21) Appl. No.: 11/737,578

(22) Filed: Apr. 19, 2007

(65) Prior Publication Data

US 2008/0017416 A1 Jan. 24, 2008

Related U.S. Application Data

(60) Provisional application No. 60/793,975, filed on Apr. 21, 2006, provisional application No. 60/868,467, filed on Dec. 4, 2006, provisional application No. 60/867,010, filed on Nov. 22, 2006.

(51) Int. Cl.
*E21B 7/04* (2006.01)
*E02D 29/00* (2006.01)

(52) U.S. Cl. ..... 175/62; 166/50; 166/313

(58) Field of Classification Search ..... 166/62, 166/50, 313; 405/249; 175/62
See application file for complete search history.

(56) References Cited

U.S. PATENT DOCUMENTS 604,330 A 5/1898 Kibling
1,520,737 A 12/1924 Wright
1,660,187 A 2/1928 Ehrat
1,722,679 A 7/1929 Ranney
1,936,643 A 10/1929 Reed
1,735,012 A 11/1929 Rich
1,735,481 A 11/1929 Uren
1,811,560 A 6/1931 Ranney
1,812,305 A 6/1931 Ranney
1,816,260 A 7/1931 Lee
(Continued)

FOREIGN PATENT DOCUMENTS

CA 986146 3/1976
(Continued)

OTHER PUBLICATIONS

"Lateral Extension for Toronto's Metro", Tunnels & Tunnelling International, Mar. 1998, pp. 46-49.

(Continued)

*Primary Examiner* — Shane Bomar
*Assistant Examiner* — Robert E Fuller
(74) *Attorney, Agent, or Firm* — Sheridan Ross P.C.

(57) ABSTRACT

The present invention discloses a selection process for installing underground workspace in or near a hydrocarbon deposit that is an appropriate workspace from which to drill, operate and service wells applicable to any of a number of methods of recovering hydrocarbons. The present invention includes a number of innovative methods for developing workspace for drilling from a shaft installed above, into or below a hydrocarbon deposit, particularly when the hydrocarbon reservoir is at significant formation pressure or has fluids (water oil or gases) that can enter the workspace. These methods can also be used for developing workspace for drilling from a tunnel installed above, into or below a hydrocarbon deposit. The present invention also discloses a procedure for evaluating the geology in and around the reservoir and using this information to select the most appropriate method of developing workspace for drilling from a shaft and/or tunnel.

6 Claims, 33 Drawing Sheets

U.S. PATENT DOCUMENTS

| | | | | |
|---|---|---|---|---|
| 1,852,717 | A | | 4/1932 | Grinnell et al. |
| 1,884,859 | A | | 10/1932 | Ranney |
| 1,910,762 | A | | 5/1933 | Grinnell et al. |
| 1,935,643 | A | | 11/1933 | Laughlin |
| 2,148,327 | A | | 2/1939 | Smith et al. |
| 2,193,219 | A | | 3/1940 | Bowie et al. |
| 2,200,665 | A | | 5/1940 | Bolton |
| 2,210,582 | A | | 8/1940 | Grosse et al. |
| 2,365,591 | A | | 12/1944 | Ranney |
| 2,670,801 | A | | 3/1954 | Sherborne |
| 2,783,986 | A | | 3/1957 | Nelson et al. |
| 2,786,660 | A | | 3/1957 | Alleman |
| 2,799,641 | A | | 7/1957 | Bell |
| 2,857,002 | A | | 10/1958 | Pevere et al. |
| 2,858,676 | A | | 11/1958 | Ross |
| 2,888,987 | A | | 6/1959 | Parker |
| 2,914,124 | A | | 11/1959 | Ripley, Jr. |
| 2,989,294 | A | | 6/1961 | Coker |
| 3,017,168 | A | | 1/1962 | Carr |
| 3,024,013 | A | | 3/1962 | Rogers et al. |
| 3,034,773 | A | | 5/1962 | Legatski |
| 3,207,221 | A | | 9/1965 | Cochran et al. |
| 3,227,229 | A | | 1/1966 | Wakefield, Jr. |
| 3,259,186 | A | | 7/1966 | Dietz |
| 3,285,335 | A | | 11/1966 | Reistle, Jr. |
| 3,333,637 | A | | 8/1967 | Prats |
| 3,338,306 | A | | 8/1967 | Cook |
| 3,353,602 | A | | 11/1967 | Geertsma |
| 3,386,508 | A | | 6/1968 | Bielstein et al. |
| 3,455,392 | A | | 7/1969 | Prats |
| 3,456,730 | A | | 7/1969 | Lange |
| 3,474,863 | A | | 10/1969 | Deans et al. |
| 3,530,939 | A | | 9/1970 | Turner et al. |
| 3,613,806 | A | | 10/1971 | Malott |
| 3,620,313 | A | | 11/1971 | Elmore et al. |
| 3,678,694 | A | | 7/1972 | Haspert |
| 3,768,559 | A | | 10/1973 | Allen et al. |
| 3,778,107 | A | | 12/1973 | Haspert |
| 3,784,257 | A | | 1/1974 | Lauber et al. |
| 3,838,738 | A | | 10/1974 | Redford et al. |
| 3,882,941 | A | | 5/1975 | Pelofsky |
| 3,884,261 | A | | 5/1975 | Clynch |
| 3,888,543 | A | | 6/1975 | Johns |
| 3,922,287 | A | | 11/1975 | Pawson et al. |
| 3,924,895 | A | | 12/1975 | Leasure |
| 3,937,025 | A | | 2/1976 | Alvarez-Calderon |
| 3,941,423 | A | | 3/1976 | Garte |
| 3,948,323 | A | | 4/1976 | Sperry et al. |
| 3,954,140 | A | | 5/1976 | Hendrick |
| 3,957,308 | A | | 5/1976 | Lambly et al. |
| 3,960,408 | A | | 6/1976 | Johns |
| 3,986,557 | A | | 10/1976 | Striegler et al. |
| 3,992,287 | A | | 11/1976 | Rhys |
| 4,046,191 | A | | 9/1977 | Neath |
| 4,055,959 | A | | 11/1977 | Fritz |
| 4,064,942 | A | | 12/1977 | Prats |
| 4,067,616 | A | | 1/1978 | Smith et al. |
| 4,072,018 | A | | 2/1978 | Alvarez-Calderon |
| 4,076,311 | A | | 2/1978 | Johns |
| 4,085,803 | A | | 4/1978 | Butler |
| 4,099,388 | A | | 7/1978 | Husemann et al. |
| 4,099,570 | A | | 7/1978 | Vandergrift |
| 4,099,783 | A | | 7/1978 | Verty et al. |
| 4,106,562 | A | | 8/1978 | Barnes et al. |
| 4,116,011 | A | * | 9/1978 | Girault ..... 405/134 |
| 4,116,487 | A | | 9/1978 | Yamazaki et al. |
| 4,152,027 | A | | 5/1979 | Fujimoto et al. |
| 4,160,481 | A | | 7/1979 | Turk et al. |
| 4,165,903 | A | | 8/1979 | Cobbs |
| 4,167,290 | A | | 9/1979 | Yamazaki et al. |
| 4,185,693 | A | | 1/1980 | Crumb et al. |
| 4,203,626 | A | | 5/1980 | Hamburger |
| 4,209,268 | A | | 6/1980 | Fujiwara et al. |
| 4,211,433 | A | | 7/1980 | Pedersen |
| 4,216,999 | A | | 8/1980 | Hanson |
| 4,224,988 | A | | 9/1980 | Gibson et al. |
| 4,227,743 | A | | 10/1980 | Ruzin et al. |
| 4,236,640 | A | | 12/1980 | Knight |
| 4,249,777 | A | | 2/1981 | Morrell et al. |
| 4,257,650 | A | | 3/1981 | Allen |
| 4,279,743 | A | | 7/1981 | Miller |
| 4,285,548 | A | | 8/1981 | Erickson |
| 4,289,354 | A | | 9/1981 | Zakiewicz |
| 4,296,969 | A | * | 10/1981 | Willman ..... 299/2 |
| 4,406,499 | A | | 9/1983 | Yildirim |
| 4,434,849 | A | | 3/1984 | Allen |
| 4,440,449 | A | | 4/1984 | Sweeney |
| 4,445,723 | A | | 5/1984 | McQuade |
| 4,455,216 | A | | 6/1984 | Angevine et al. |
| 4,456,305 | A | | 6/1984 | Yoshikawa |
| 4,458,945 | A | | 7/1984 | Ayler et al. |
| 4,458,947 | A | | 7/1984 | Hopley et al. |
| 4,463,988 | A | | 8/1984 | Bouck et al. |
| 4,486,050 | A | | 12/1984 | Snyder |
| 4,494,799 | A | | 1/1985 | Snyder |
| 4,502,733 | A | * | 3/1985 | Grubb ..... 299/2 |
| 4,505,516 | A | | 3/1985 | Shelton |
| 4,533,182 | A | | 8/1985 | Richards |
| 4,536,035 | A | | 8/1985 | Huffman et al. |
| 4,565,224 | A | | 1/1986 | Keller |
| 4,575,280 | A | | 3/1986 | Hemphill et al. |
| 4,595,239 | A | | 6/1986 | Ayler et al. |
| 4,601,607 | A | | 7/1986 | Lehmann |
| 4,603,909 | A | | 8/1986 | LeJeune |
| 4,607,888 | A | | 8/1986 | Trent et al. |
| 4,607,889 | A | | 8/1986 | Hagimoto et al. |
| 4,611,855 | A | | 9/1986 | Richards |
| 4,699,709 | A | | 10/1987 | Peck |
| 4,774,470 | A | | 9/1988 | Takigawa et al. |
| 4,793,736 | A | | 12/1988 | Thompson et al. |
| 4,808,030 | A | | 2/1989 | Takegawa |
| 4,856,936 | A | | 8/1989 | Hentschel et al. |
| 4,858,882 | A | * | 8/1989 | Beard et al. ..... 251/1.2 |
| 4,911,578 | A | | 3/1990 | Babendererde |
| 4,946,579 | A | | 8/1990 | Ocelli |
| 4,946,597 | A | | 8/1990 | Sury |
| 4,983,077 | A | | 1/1991 | Sorge et al. |
| 5,016,710 | A | | 5/1991 | Renard et al. |
| 5,032,039 | A | | 7/1991 | Hagimoto et al. |
| 5,051,033 | A | | 9/1991 | Grotenhofer |
| 5,125,719 | A | | 6/1992 | Snyder |
| 5,141,363 | A | | 8/1992 | Stephens |
| 5,174,683 | A | | 12/1992 | Grandori |
| 5,205,613 | A | | 4/1993 | Brown, Jr. |
| 5,211,510 | A | | 5/1993 | Kimura et al. |
| 5,217,076 | A | | 6/1993 | Masek |
| 5,249,844 | A | | 10/1993 | Gronseth |
| 5,255,960 | A | | 10/1993 | Ilomaki |
| 5,284,403 | A | | 2/1994 | Ilomaki |
| 5,316,664 | A | | 5/1994 | Gregoli et al. |
| 5,330,292 | A | | 7/1994 | Sakanishi et al. |
| 5,339,898 | A | | 8/1994 | Yu et al. |
| 5,354,359 | A | | 10/1994 | Wan et al. |
| 5,446,980 | A | | 9/1995 | Rocke |
| 5,472,049 | A | | 12/1995 | Chafee et al. |
| 5,484,232 | A | * | 1/1996 | Hayashi et al. ..... 405/184 |
| 5,534,136 | A | | 7/1996 | Rosenbloom |
| 5,534,137 | A | | 7/1996 | Griggs et al. |
| 5,655,605 | A | | 8/1997 | Matthews |
| 5,697,676 | A | | 12/1997 | Kashima et al. |
| 5,767,680 | A | | 6/1998 | Torres-Verdin et al. |
| 5,785,736 | A | | 7/1998 | Thomas et al. |
| 5,831,934 | A | | 11/1998 | Gill et al. |
| 5,846,027 | A | | 12/1998 | Fujii |
| 5,852,262 | A | | 12/1998 | Gill et al. |
| 5,879,057 | A | | 3/1999 | Schwoebel et al. |
| 5,890,771 | A | | 4/1999 | Cass |
| 6,003,953 | A | | 12/1999 | Huang et al. |
| 6,017,095 | A | | 1/2000 | DiMillo |
| 6,027,175 | A | | 2/2000 | Seear et al. |
| 6,206,478 | B1 | | 3/2001 | Uehara et al. |
| 6,257,334 | B1 | | 7/2001 | Cyr et al. |
| 6,263,965 | B1 | | 7/2001 | Schmidt et al. |
| 6,277,286 | B1 | | 8/2001 | Søntvedt et al. |
| 6,364,418 | B1 | | 4/2002 | Schwoebel |
| 6,412,555 | B1 | | 7/2002 | Sten-Halvorsen et al. |
| 6,510,897 | B2 | * | 1/2003 | Hemphill ..... 166/373 |

| | | | | |
|---|---|---|---|---|
| 6,554,368 | B2 | 4/2003 | Drake et al. | |
| 6,569,235 | B2 | 5/2003 | Carter, Jr. | |
| 6,604,580 | B2 | 8/2003 | Zupanick et al. | |
| 6,631,761 | B2 | 10/2003 | Yuan et al. | |
| 6,679,326 | B2 | 1/2004 | Zakiewicz | |
| 6,705,401 | B2 * | 3/2004 | Buckle et al. | 166/337 |
| 6,758,289 | B2 | 7/2004 | Kelley et al. | |
| 6,796,381 | B2 | 9/2004 | Ayler et al. | |
| 6,857,487 | B2 | 2/2005 | Galloway et al. | |
| 6,869,147 | B2 | 3/2005 | Drake et al. | |
| 6,880,633 | B2 | 4/2005 | Wellington et al. | |
| 6,929,330 | B2 | 8/2005 | Drake et al. | |
| 6,997,256 | B2 | 2/2006 | Williams et al. | |
| 7,066,254 | B2 | 6/2006 | Vinegar et al. | |
| 7,097,255 | B2 | 8/2006 | Drake et al. | |
| 7,128,375 | B2 | 10/2006 | Watson | |
| 7,163,063 | B2 | 1/2007 | Seams | |
| 7,185,707 | B1 | 3/2007 | Graham | |
| 7,192,092 | B2 | 3/2007 | Watson | |
| 7,240,730 | B2 | 7/2007 | Williams et al. | |
| 7,419,223 | B2 | 9/2008 | Seams | |
| 7,448,692 | B2 | 11/2008 | Drake et al. | |
| 7,641,756 | B2 | 1/2010 | Schwert | |
| 2002/0015619 | A1 | 2/2002 | Stephens | |
| 2003/0160500 | A1 | 8/2003 | Drake et al. | |
| 2004/0211559 | A1 | 10/2004 | Nguyen et al. | |
| 2005/0051362 | A1 | 3/2005 | McGuire et al. | |
| 2007/0039729 | A1 | 2/2007 | Watson | |
| 2007/0044957 | A1 | 3/2007 | Watson | |
| 2007/0085409 | A1 | 4/2007 | Drake et al. | |
| 2008/0017416 | A1 | 1/2008 | Watson | |
| 2008/0078552 | A1 | 4/2008 | Donnelly et al. | |
| 2008/0087422 | A1 | 4/2008 | Kobler et al. | |
| 2008/0122286 | A1 | 5/2008 | Brock et al. | |

FOREIGN PATENT DOCUMENTS

| | | | |
|---|---|---|---|
| CA | 986544 | | 3/1976 |
| CA | 1165712 | | 4/1984 |
| CA | 1167238 | | 5/1984 |
| CA | 1289057 | | 9/1991 |
| CA | 2124199 | | 6/1992 |
| CA | 2222668 | | 5/1998 |
| CA | 2340506 | | 9/2001 |
| CA | 2526854 | | 9/2001 |
| CA | 2583508 | | 9/2001 |
| CA | 2583513 | | 9/2001 |
| CA | 2583519 | | 9/2001 |
| CA | 2583523 | | 9/2001 |
| CA | 2358805 | | 10/2001 |
| CA | 2315596 | | 2/2002 |
| CA | 2332207 | | 2/2002 |
| JP | 03267497 | A * | 11/1991 |
| JP | 04-044514 | A | 2/1992 |
| JP | 04-312697 | | 11/1992 |
| WO | WO 01/69042 | | 9/2001 |
| WO | WO 02/45682 | | 6/2002 |

OTHER PUBLICATIONS

Eric P. Kindwall and Dana Brock, "Successful Use of Oxygen Decompression in Compressed Air Caisson Work", undated.
Claus Becker, "Chapter 48: Recent Application of Slurry- and EPB-Technique in Europe", 1999 RETC Proceedings, pp. 857-864.
J.H.L. Palmer et al., "Performance of a 7.6-m Diameter Full-Face Tunnel-Boring Machine Designed for a Canadian Coal Mine", pp. 203-208, undated.
Shani Wallis, "Canadian Coal Given the TBM Treatment at Cape Breton", Tunnels & Tunnelling, May 1985, 4 pages.
JC Marsh et al, "Ch. 11: Design, Excavation, Support of a Large Diameter Coal Mine Access Decline Using a Tunnel Boring Machine", 1985 RETC Proceedings, vol. 1, pp. 155-176.
George A. Peer, "Giant Rock TMB to Drive Access Tunnels Under Ocean", Heavy Construction News, Sep. 19, 1983, 2 pages.
J.A. Hunter and R. Lovat, "Design, Development, and Verfication of a Lovat 7.6-metre Full-Face Tunnel-Boring Machine", CIM Coal Developments, undated, 8 pages.
AW Stokes and D.B. Stewart, "Cutting Head Ventilation fo a Full Face Tunnel Boring Machine", Cape Breton Coal Research Laboratory, CANMET, Sydney, Canada, undated, pp. 305-311.
"Versatile Lovat Picked for Jubilee Line", Tunnels & Tunnelling, Sep. 1994, 1 page.
"Jubilee Line Meets the Challenge", undated, 2 pages.
Simon Walker, "One Year Down the Jubilee Line", World Tunnelling, Feb. 1995, 4 pages.
Shani Wallis, "London's JLE Experience With Closed-Face Soft-Ground Pressurised TBMs", Tunnel, Feb. 1998, 4 pages.
George A. Peer, "Rock 'n' Roll Goes Underground", Heavy Construction News, Oct. 1997, pp. 12-13.
Steve Skelhorn et al., "North American Focus: Partnering in Toronto", World Tunnelling and Subsurface Excavation, Dec. 1998, 4 pages.
B. Garrod and R. Delmar, "Earth Pressure Balance TBM Performance—A Case Study", undated, pp. 41-50.
"A New TBM Saves Critical Deadline at Cleuson-Dixence Switzerland", Tunnels & Tunnelling, undated, 4 pages.
Kieways, The Magazine of Peter Kiewit Sons', Inc., Jan.-Feb.-Mar. 2006 (34 pages).
R.M. Butler, "Thermal Recovery of Oil and Bitumen", ISBN 0-9682563-0-9, 2nd Printing by GravDrain, Inc., Calgary, Alberta (1998) (Parts 1-8).
"Mining for Petroleum: Feasibility Study", Energy Development Consultants, Inc., US Bureau of Mines Contract No. JO275002 (Jul. 1978).
Piper et al, "An Evaluation of Heavy Oil Mining", Energy Dvlpmnt Consultants/Stone & Webster Engineering Corp, Dept of Energy Contract DE-AC03-80PC30259 (Dec. 1982) (Parts 1-3).
R.C. Fontaine et al., "An Evaluation of Oil Mining in the State of Ohio Phase II", Stone & Webster Engineering Corp. (Sep. 1983).
"Future of Oil Recovery From Underground Drill Sites", Underground Technology Research Council, Committee on Mine Assisted Oil Recovery (Dec. 1988).
A.W. Riddell, "Oil Mining a Review of Projects" (Jun. 1984).
J.S. Hutchins et al., "Oil Mining: An Emerging Technology", Mining Engineering (Dec. 1981).
R.A. Dick et al., "Oil Mining", US Bureau of Mines (1980) (best available).
"Oil Mining: The Fourth Order of Oil Recovery", Compressed Air magazine (Dec. 1983).
W.F. Dobson et al., "Mining Technology Assists Oil Recovery from Wyoming Field", Journal of Petroleum Technology, from Soc. Pet. Eng. (Apr. 1981).
R.C. Fontaine, "Recommended Reservoir Engineering Testing Program for Oil Mining Projects", Stone & Webster Engineering Corp. (Jan. 1984).
O'Rourke et al., "AOSTRA's Underground Test Facility (UTF): Mine-Assisted Recovery Under Difficult Conditions", CIM Bulletin, vol. 82, No. 921 (Jan. 1989).
Harris et al., "Feasibility Study of Underground Mining of Oil Sand", Alberta Oil Sands Information Center (1978).
"Feasibility Study Underground Mining of Oil Sand", R.M. Hardy & Associates Ltd. And Hatch Associates Limited (Sep. 1977).
AW Riddell et al, "Heavy Oil Mining Technical and Economic Analysis", California Regional Meeting of the Society of Petroleum Engineers, Long Beach, CA (Apr. 11-13, 1984).
"High-Strength Concrete at High Temperature—An Overview", Long T. Phan, National Institute of Standards and Technology, Gaithersburg, Maryland.
"Steam Assisted Gravity Drainage (SAGD): A New Oil Production Technology for Heavy Oil and Bitumens", T.N. Nasr, Alberta Research Council, Calgary, Canada, Mar. 2003.
U.S. Appl. No. 12/237,163, filed Sep. 24, 2008, Gil.
Stokes, et al., "Cutting Head Ventilation for a Full Face Tunnel Boring Machine", Cape Breton Coal Research Laboratory, CANMET, Sydney, Canada, date unknown, pp. 305-311.
Stephenson et al., "Mining Aspects of Hard to Access Oil Sands Deposits", Norwest Corporation, Mar. 2, 2006, pp. 1-57.
Deutsch et al., "Guide to SAGD (Steam Assisted Gravity Drainage) Reservoir Characterization Using Geostatistics", Centre for Computational Geostatistics (CCG) Guidebook Series vol. 3, 2005 (27 pages).
Author Unknown, "Technical Overview: Nigeria's Bitumen Belt and Developmental Potential", Ministry of Solid Minerals Development, Mar. 6, 2006, Available at http://64.233.167.104/search?q__cache:m12yiQ5o16EJ:msmd.gov.ng/privatisation/docs/Bitumen%2520Overview.pdf+SAGD+a..., printed Jan. 10, 2007, pp. 1-48.
Author Unknown, Lovat Inc. Company Brochure, date unknown, pp. 1-22.
Author Unknown, "Sunburst Excavation", IN FOCUS, Nov. 1993, pp. 18-19, 22-23.
Hignett et al.; "Tunnelling Trials in Chalk: Rock Cutting Experiments"; TRRL Laboratory Report 796; 1977.
Wallis, "Canadian coal given the TBM treatment at Cape Breton", Reprinted from Tunnels & Tunnelling, May 1985, pp. 1-4.
Ozdemir, et al., "Development of a Water Jet Assisted Drag Bit cutting Head for Coal Measure Rock" Chapter 41, RETC Proceedings, vol. 2, 1983, pp. 701-718.
Wang, et al.; "High Pressure Water Jet Assisted Tunnelling" Chapter 34, 1976 RETC Proceedings, pp. 649-676.
McCormick, et al., "Analysis of TBM Performance at the Record Setting River Mountains Tunnel #2", Chapter 8, 1997 RETC Proceedings, pp. 135-149.
Maciejewski, "Hydrotransport—An Enabling Technology for Future Oil Sands Development" Syncrude Canada Ltd., pp. 67-79.
Paine, et al., "Understanding hydrotransport: The key to Syncrude's success", CIM Bulletin, vol. 92, 1999, pp. 105-108.
Mikula et al., "Oil Sands Conditioning, Bitumen Release Mechanisms, and New Process Development", Alberta Oil Sands Information Services, 1999, pp. 1-8.
Mikula et al., "Commercial Implementation of a Dry Landscape Oil Sands Tailings Reclamation Option: Consolidated Tailings", Alberta Oil Sands Information Services; No. 1998.096, date unknown, pp. 907-921.
Friesen et al., "Monitoring of Oil Sand Slurries by On-line NIR Spectroscopy", Petroleum Society of CIM & Aostra, paper No. 94.10, date unknown, pp. 1-9.
Liu, et al.; "Volume reduction of oil sands fine tails utilizing nonsegregating tailings", Tailings and Mine Waste '96, pp. 73-81.
Matthews, et al., "Development of composite tailings technology at Syncrude Canada", Syncrude EDM Research, 2000, pp. 455-463.
Yoshidawa, et al., "A Study of Shield Tunnelling Machine (Part 1)—Soil Condition for Pressurized Slurry Shield to be Adapted-", Translation of Hitachi Zosen Technical Review, vol. 42, No. 1-4, 1981, pp. 1-41.
Author Unknown, "Mitsubishi Shield Machine", Mitsubishi Heavy Industries, Ltd., date unknown, pp. 1-38.
Czarnecki, Press Release; NSERC Industrial Research Chair in Oil Sands Syncrude Canada, Ltd, date unknown, pp. 1-3.
Canadian Heavy Oil Associate (CHOA) Annual Conference, Dec. 6, 2000, presentation by Oil Sands Underground Mining, Inc.
Stack, "Handbook of Mining and Tunneling Machinery", 1982, pp. 283 and 311.
Young,et al., "Full-scale Testing of the PCF Rock Excavation Method", VII Australian Tunelling Conference, Aug. 1993 pp. 259-264.
Babendererde, et al., "Extruded Concrete Lining—The Future Lining Technology for Industrialized Tunnelling," 2001 RETC Proceedings, Chapter 55, pp. 679-685.
Becker, "The Choice Between EPB- and Slurry Shields: Selection Criteria by Practical Examples," 1995 RETC Proceedings, Chapter 31, pp. 479-492.
Becker, "The Fourth Tube of the Elbe-Tunnel—Built by the World's Largest Soft Ground Tunnelling Machine", 2001 RETC Proceedings, Chapter 17, pp. 182-186.
Bergling, et al., "Main Bearings for Advanced TBMS," 1995 RETC Proceedings, Chapter 32, pp. 493-508.
Corti, et al., "Athabasca Mineable Oil Sands: The RTR/Gulf Extraction Process Theoretical Model of Bitumen Detachment," The 4.sup. th UNITAR/UNDP International Conference on Heavy Crude and Tar Sands Proceedings, vol. 5, Edmonton, AB, Aug. 7-12, 1988, pp. 41-44, 71.
Funasaki, et al., "World's Largest Slurry Shield Tunneling Report in Trans-Tokyo Bay Highway Construction," 1997 RETC Proceedings, Chapter 36, pp. 591-604.
Guetter, et al., "Two Tunnels in Totally Different Geological Formations Driven by the Same 7M Double-Shield TMB with an Extremely Thin-Walled Monoshell Honeycomb Segmental Lining System," 2001 RETC Proceedings, Chapter 21, pp. 241-260.
Herrenknecht, et al., "The New Generation of Soft Ground Tunnelling Machines," 1999 RETC Proceedings, Chapter 36, pp. 647-663.
Author Unknown, "Improving Profitability With New Technology," Joint Paper Between Petrel Robertson and Oil Sands Underground Mining, Inc., Edmonton, Alberta, Sep. 2001, pp. 1-44.
Jacobs, et al., "Hydrogen Sulfide Controls for Slurry Shield Tunneling in Gassy Ground Conditions—A Case History," 1999 RETC Proceedings, pp. 221-239.
Marcheselli, et al., "Construction of the 'Passante Ferroviario' Link in Milano, Lots 3P—5P—6P Excavation by Large Earth Pressure Balanced Shield with Chemical Foam Injection," 1995 RETC Proceedings, Chapter 36, pp. 549-572.
Moulton, et al., "Tunnel Boring Machine Concept for Converging Ground," 1995 RETC Proceedings, Chapter 33, pp. 509-523.
Author Unknown, "Underground Mining of Oil Sands," Oil Sands Underground Mining, Inc., presented at National Oil Sands Task Force, Jan. 2001 Quarterly Meeting, pp. 1-38.
Author Unknown, "A New Technology for the Recovery of Oil Sands," Oil Sands Underground Mining, Inc., presented at combined Oil Sands Task Force and Black Oil Pipeline Network Meeting, Jun. 2001, pp. 1-30.
Richards, et al., "Slurry Shield Tunnels on the Cairo Metro," 1997 RETC Proceedings, Chapter 44, pp. 709-733.
Rose, "Steel-Fiber-Reinforced-Shotcrete for Tunnels: An International Update," 1999 RETC Proceedings, pp. 525-536.
Sager, "Underpassing the Westerschelde by Implementing New Technologies," 1999 RETC Proceedings, pp. 927-938.
Uchiyama, "Twin TBM with Four Cutters for Subway Station (Roppongi Station in the Tokyo Metro Line 12)," 1999 RETC Proceedings, Chapter 37, pp. 665-674.
Wu, et al., "Stress Analysis and Design of Tunnel Linings," Chapter 26, pp. 431-455.
Borm, "Integrated Seismic Imaging System for Geological Prediction Ahead in Underground Construction," 2001 RETC Proceedings, Chapter 22, pp. 263-271.
Dowden, et al., "Coping with Boulders in Soft Ground TBM Tunneling," 2001 RETC Proceedings, Chapter 78, pp. 961-977.
Doyle, et al., "Construction of Tunnels in Methane Environments," 1991 RETC Proceedings, Chapter 12, pp. 199-224.
Drake, et al., "A Promising New Concept for Underground Mining of Oil Sands," technical papers presented to Canadian Institute of Mining (CIM), Ft. McMurray, Jun. 13-15, 2001, pp. 1-16.
Drake, "An Innovative Approach for the Underground Mining of Oil Sands," presented at North American Tunneling 2002, Seattle, WA May 2002 and NARMS-TAC 202, Mining and Tunneling Innovation and Opportunity Conference, Toronto, Ontario, Jul. 2002, pp. 1-8.
Higashide, et al., "Application of DOT Tunneling Method to Construction of Multi-Service Utility Tunnel Adjacent to Important Structures," 1995 RETC Proceedings, Chapter 34, pp. 527-541.
Ounanian, et al., "Development of an Extruded Tunnel Lining System" Chapter 81, 1981 RETC Proceedings, vol. 2, pp. 1333-1351.
Schenk, "Recent Developments in High-Pressure Water-Jet Assisted Cutting of Rock and Coal", The Pennsylvania State University, RETC Proceedings, vol. 2, Chapter 39, 1983, pp. 663-684.
Zink, et al., "Water Jet Uses in Sandstone Excavation", RETC Proceedings, vol. 2, Chapter 40, 1983, pp. 685-700.
Souder, et al. "Water Jet Coal Cutting: The Resurgence of an Old Technology", RETC Proceedings, vol. 2, Chapter 42, 1983, pp. 719-739.
Li, et al., "Prediction of Oil Production by Gravity Drainage", Stanford University, SPE 84 184, Oct. 2003, pp. 1-8.
International Search Report for International (PCT) Patent Application No. PCT/US07/66995, mailed Aug. 26, 2008.
Written Opinion for International (PCT) Patent Application No. PCT/US07/66995, mailed Aug. 26, 2008.
International Preliminary Report on Patentability for International (PCT) Patent Application No. PCT/US07/066995, mailed Apr. 21, 2006.

Sahni, et al., "Electromagnetic Heating Methods for Heavy Oil Reservoirs", Submitted to 2000 Society of Petroleum Engineers, SPE/AAPG Western Regional Meeting, May 1, 2000, Long Beach, CA, pp. 1-12.
"Plan of Operation, Shell Frontier Oil and Gas Inc., E-ICP Test Project", Oil Shale Research and Development Project, Prepared for Bureau of Land Management, Feb. 15, 2006, pp. 1-70.
Cardwell et al., "Gravity Drainage Theory," Petroleum Transactions, AIME, vol. 179, 1949, pp. 199-211.
Dykstra, H., "The Prediction of Oil Recovery by Gravity Drainage," Journal of Petroleum Technology, May 1978, pp. 818-830.
Huang, et al., "Wet Electric Heating for Starting Up SAGD/VAPEX", Alberta Research Council, Presented at the Petroleum Society's 5th Canadian International Petroleum Conference, Jun. 2004, pp. 1-12, Paper 2004-130, Petroleum Society: Canadian Institute of Mining, Metallurgy and Petroleum.
Kewen et al., "Prediction of Production by Gravity Drainage," Stanford University, SPE 84184, Oct. 2003, p. 1-8.
Terwilliger et al. "An Experimental and Theoretical Investigation of Gravity Drainage Performance," Petroleum Transactions, AIME, vol. 146, 1951, pp. 285-296.
Singh et al., "Cost Analysis of Advanced Technologies for the Production of Heavy Oil and Bitumen in Western Canada," Alberta Research Council, 17th World Energy Council, Edmonton, Alberta, Canada, Sep. 1998, 11 pages.

* cited by examiner

METHOD OF DRILLING FROM A SHAFT FOR UNDERGROUND RECOVERY OF HYDROCARBONS

CROSS REFERENCE TO RELATED APPLICATION

The present application claims the benefits, under 35 U.S.C. §119(e), of U.S. Provisional Application Ser. No. 60/793,975 filed Apr. 21, 2006, entitled "Method of Drilling from a Shaft" to Brock, Kobler and Watson; U.S. Provisional Application Ser. No. 60/868,467 filed Dec. 4, 2006, entitled "Method of Drilling from a Shaft" to Brock, Kobler and Watson; and U.S. Provisional Application Ser. No. 60/867,010 filed Nov. 22, 2006 entitled "Recovery of Bitumen by Hydraulic Excavation" to Brock, Squires and Watson, all of which are incorporated herein by these references.

Cross reference is made to U.S. patent application Ser. No. 11/441,929 filed May 25, 2006, entitled "Method for Underground Recovery of Hydrocarbons", which is also incorporated herein by this reference.

FIELD

The present invention relates generally to selection of a lined shaft-based and tunnel-based method and system for installing, operating and servicing wells for recovery of hydrocarbons from pressurized soft-ground reservoirs, wherein the underground space is always isolated from the formation.

The present invention relates generally to selection of a lined shaft-based method and system for installing, operating and servicing wells for recovery of hydrocarbons from pressurized soft-ground reservoirs.

BACKGROUND

Oil is a nonrenewable natural resource having great importance to the industrialized world. The increased demand for and decreasing supplies of conventional oil has led to the development of alternative sources of crude oil such as oil sands containing bitumen or heavy oil and to a search for new techniques for continued recovery from conventional oil deposits. The development of the Athabasca oil sands in particular has resulted in increased proven world reserves of over 170 billion barrels from the application of surface mining and in-situ technologies. There are also large untapped reserves in the form of stranded oil deposits from known reservoirs. Estimates as high as 300 billion barrels of recoverable light and heavy oil have been made for North America. Recovery of stranded oil requires new recovery techniques that can overcome, for example, the loss of drive pressure required to move the oil to nearby wells where it can be pumped to the surface. These two sources of oil, oil sands and stranded oil, are more than enough to eliminate the current dependence on outside sources of oil and, in addition, require no substantial exploration.

Shaft Sinking

Shaft-sinking or shaft-drilling are well-developed areas of civil and mining construction. Applications in civil construction include for example ventilation shafts for transportation tunnels, access shafts for water drainage and sewage system tunnels and Ranney wells for recovering filtered water from aquifers. Applications in mining include for example ventilation and access shafts for underground mine works. Shafts have been sunk in hard rock and drilled or bored into soft-ground. Soft-ground shafts are commonly concrete lined shafts and are installed by a variety of methods. These methods include drilling and boring techniques often where the shaft is filled with water or drilling mud to counteract local ground pressures. There are casing drilling machines that use high torque reciprocating drives to work steel casing into the formation. There are also shaft sinking techniques for sinking shafts underwater using robotic construction equipment. There are secant pile systems, where several small diameter bores are drilled in a ring configuration, completed with concrete and then the center of the ring excavated to create the shaft. There is the caisson sinking method, which formation materials are removed from below the center of caisson, creating a void and causing the casing to sink under its own weight. Soft-ground shafts can be installed with diameters in the range of about 3 to about 10 meters.

Drilling Technology

Drilling technology for oil and gas wells is well developed. Drilling technologies for soft and hard rock are also well known. Water jet drilling has been implemented in both oil and gas well drilling, geothermal drilling, waste and groundwater control as well as for hard rock drilling. An example of water jet drilling technology is provided in published papers such as "Coiled Tubing Radials Placed by Water Jet Drilling: Field Results, Theory, and Practice" and "Performance of Multiple Horizontal Well Laterals in Low-to-Medium Permeability Reservoirs" which are listed as prior art references herein. Prior art "mining for access" methods are based on excavating tunnels, cross-connects and drilling caverns in competent rock above or below the target hydrocarbon formation. The competent rock provides ground support for the operation and, being relatively impermeable, to some extent protects the work space from fluid and gas seepages from the nearby hydrocarbon deposit. This approach cannot be applied when formation pressures are high; when the hydrocarbon reservoir is artificially pressurized for enhanced recovery operations ("EOR"); when the hydrocarbon formation is heated, for example, by injecting steam; or when the ground adjacent to the hydrocarbon reservoir is fractured, soft, unstable, gassy or saturated with ground fluids.

Drilling technology for oil and gas wells is well developed. Drilling technologies for soft and hard rock are also well known. Water jet drilling has been implemented in both oil and gas well drilling, geothermal drilling, waste and groundwater control as well as for hard rock drilling. An example of waterjet drilling technology is provided in published papers such as "Coiled Tubing Radials Placed by Water Jet Drilling: Field Results, Theory, and Practice" and "Performance of Multiple Horizontal Well Laterals in Low-to-Medium Permeability Reservoirs" which are listed as prior art references herein.

One of the present inventors has developed a hybrid drilling method using a modified pipejacking process in conjunction with a augur cutting tool and a plasticized drilling mud to install horizontal wells from the bottom of a distant shaft into a river bottom formation. This technique was successfully used to develop a Ranney well with a long horizontal collector well.

Vertical, inclined and horizontal wells may be installed from the surface by well-known methods. In many cases surface access is restricted and installing wells from an underground platform such as the bottom of a shaft or a tunnel may be a more practical and cost-effective approach to installing wells. Machine and methodology developments, particularly in the heavy civil underground construction sector, have opened up new possibilities for an underground approach for installing wells. Discussing some of these techniques, the present inventors have filed U.S. provisional patent applications U.S. Ser. No. 60/685,251, filed May 27, 2005 entitled "Method of Collecting Hydrocarbons from Tunnels", and U.S. Ser. No. 60/753,694, filed Dec. 23, 2005 entitled "Method of Recovering Bitumen" both of which are incorporated herein by this reference.

TBM and Microtunneling Technology

Soft-ground tunnels can be driven through water saturated sands and clays or mixed ground environments using large slurry, Earth Pressure Balance ("EPB") or mixed shield systems. This new generation of soft-ground tunneling machines can now overcome water-saturated or gassy ground conditions and install tunnel liners to provide ground support and isolation from the ground formation for a variety of underground transportation and infrastructure applications.

Developments in soft-ground tunneling led to the practice of micro-tunneling which is a process that uses a remotely controlled micro-tunnel boring machine combined with a pipe-jacking technique to install underground pipelines and small tunnels. Micro-tunneling has been used to install pipe from twelve inches to twelve feet in diameter and therefore, the definition for micro-tunneling does not necessarily include size. The definition has evolved to describe a tunneling process where the workforce does not routinely work in the tunnel.

Robotic Excavation Technology

Robotic excavators have been used in a variety of difficult situations such as excavating trenches undersea or preforming excavation functions underground in unsafe environments. An example of this technology can be found, for example, in U.S. Pat. No. 5,446,980, entitled "Automatic Excavation Control System and Method".

Other Means of Forming Underground Drilling Space

The mining and heavy civil underground industries have developed other processes that may be applied to forming drilling rooms for underground recovery of hydrocarbons. These include for example:

1. Hydraulic mining—Hydraulic mining techniques have been successfully demonstrated in the Alberta oil sands. Proposals have been put forward which involve mining the oil sand by hydraulic means through wells sunk from the surface. Such efforts are described, for example, in "Feasibility of Underground Mining of Oil Sand", Harris and Sobkowicz, 1978 and "Feasibility Study for Underground Mining of Oil Sand", Hardy, 1977. Johns in U.S. Pat. No. 4,076,311 issued Feb. 28, 1978 entitled "Hydraulic Mining from Tunnel by Reciprocated Pipes" discloses a method of hydraulic underground mining of oil sands and other friable mineral deposits. The present inventors have disclosed a method of hydraulic mining in oil sands in U.S. Patent Provisional Application 60/867,010 entitled "Recovery of Bitumen by Hydraulic Excavation" filed Nov. 22, 2006. The method of hydraulic mining disclosed includes: several means of drilling production and tailings injection wells; several means of augmenting hydraulic excavation for example by inducing block caving; means of isolating the underground personnel areas from formation gases and fluids; and means of backfilling the excavated volumes with tailings.
2. Horizontal secant pile—Secant pile walls or tunnels may be formed by constructing a longitudinal assembly of piles which contact each other to define a tunnel. The volume contained inside the pile assembly is excavated using the piles as ground support. The piles may be fabricated, for example, from steel tubes or reinforced concrete. The piles may be installed by pipe-jacking, pile driving, drilling or augering. Primary piles are installed first with secondary piles constructed in between primary piles once the latter gain sufficient strength. Pile overlap is typically in the order of about 50 to 100 mm.
3. Soil Mixing—Various methods of soil mixing (sometimes referred to as jet grouting), mechanical, hydraulic, with and without air, and combinations of both types have been used widely in Japan for about 20 years and more recently have gained wide acceptance in the United States. The soil mixing, ground modification technique, has been used for many diverse applications including building and bridge foundations, retaining structures, liquefaction mitigation, temporary support of excavation and water control. Names such as Jet Grouting, Soil Mixing, Cement Deep Mixing (CDM), Soil Mixed Wall (SMW), Geo-Jet, Deep Soil Mixing, (DSM), Hydra-Mech, Dry Jet Mixing (DJM), and Lime Columns are known to many. Each of these methods has the same basic root, finding the most efficient and economical method to mix cement (or in some cases fly ash or lime) with soil and cause the properties of the soil to become more like the properties of a soft rock.
4. Ground modification (also known as ground freezing)—Historically, ground modification for civil applications has been used primarily on large projects where groundwater and caving soils create an unstable situation and ground freezing represents the only possible solution. Ground freezing has been used to stabilize excavation walls in caving soils and to prevent groundwater seepage into the deep excavations near existing structures. The technology has been applied in Europe and North America for more than a century on a variety of construction and mining projects. The freezing method aims to provide artificially frozen soil that can be used temporarily as a support structure for tunneling or mining applications. It is a versatile technique that increases the strength of the ground and makes it impervious to water seepage. Excavation can proceed safely inside the frozen ground structure until construction of the final lining provides permanent support. In contrast to grouting works the freezing method is completely reversible and has no environmental impact. Ground freezing is not limited by adverse ground conditions and may be used in any soil formation, regardless of structure, grain size, permeability or moderate groundwater flow.
5. NATM—New Austrian Tunnelling Method (NATM) As defined by the Austrian Society of Engineers and Architects, the NATM " . . . constitutes a method where the surrounding rock or soil formations of a tunnel are integrated into an overall ringlike support structure. Thus the supporting formations will themselves be part of this supporting structure." In world-wide practice, however, when shotcrete is proposed for initial ground support of an open-face tunnel, it is often referred to as NATM. In current practice, for soft-ground tunnels which are referred to as NATM tunnels, initial ground support in the form of shotcrete (usually with lattice girders and some form of ground reinforcement) is installed as excavation proceeds, followed by installation of a final lining at a later date. Soft ground can be described as any type of ground requiring support as soon as possible after excavation in order to maintain stability of the NATM for soft ground. As long as the ground is properly supported, NATM construction methods are appropriate for soft-ground conditions. However, there are cases where soft-ground conditions do not favor an open face with a short length of uncompleted lining immediately next to it, such as in flowing ground or ground with short stand-up time (i.e., failure to develop a ground arch). Unless such unstable conditions can be modified by dewatering, spiling, grouting, or other methods of ground improvement, then NATM may be inappropriate. In these cases, close-face shield tunneling methods may be more appropriate for safe tunnel construction.

Key features of the NATM design philosophy are:

The strength of the ground around a tunnel is deliberately mobilised to the maximum extent possible.

Mobilisation of ground strength is achieved by allowing controlled deformation of the ground.

Initial primary support is installed having load-deformation characteristics appropriate to the ground conditions, and installation is timed with respect to ground deformations.

Instrumentation is installed to monitor deformations in the initial support system, as well as to form the basis of varying the initial support design and the sequence of excavation.

Key features of NATM construction methods are:

The tunnel is sequentially excavated and supported, and the excavation sequences can be varied.

The initial ground support is provided by shotcrete in combination with fibre or welded-wire fabric reinforcement, steel arches (usually lattice girders), and sometimes ground reinforcement (e.g., soil nails, spiling).

The permanent support is usually (but not always) a cast-in-place concrete lining.

It should be noted that many of the construction methods described above were in widespread use in the US and elsewhere in soft-ground applications before NATM was described in the literature.

For underground recovery of hydrocarbons, there remains a need for modified excavation methods and a selection method to utilize shafts as an underground base to install a network of wells either from the shaft itself or drilling rooms, tunnels and the like, initiated from the shaft. There is a need for safe and economical process of installing a network of hydrocarbon recovery wells from an underground work space while maintaining isolation between the work space and the ground formation. It is the objective of the present invention to provide a method and means of selecting the most appropriate process for providing adequate underground workspace by selecting one or more of a number of methods for installing, operating and servicing a large number of wells in various levels of a hydrocarbon deposit which may contain free gas, gas in solution and water zones.

For underground recovery of hydrocarbons, there remains a need for modified excavation methods and a selection method to utilize shafts as an underground base to install a network of wells either from the shaft itself or drilling rooms, tunnels and the like, initiated from the shaft. It is the objective of the present invention to provide a method and means of selecting the most appropriate process for providing adequate underground workspace by selecting one or more of a number of methods for installing, operating and servicing a large member of wells in various levels of a hydrocarbon deposit which may contain free gas, gas in solution and water zones.

SUMMARY

These and other needs are addressed by embodiments of the present invention, which are directed generally to methods for installing underground workspace in or near a hydrocarbon deposit that is an appropriate workspace from which to drill, operate and/or service wells applicable to any of a number of methods of recovering hydrocarbons and selecting an appropriate method for a given application. The present invention includes a number of innovative methods for developing workspace for drilling from a shaft installed above, into, or below a hydrocarbon deposit, particularly when the hydrocarbon reservoir is at significant formation pressure or has fluids (water, oil or gases) that can seep into or flood a workspace. These methods can also be used for developing workspace for drilling from a tunnel installed above, into, or below a hydrocarbon deposit. The entire process of installing the shafts and tunnels as well as drilling and operating the wells is carried out while maintaining isolation between the work space and the ground formation. The present invention also discloses a procedure for evaluating the geology in and around the reservoir and using this and other information to select the most appropriate method of developing workspace for drilling from a shaft and/or tunnel.

These and other needs are addressed by embodiments of the present invention, which are directed generally to methods for installing underground workspace in or near a hydrocarbon deposit that is an appropriate workspace from which to drill, operate and/or service wells applicable to any of a number of methods of recovering hydrocarbons and selecting an appropriate method for a given application. The present invention includes a number of innovative methods for developing workspace for drilling from a shaft installed above, into, or below a hydrocarbon deposit, particularly when the hydrocarbon reservoir is at significant formation pressure or has fluids (water, oil or gases) that can seep into or flood a workspace. These methods can also be used for developing workspace for drilling from a tunnel installed above, into, or below a hydrocarbon deposit. The present invention also discloses a procedure for evaluating the geology in and around the reservoir and using this and other information to select the most appropriate method of developing workspace for drilling from a shaft and/or tunnel.

In one embodiment, an excavation method includes the steps:

(a) forming a substantially vertically inclined shaft;

(b) at a selected level of the shaft, forming a plurality of recess cavities extending approximately radially outward from the shaft, the selected level of the shaft being adjacent to or near a hydrocarbon-containing formation; and (c) drilling one or more wells outward from a face of each of the recess cavities, each of the wells penetrating the hydrocarbon-containing formation.

The recess cavities are preferably manned. More preferably, each of the recess cavities has a diameter ranging from about 1 to about 2 meters and a length ranging from about 4 to about 10 meters.

To protect underground personnel and inhibit underground gas explosions, the recess cavities and at least some of the shaft are lined with a formation-fluid impervious liner.

The shaft normally includes a number of spaced apart levels. Each of the spaced apart levels comprises a plurality of approximately radially outwardly extending recess cavities.

In one configuration, the drilling step (c) includes the further steps of:

(c1) from the shaft, drilling through a flange positioned adjacent to a surface of the shaft to form a drilled hole extending outwardly from the shaft;

(c2) placing a cylindrical shield in the drilled hole;

(c3) securing the shield to the surface of the shaft; and (c4) introducing a cementitious material into an end of the drilled hole to form a selected recess cavity.

When the cementitious material sets, the set cementitious material and shield will seal the interior of the cavity from one or more selected formation fluids.

In one configuration, the drilling step (c) includes the further steps of:

(c1) from the shaft, drilling, by a drill stem and bit, through a flange and sealing gasket, the flange and gasket being positioned on a surface of the shaft, to form a drilled hole extending into the hydrocarbon-containing formation;

(c2) while the hole is being drilled, extending a cylindrical shield into the hole in spatial proximity to the drill bit, the shield surrounding the drill stem;

(c3) pumping a cementitious composition through the drill stem and into a bottom of the drilled hole;

(c4) securing the shield to the flange; and (c5) after the cementitious composition has set, removing the drill stem from the hole to form a selected recess cavity.

When the cementitious material sets, the set cementitious material and shield will seal the interior of the cavity from one or more selected formation fluids.

In another embodiment, a drilling method includes the steps:

(a) from a manned excavation, drilling through a flange positioned adjacent to a surface of the excavation to form a drilled hole extending outwardly from the excavation;

(b) placing a cylindrical shield in the drilled hole;

(c) securing the shield to the surface of the excavation; and (d) introducing a cementitious material into an end of the drilled hole to form a selected recess cavity.

When the cementitious material sets, the set cementitious material and shield will seal the interior of the hole from one or more selected formation fluids.

In the drilling step, a drill stem and attached bit drill through a flange and the sealing gasket and into a hydrocarbon-containing formation. The flange and gasket are positioned on a surface of the excavation. During the drilling step, a cylindrical shield is preferably extended into the hole in spatial proximity to the drill bit, the shield surrounding the drill stem. The shield may or may not rotate in response to rotation of the bit.

In yet another embodiment, an excavation method includes the steps:

(a) excavating a shaft, the excavated shaft being at least partially filled with a drilling fluid and having a diameter of at least about 3 meters; and (b) an automated and/or remotely controlled excavation machine forming an excavation extending outwards from the shaft, the excavation machine being positioned below a level of and in the drilling fluid when forming the excavation.

The position of the excavation machine is preferably determined relative to a fixed point of reference in the shaft. The excavation machine is typically immersed in the drilling fluid when forming the excavation, and, to track the machine's position, the excavation machine is normally connected to the fixed point of reference. The excavation machine is controlled remotely by an operator.

In one configuration, the excavation machine is at least partially automated, and the excavation is located in a hydrocarbon-containing formation.

The method can include the further steps:

(c) removing the excavation machine from the excavation;

(d) filling, at least substantially, the excavation with a cementitious material that displaces the lighter drilling fluid from the filled portion of the excavation;

(e) repositioning the excavation machine in the shaft at an upper surface of the cementitious material, after the cementitious material has set, with the repositioned excavation machine still being immersed in the drilling fluid;

(f) removing, by the repositioned excavation machine, at least a portion of the set cementitious material to form a lined excavation; and (g) installing, in the lined excavation and while the lined excavation is filled with the drilling fluid, a permanent liner, the permanent liner being positioned interiorly of the remaining cementitious material.

In yet another embodiment, an excavation method includes the steps:

(a) drilling a plurality of substantially horizontal drill holes, the drill holes defining an outline of a volume to be excavated;

(b) filling, at least substantially, the drill holes with a cementitious material, to inhibit the passage of a selected formation fluid between the adjacent, filled drill holes and/or to provide structural support; and (c) thereafter excavating the volume to be excavated.

The volume to be excavated is positioned preferentially in a hydrocarbon-containing formation, and each of the drill holes has a normal diameter of at least about 0.33 meters and a length of up to about 800 meters.

The filling step (b) can include the further steps of:

(b1) after a selected hole is drilled and while a drill stem is positioned in the selected hole, pumping the cementitious material through the drill stem and into the hole and (b2) while the cementitious material is being introduced into the selected hole, removing gradually the drill stem from the selected hole, the rate of removal being related to the rate of introduction of the cementitious material into the selected hole.

In yet another embodiment, a method for recovering a bitumen-containing material is provided that includes the steps:

(a) determining, for a selected in situ hydrocarbon-containing deposit, a set of possible underground and/or surface excavation methods;

(b) determining a set of surface restrictions above and around the deposit;

(c) determining a set of regulatory requirements applicable to excavation of the deposit;

(d) determining a set of physical limitations on underground excavation of the deposit;

(e) determining a set of physical limitations on surface excavation of the deposit;

(f) determining a set of data for the deposit;

(g) determining a set of geotechnical data for at least one formation other than the deposit;

(h) based on the sets of surface restrictions, regulatory requirements, physical limitations, deposit data, and geotechnical data, assigning a recovery cost to each member of the set of possible excavation methods;

(i) based on a comparison of the recovery costs of the members, selecting a preferred excavation method to be employed;

(j) in response to the preferred excavation method being an underground method, performing the following substeps:

(j1) for an inclined access excavation to the deposit, the inclined access excavation being a shaft and/or decline, determining whether the inclined access excavation will intercept a formation with a potentially harmful formation fluid;

(j2) in response to the inclined access excavation intercepting a formation having at least one potentially harmful formation fluid, requiring men to be absent from the inclined access excavation when the access excavation is excavated in the vicinity of the formation;

(j3) selecting a bitumen recovery method to be employed, wherein possible bitumen recovery methods comprise thermal, gravity drain, and cold recovery methods; and (j4) based on the selected bitumen recovery method, selecting (a) a location in the underground excavation for well head placement, the location being at least one of in the inclined access excavation, in a recess cavity extending outwardly from the inclined access excavation, in a drilling room extending outwardly from the inclined access excavation, and in a tunnel extending outwardly from the inclined access excavation and (b) a position of the location relative to the deposit, the possible positions being above, in, and below the deposit.

Typically, the deposit data include deposit depth, areal extent, and geology, and the geotechnical data are for a formation positioned above the deposit.

In one configuration, the method includes the further substep:

(j5) based on the selected bitumen recovery method, determining a method for forming the location, the possible methods comprising ground modification, secant pile, robotic excavation machine, New Austrian Tunneling Method (NATM), soil mixing, and hydraulic mining.

Preferably, the method is embodied as a computer program recorded, in the form of processor-executable instructions, on a computer readable medium.

The maintenance of a sealed work space can provide a safe working environment for accessing, mobilizing and producing hydrocarbons from underground. The seals can prevent unacceptably high amounts of unwanted and dangerous gases from collecting in the excavation. It can also allow the excavation to be located in hydrologically active formations, such as formations below a body of water or forming part of the water table.

In certain embodiments, the present invention discloses a method for installing an underground workspace suitable for drilling wells into a hydrocarbon formation wherein the underground workspace is fully lined in order to provide ground support and isolation from formation pressures, excessive temperatures, fluids and gases. The process of maintaining isolation of the underground work space from the formation includes the phases of (1) installation of underground workspace and wells and (2) all production and maintenance operations from the underground workspace. Because the underground workspace is installed and operated in full isolation from the formation pressures and fluids, the workspace can be installed above, inside or below the hydrocarbon formation in soft or mixed ground.

The present invention can provide a number of advantages. First, the various excavation methods can provide a cost effective, safe way to recover hydrocarbons, particularly bitumen, from hydrocarbon-containing materials, even those located beneath otherwise inaccessible obstacles, such as rivers, lakes, swamps, and inhabited areas. The methods can permit excavation to be performed safely in the hydrocarbon-containing materials rather than from a less economical or effective location above or below the material. The excavation selection method can permit one to select the optimal, or near optimal, excavation method for a given set of conditions and restraints. The selection method considers not just the excavation methods described herein but other known methods that have proven track records in non-hydrocarbon-containing materials.

The following definitions are used herein:

It is to be noted that the term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

The term automatic and variations thereof, as used herein, refers to any process or operation done without material human input when the process or operation is performed. However, a process or operation can be automatic even if performance of the process or operation uses human input, whether material or immaterial, received before performance of the process or operation. Human input is deemed to be material if such input influences how the process or operation will be performed. Human input that consents to the performance of the process or operation is not deemed to be "material".

The terms determine, calculate and compute, and variations thereof, as used herein, are used interchangeably and include any type of methodology, process, mathematical operation or technique.

The term module as used herein refers to any known or later developed hardware, software, firmware, artificial intelligence, fuzzy logic, or combination of hardware and software that is capable of performing the functionality associated with that element. Also, while the invention is described in terms of exemplary embodiments, it should be appreciated that individual aspects of the invention can be separately claimed.

A cementitious material refers to material that, in one mode, is in the form of a liquid or slurry and, in a different mode, is in the form of a solid. By way of example, cement, concrete, or grout-type cementitious materials are in the form of a flowable slurry, which later dries or sets into cement, concrete, or grout, respectively.

A hydrocarbon is an organic compound that includes primarily, if not exclusively, of the elements hydrogen and carbon. Hydrocarbons generally fall into two classes, namely aliphatic, or straight chain, hydrocarbons, cyclic, or closed ring, hydrocarbons, and cyclic terpenes. Examples of hydrocarbon-containing materials include any form of natural gas, oil, coal, and bitumen that can be used as a fuel or upgraded into a fuel. Hydrocarbons are principally derived from petroleum, coal, tar, and plant sources.

Hydrocarbon production or extraction refers to any activity associated with extracting hydrocarbons from a well or other opening. Hydrocarbon production normally refers to any activity conducted in or on the well after the well is completed. Accordingly, hydrocarbon production or extraction includes not only primary hydrocarbon extraction but also secondary and tertiary production techniques, such as injection of gas or liquid for increasing drive pressure, mobilizing the hydrocarbon or treating by, for example chemicals or hydraulic fracturing the well bore to promote increased flow, well servicing, well logging, and other well and wellbore treatments.

A liner as defined for the present invention is any artificial layer, membrane, or other type of structure installed inside or applied to the inside of an excavation to provide at least one of ground support, isolation from ground fluids (any liquid or gas in the ground), and thermal protection. As used in the present invention, a liner is typically installed to line a shaft or a tunnel, either having a circular or elliptical cross-section. Liners are commonly formed by pre-cast concrete segments and less commonly by pouring or extruding concrete into a form in which the concrete can solidify and attain the desired mechanical strength.

A liner tool is generally any feature in a tunnel or shaft liner that self-performs or facilitates the performance of work. Examples of such tools include access ports, injection ports, collection ports, attachment points (such as attachment flanges and attachment rings), and the like.

A mobilized hydrocarbon is a hydrocarbon that has been made flowable by some means. For example, some heavy oils and bitumen may be mobilized by heating them or mixing them with a diluent to reduce their viscosities arid allow them to flow under the prevailing drive pressure. Most liquid hydrocarbons may be mobilized by increasing the drive pressure on them, for example by water or gas floods, so that they can overcome interfacial and/or surface tensions and begin to flow. Bitumen particles may be mobilized by some hydraulic mining techniques using cold water.

A seal is a device or substance used in a joint between two apparatuses where the device or substance makes the joint substantially impervious to or otherwise substantially inhibits, over a selected time period, the passage through the joint of a target material, e.g., a solid, liquid and/or gas. As used herein, a seal may reduce the in-flow of a liquid or gas over a selected period of time to an amount that can be readily controlled or is otherwise deemed acceptable. For example, a seal between a TBM shield and a tunnel liner that is being installed, may be sealed by brushes that will not allow large water in-flows but may allow water seepage which can be controlled by pumps. As another example, a seal between sections of a tunnel may be sealed so as to (1) not allow large water in-flows but may allow water seepage which can be controlled by pumps and (2) not allow large gas in-flows but may allow small gas leakages which can be controlled by a ventilation system.

A shaft is a long approximately vertical underground opening commonly having a circular cross-section that is large enough for personnel and/or large equipment. A shaft typically connects one underground level with another underground level or the ground surface.

A tunnel is a long approximately horizontal underground opening having a circular, elliptical or horseshoe-shaped cross-section that is large enough for personnel and/or vehicles. A tunnel typically connects one underground location with another.

An underground workspace as used in the present invention is any excavated opening that is effectively sealed from the formation pressure arid/or fluids and has a connection to at least one entry point to the ground surface.

A well is a long underground opening commonly having a circular cross-section that is typically not large enough for personnel and/or vehicles and is commonly used to collect and transport liquids, gases or slurries from a ground formation to an accessible location and to inject liquids, gases or slurries into a ground formation from an accessible location.

Well drilling is the activity of collaring and drilling a well to a desired length or depth.

Well completion refers to any activity or operation that is used to place the drilled well in condition for production. Well completion, for example, includes the activities of open-hole well logging, casing, cementing the casing, cased hole logging, perforating the casing, measuring shut-in pressures and production rates, gas or hydraulic fracturing arid other well and well bore treatments and any other commonly applied techniques to prepare a well for production.

Wellhead control assembly as used in the present invention joins the manned sections of the underground workspace with and isolates the manned sections of the workspace from the well installed in the formation. The wellhead control assembly can perform functions including: allowing well drilling, and well completion operations to be carried out under formation pressure; controlling the flow of fluids into or out of the well, including shutting off the flow; effecting a rapid shutdown of fluid flows commonly known as blow out prevention; and controlling hydrocarbon production operations.

It is to be understood that a reference to oil herein is intended to include low API hydrocarbons such as bitumen (API less than ~10°) and heavy crude oils (API from ~10° to ~20°) as well as higher API hydrocarbons such as medium crude oils (API from ~20° to ~35°) and light crude oils (API higher than ~35°).

Primary production or recovery is the first stage of hydrocarbon production, in which natural reservoir energy, such as gasdrive, waterdrive or gravity drainage, displaces hydrocarbons from the reservoir, into the wellbore and up to surface. Production using an artificial lift system, such as a rod pump, an electrical submersible pump or a gas-lift installation is considered primary recovery. Secondary production or recovery methods frequently involve an artificial-lift system and/or reservoir injection for pressure maintenance. The purpose of secondary recovery is to maintain reservoir pressure and to displace hydrocarbons toward the wellbore. Tertiary production or recovery is the third stage of hydrocarbon production during which sophisticated techniques that alter the original properties of the oil are used. Enhanced oil recovery can begin after a secondary recovery process or at any time during the productive life of an oil reservoir. Its purpose is not only to restore formation pressure, but also to improve oil displacement or fluid flow in the reservoir. The three major types of enhanced oil recovery operations are chemical flooding, miscible displacement and thermal recovery.

Soft ground means any type of ground requiring substantial support as soon as possible after the excavated opening is formed ion in order to maintain stability of the opening. Soft-ground is generally easy to excavate by various mechanical or hydraulic means but requires some form of ground support to maintain the excavated opening from collapse. Ground support may include, for example, permanent solutions such as grouting, shotcreting, or installation of a concrete or metal liner; or temporary solutions such as freezing or soil modification.

A drilling room as used herein is any self-supporting space that can be used to drill one or more wells through its floor, walls or ceiling. The drilling room is typically sealed from formation pressures and fluids.

Hydraulic mining means any method of excavating a valuable ore by impact and/or erosion of high pressure water from a hose or water jet nozzle.

Secant Pile means an opening formed by installing intersecting concrete piles by either drilling, augering, jacking or driving the piles into place and then excavating the material from the interior of the opening formed by the piles. A secant pile (sometimes called the tangent) may be formed using primary piles installed first and then secondary piles installed in between or overlapping the primary piles, once the primary piles attain sufficient strength.

Ground modification typically means freezing the ground to stabilize an excavation in soft ground especially caving soils and to prevent groundwater seepage into the excavation. The freezing method provides artificially frozen soil that can be used temporarily as a support structure for tunneling or mining applications. The process increases the strength of the ground and makes it impervious to water seepage so that excavation can proceed safely inside the frozen ground structure until construction of the final lining provides permanent support.

NATM means "New Austrian Tunneling Method" and is generally a method where the surrounding rock or soil formations of a tunnel are integrated into an overall ringlike support structure and where the supporting formations will themselves be part of this supporting structure.

Soil mixing means any of various methods of soil mixing or jet grouting methods based on mechanical, hydraulic devices used with or without air, and combinations of each.

Soil mixing typically involves methods of mixing, for example, cement, fly ash or lime with the in-situ soil so as to cause the properties of the soil to become more like the properties of a soft rock.

As used herein, "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

BRIEF DESCRIPTION OF THE DRAWINGS

FIG. 26*a* shows the shaft wall 2601 with a drill assembly in position to begin drilling. The drill assembly is comprised of a drill bit 2606 and a drill steel 2608, both of which are contained in a steel shield 2607. The steel shield 2607 forms a pressure vessel around the drill assembly during the drilling phase of the operation. The steel shield 2607 is sealed to the drilling rig (not shown) by any number of well-known means (also not shown), The steel shield 2607 will ultimately form the housing of the recess that is being installed. The steel shield 2607 may be rotated during drilling or it may be pipe-jacked (pushed but not rotated). FIG. 26*b* shows the drill bit 2606 and steel shield 2607 having drilled through the shaft liner wall 2601 and continuing to drill or bore into the formation. FIG. 26*c* shows the drill bit 2606 and steel shield 2607 penetrated into the formation.

DETAILED DESCRIPTION

Figure 1:
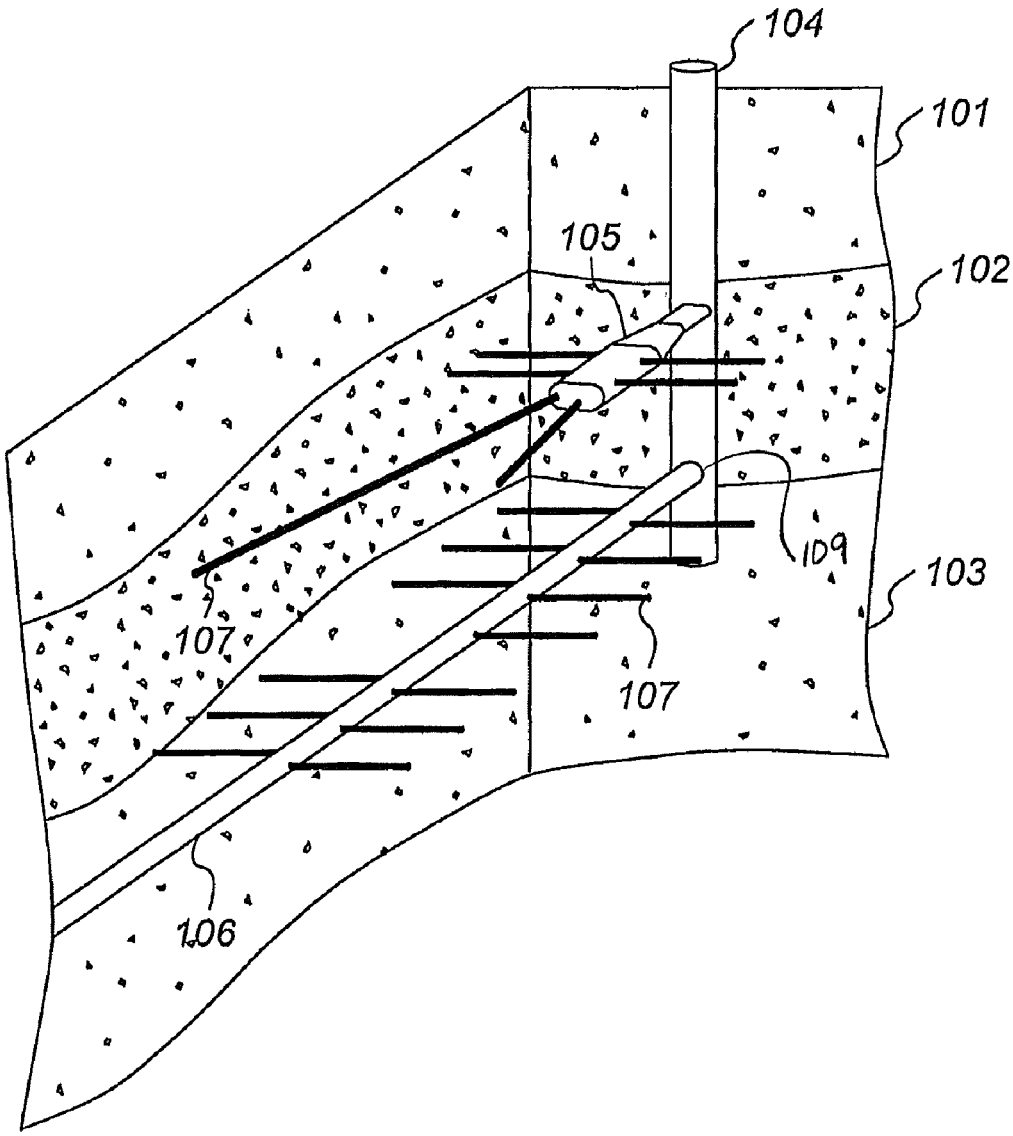
FIG. 1 is an isometric view of an example shaft, drilling room and tunnel facility.

FIG. 1 is an isometric view of an example shaft, drilling room and tunnel facility. As an example, a shaft 104 is shown installed through an overburden 101, a hydrocarbon reservoir zone 102 and terminating in a basement layer 103. Wells may be drilled into the hydrocarbon formation 102 from the shaft 102 as will be described in subsequent figures. A drilling room 105 is shown installed in the hydrocarbon formation 102 from the shaft 104 and wells 107 are shown installed into the hydrocarbon formation 102 from the drilling room 105. As can be appreciated, the drilling room can be installed from the shaft 104 above, within or below the hydrocarbon formation 102, depending on, for example, the type of reservoir being produced. A tunnel 105 is also shown installed in the hydrocarbon formation 102 from the shaft 104 and wells 107 are shown installed into the hydrocarbon formation 102 from the tunnel 105. In effect the tunnel can be considered as a long drilling room but is typically formed by a tunnel boring machine or other tunneling technique. As will be discussed in subsequent figures, a drilling room may be formed by a variety of methods but are generally too short to warrant excavation by a tunneling machine. As can be appreciated, drilling rooms may be installed in the hydrocarbon formation 102 from the tunnel 106 and wells subsequently installed into the hydrocarbon formation 102 from these drilling rooms.

A key feature of this installation are the junctions 109 between the shaft 104 and the tunnel 106. If these junctions are in a pressurized or gassy or fluid-saturated portion of the formation, they must be sealed junctions. The junctions are not necessarily sealed during installation as dewatering, degassing or other well known techniques can be applied during installation to cope with fluid or gas inflows. A method for maintaining a seal at such junctions 109 during installation is described in FIG. 28.

Recesses Formed in Shaft or Tunnel Walls

Figure 2:
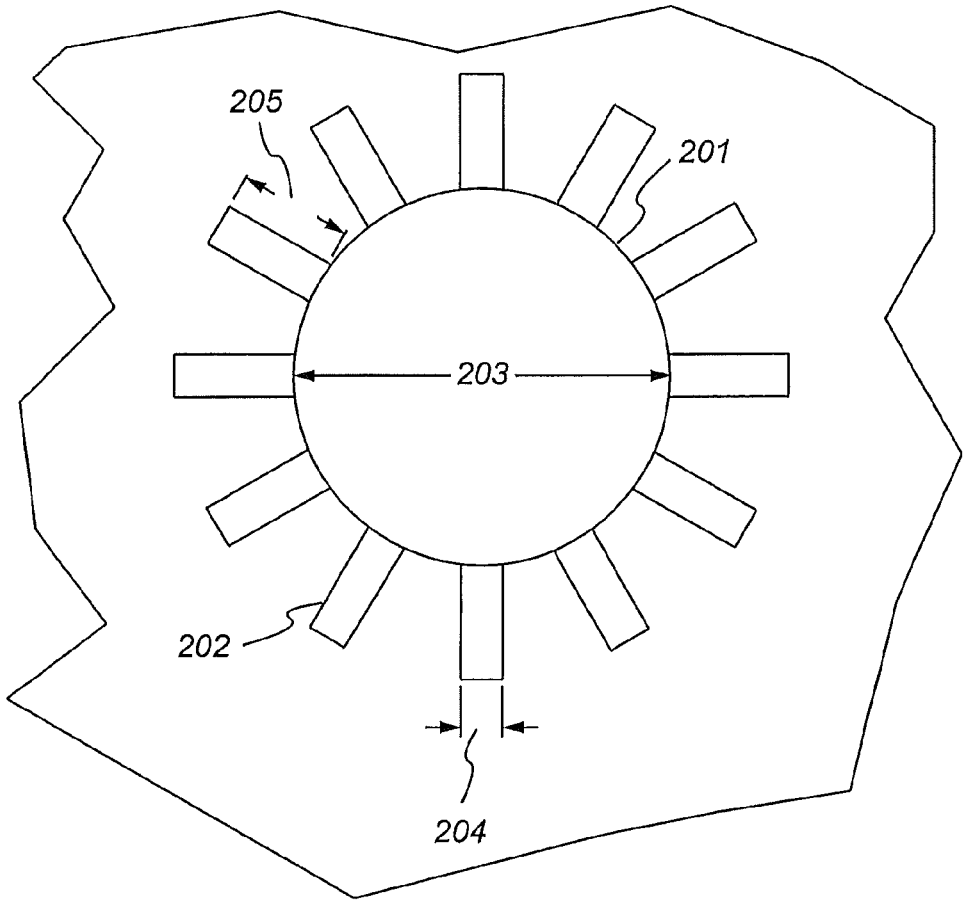
FIG. 2 is a plan view of a lined shaft and a plurality of well-head recesses.

FIG. 2 is a plan view of a lined shaft 201 and a plurality of well-head recesses 202. The shaft 201 is shown with an inside diameter 203 which is the range of about 4 meters to about 10 meters. FIG. 2 shows twelve recess cavities 202 which are installed approximately along radial lines from the center of the shaft and spaced at approximately equal angles. The diameters 204 of the recesses 202 are in the range of about 1 meter to about 2 meters. The lengths 205 of the recesses 202 are in the range of about 4 meters to about 10 meters. Once installed, the recesses 202 serve as the working space for installing blow-out preventer and other well-head equipment. The recesses are large enough to allow personnel to work in them or to utilize robotic equipment to perform the necessary work. In this way, a large number of horizontal wells can be drilled out into the formation from the confined working space at the bottom of the shaft 201. The working volume provided by the recesses can approximately double or triple the working space available on a working level of the shaft alone.

Figure 3:
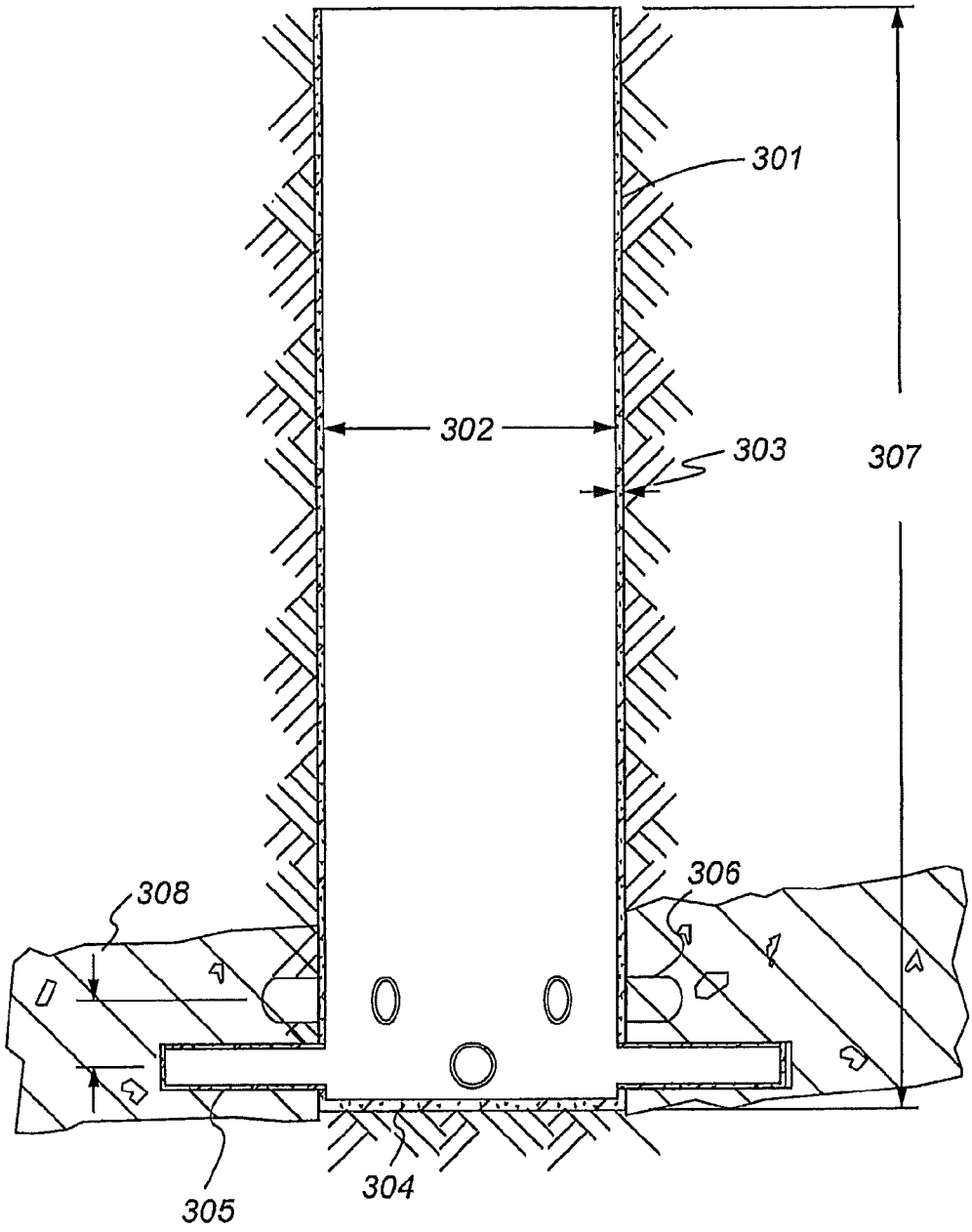
FIG. 3 is a cutaway side view of a lined shaft and a offset well-head recesses.

FIG. 3 is a cutaway side view of a lined shaft 301 and a offset well-head recesses 305. As can be appreciated, the depth of the shaft 307 is determined by the depth of the hydrocarbon deposit being developed. Typically, the depth of the shaft 307 is in the range of about 40 meters to about 500 meters. The shaft liner 301 which is typically formed from concrete has a diameter 302 typically in the range of about 3 meters to about 10 meters and a wall thickness 303 that is typically in the range of about 0.1 meter to about 0.4 meters. This figure illustrates how some recesses 305 can be installed on one level while other recesses 306 can be installed on a different level. The levels may be separated by a distance 308 which can be as large as desired but no less than about 1 diameter where the diameter is that of the recess. By offsetting recesses, more recesses can be installed in one location. As can be appreciated, wells can be drilled from the offset recesses into the formation and, using well-known directional drilling techniques, can be installed at the same level in the hydrocarbon formation, even though they originate higher or lower in the shaft than some of their neighboring recesses.

Figure 4:
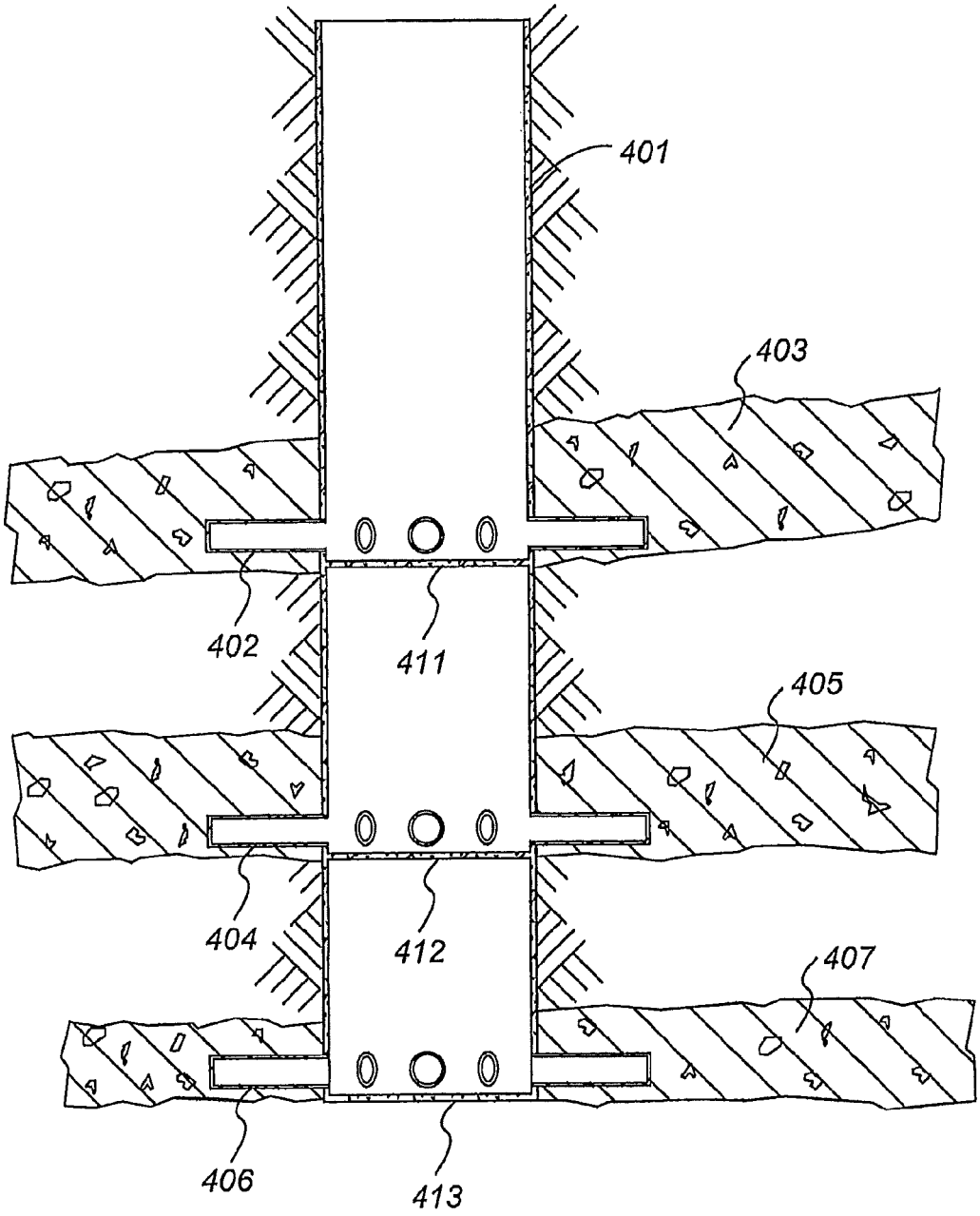
FIG. 4 is a cutaway side view of a multi-level shaft with a plurality of well-head recesses.

FIG. 4 is a cutaway side view of a multi-level shaft with a plurality of wellhead recesses. This figure illustrates how a single shaft can be used to drill wells into different producing zones within a hydrocarbon reservoir. A lined shaft 401 is shown piercing producing zones 403 and 405 and being terminated in producing zone 407. A floor 411 is installed in the shaft to act as a working platform for installing recesses 402 which are installed into producing zone 403. As can be appreciated, the floors can be installed on various levels within the shaft either sequentially as the shaft is drilled/sunk or they can be added later as needed to access the various reservoir producing zones. Because reservoir horizons may be exploited by different techniques (cold flood drive, gravity drain, thermal stimulation, for example), the various working levels within the shaft may be installed or removed when a particular reservoir zone is produced. As described in FIGS. 2 and 3, anywhere from 1 or 2 to approximately 24 recesses can be installed from any one level. A second floor 412 is installed in the shaft to act as a working platform for installing recesses 404 which are installed into producing zone 405. The bottom of the shaft 413 acts as a working platform for installing recesses 406 which are installed into the bottom producing zone 407. As can be appreciated, this approach can be used to install recesses and, from the recesses, drill wells into as many producing zones as are found in the reservoir.

Figure 5:
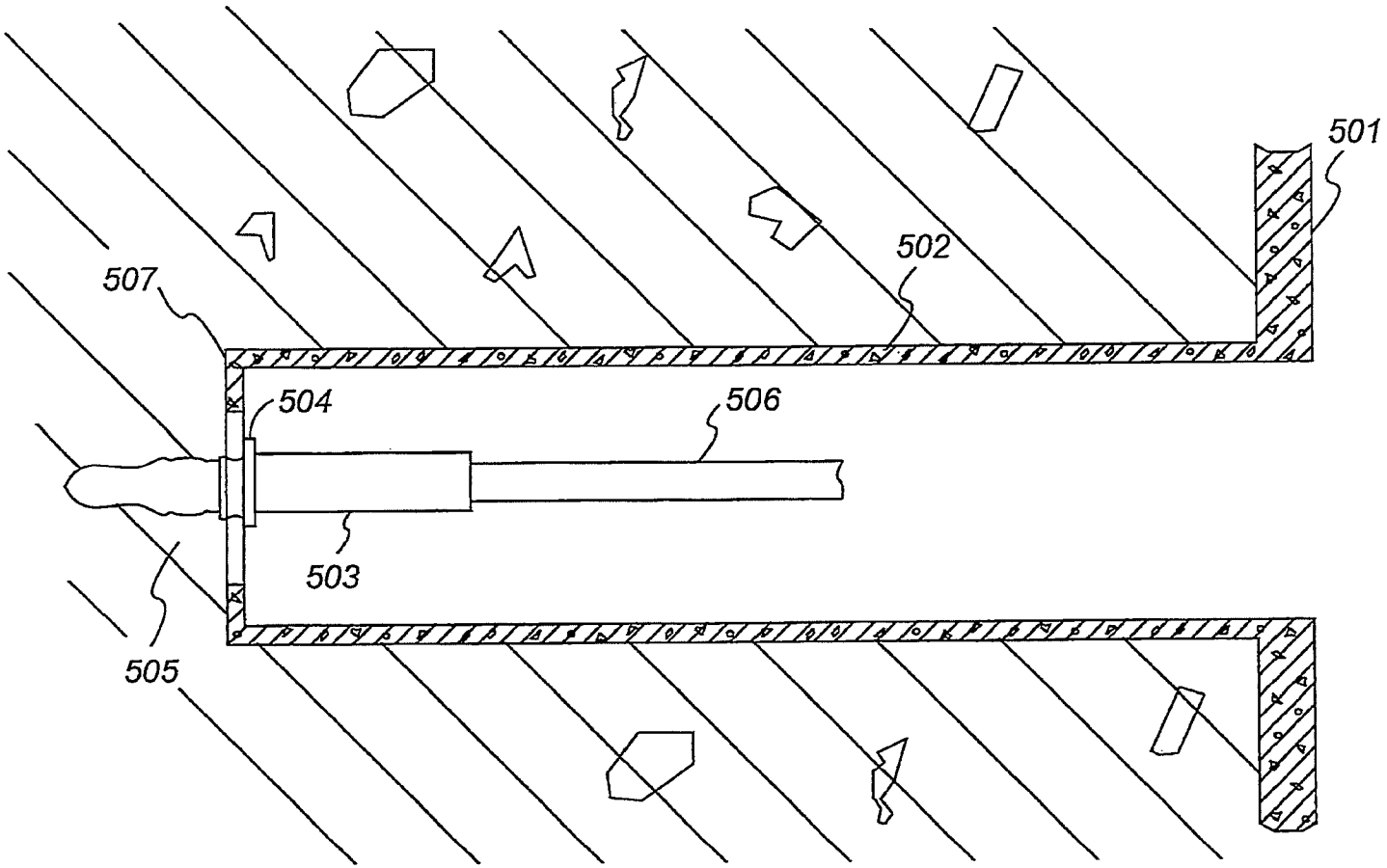
FIG. 5 is a close up cutaway side view of a well-head recess with well-head equipment installed.
Figure 8:
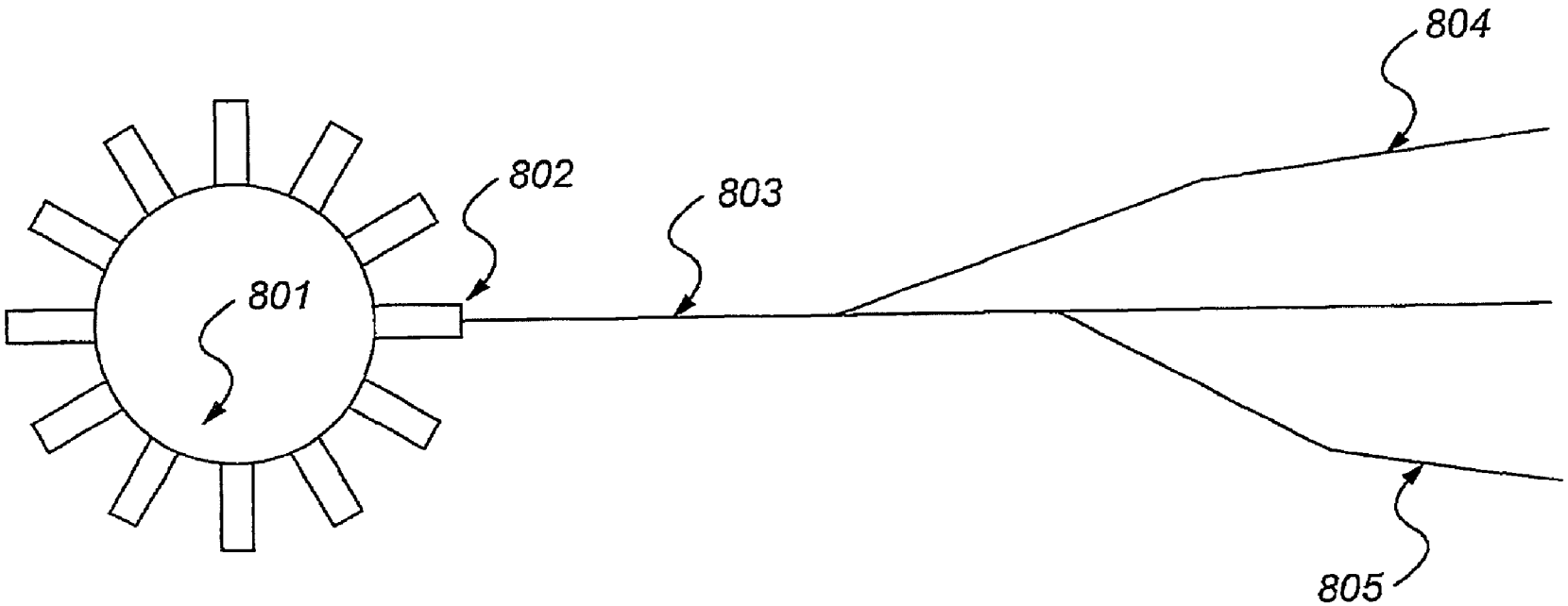
FIG. 8 is a plan view showing a well drilled from a shaft of the present invention with offshoots.

FIG. 5 is a close up cutaway side view of a well-head recess 502 with well-head equipment 503 installed. The recess 502 is attached and sealed to the shaft liner 501. A method of installing recesses under pressure is fully described in FIG. 8. FIG. 8 also shows a recess end flange which has a threaded plug that can be removed for installing the well-head equipment 503. The well-head equipment 503 is secured to the recess end plate 507 by a flange 504. A portion of the well-head equipment 503 is set into the formation 505. As shown, that portion is typical of well-production operations and collects hydrocarbons and delivers them to a piping system 506.

Figure 6:
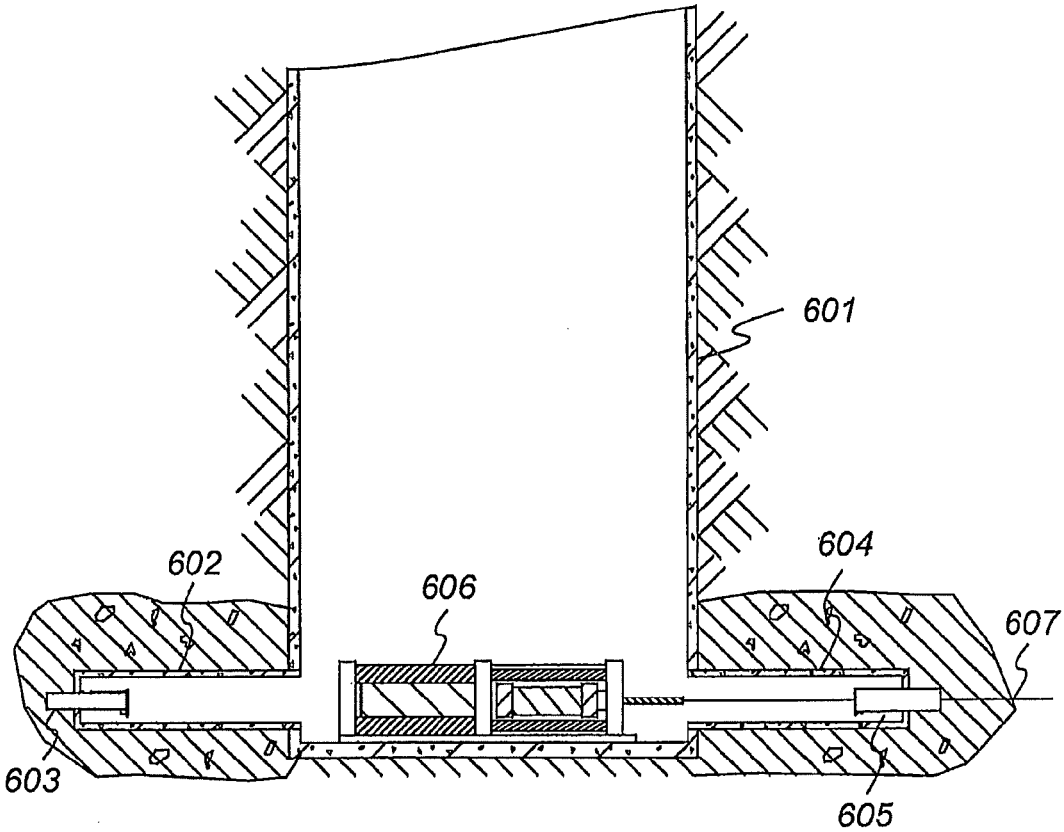
FIG. 6 is a cutaway side view of a well-head recess with well-head equipment installed and drilling equipment drilling a well.

FIG. 6 is a cutaway side view of a well-head recess 602 with well-head equipment 603 installed. Also shown is drilling equipment 606 drilling a well 607 through blow-out preventer apparatus 605 located in recess 604. Both recesses shown are located at the bottom of shaft 601. As can be seen, the well-head equipment, once installed as shown by 603, does not interfere with on-going drilling operations in other recesses. This means, for example, that not all wells need be drilled at the same time. With the recess configuration, additional recesses can be installed and additional wells can be completed while the original wells continue to be operated.

A drill rig suitable for drilling from a shaft or tunnel is prior art. As can be appreciated, the drill rig must be compact. As can be seen in FIG. 6, the drill motor is located in the center of the rig and surrounded by 4 large hydraulic cylinders. This system has a short but powerful drilling stroke. The length of the wells that can be drilled with such a rig is in the range of about 100 meters to about 1,000 meters. The length is achieved by adding many short lengths of drill steel as the well is drilled. A drill rig such as shown can be used to install casing and service operating wells from time to time. The principal components of the drill rig are a drill motor, a drill steel, hydraulic cylinders. The rig is typically mounted on a skid or it may have wheels for moving along a tunnel floor or tracks.

Figure 7A:
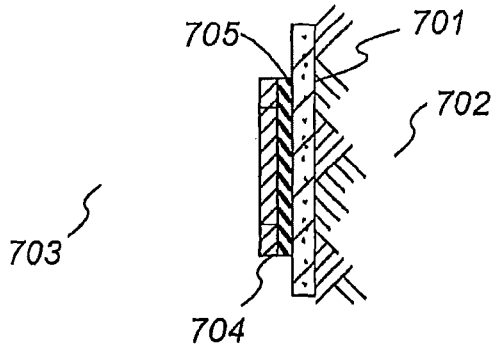
FIG. 7*a-h* is a sequence illustrating installing a recess under pressure.
Figure 7B:
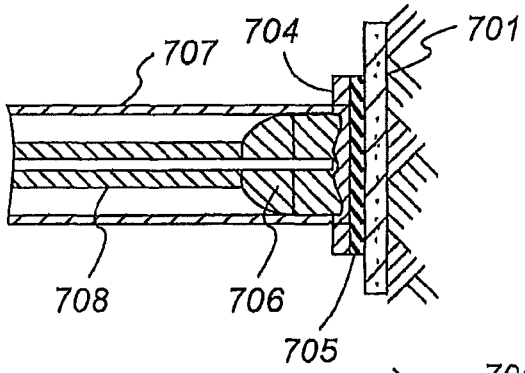
Figure 7C:
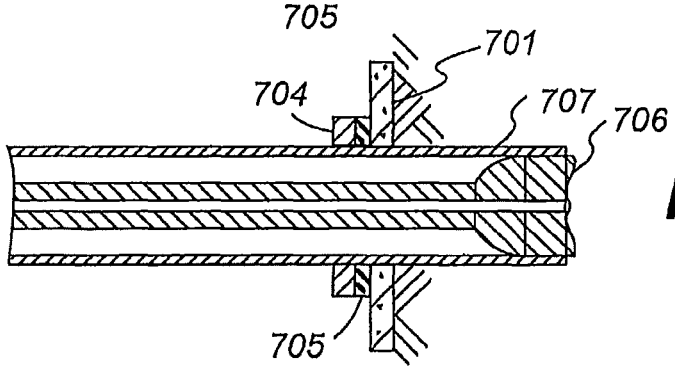
Figure 7D:
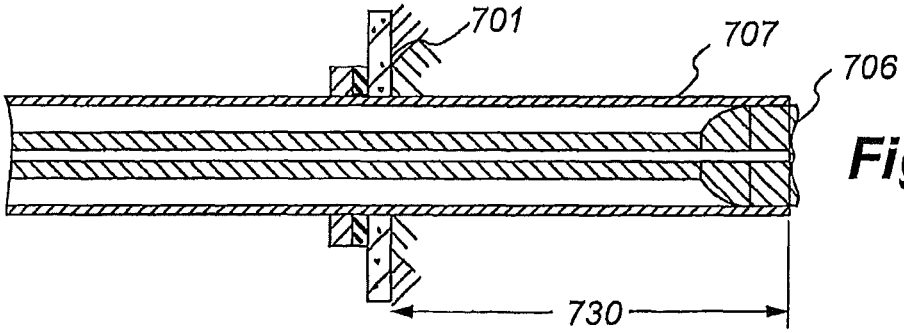

FIG. 7*a-h* illustrates a method of installing a well-head recess when there is significant formation pressure. The method is applicable to formation pressures as high as about 20 bars above the ambient pressure inside the shaft. The method is applicable when a recess is to be installed from inside a lined shaft into the surrounding formation when the surrounding formation has or is thought to have a formation pressure and/or the possibility of substantial water or gas inflow. FIG. 7*a* shows a cross-section of shaft liner 701 which is typically formed from concrete and has a wall thickness in the range of about 0.1 meter to about 0.4 meters. The ground formation in which the shaft is sunk is on the side 702 and the interior, working space of the shaft is on side 703. A flange 704 is bolted onto the inside of the shaft liner wall 701 and secures a gasket 705 between the flange 704 and the liner wall 701. The flange 704 is typically made of steel and is typically in the thickness range of about 0.1 meter to about 0.4 meters and in the diameter range of about 1 meter to about 2.5 meters. The gasket 705 is about the same outside diameter as the flange and has an inside diameter substantially less than the anticipated diameter of the recess to be installed. The gasket may be a full-face gasket. The gasket has a thickness in the range of about 10 millimeters to about 50 millimeters. The gasket is made from any sealing material such as for example rubber, urethane, polyethylene, teflon or the like. The gasket may be made from other materials or may be made as a labyrinth of metallic strands or other well-known structure capable of forming a seal. FIG. 7*b* shows the shaft wall 701 with a drill assembly in position to begin drilling through the gasket 705 and shaft liner 701. The drill assembly is comprised of a drill bit 706 and a drill steel 708, both of which are contained in a steel shield 707. The steel shield 707 forms a pressure vessel around the drill rig assembly during the drilling phase of the operation. The steel shield 707 is sealed to the drilling rig (not shown) by any number of well-known means (also not shown). The steel shield 707 will ultimately form the housing of the recess that is being installed. The steel shield 707 may be rotated during drilling or it may be pipe-jacked (pushed but not rotated). The diameter of the steel shield 707 is in the range of about 1 meter to about 2 meters and fits closely within the inner diameter of the flange 704. The steel shield 707 is typically in the thickness range of about 15 millimeters to about 50 millimeters. As shown in FIG. 7*b*, the drill bit is in position to pierce through the sealing gasket 705. FIG. 7*c* shows the drill bit 706 and steel shield 707 having drilled through the gasket 705 and shaft liner wall 701 and continuing to drill or bore into the formation. Drilling mud is shown being pumped down the center of the drill steel 708, as shown by an arrow, and at emerges through jets in the drill bit 706. The cuttings and drilling mud flow back through the flutes of the drill bit 706 and along the annulus formed by the drill steel 708 and the steel shield 707, as shown by arrows. The gasket 704 forms a seal between the outer wall of the steel shield 707 and the inside of the shaft liner wall 701 as shown by 709. FIG. 7*d* shows the drill bit 706 and steel shield 707 at their maximum penetration into the formation as indicated by length 730. Maximum penetration length 730 is typically in the range of about 4 meters to about 10 meters beyond the shaft wall 701.

Figure 7E:
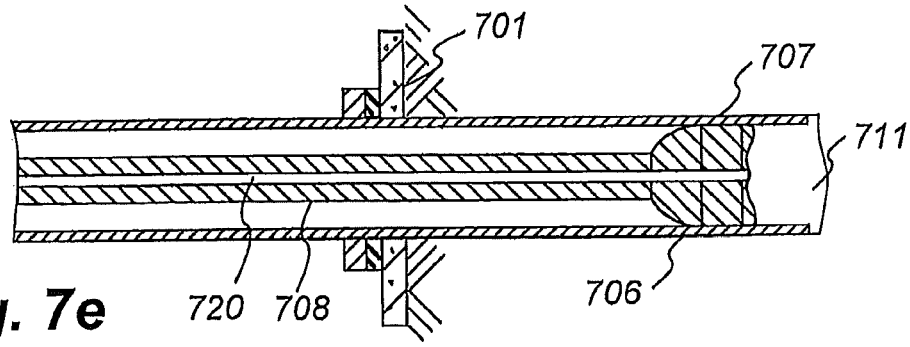
Figure 7F:
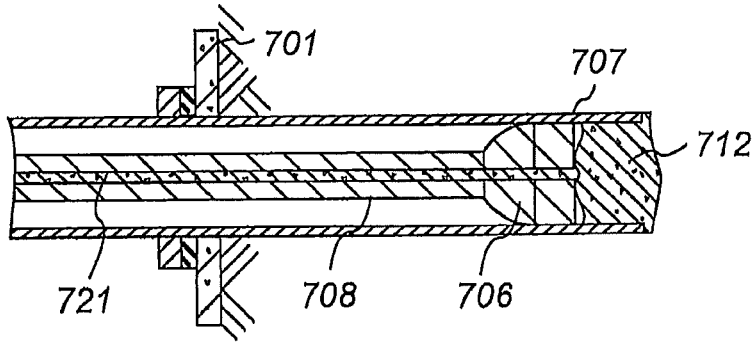
Figure 7G:
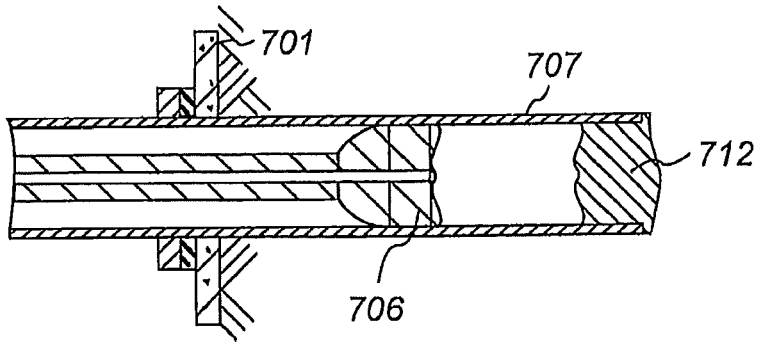
Figure 7H:
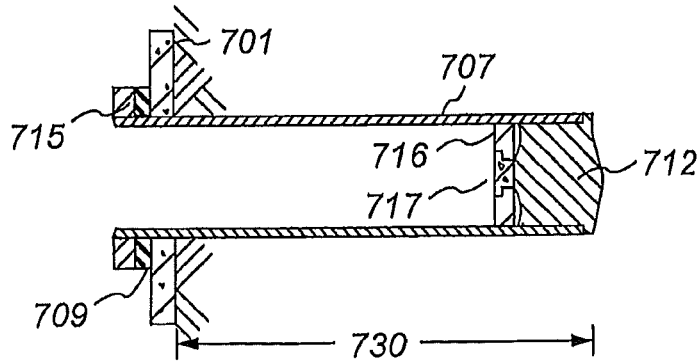

FIG. 7*e* shows how the drill bit 706 is now withdrawn a small distance inside the steel shield 707 leaving an excavated void 711. The steel shield 707 is not allowed to move any significant amount. The withdrawal distance is in the range of about 0.3 steel shield diameters to about 1 steel shield diameter. FIG. 7*f* shows grout or concrete being pumped down a hole 721 in the drill steel 708, as shown by an arrow, and through the drill bit 706 to fill the volume 711 with a concrete or grout plug 712. The plug 712 forms a temporary seal between the formation and the steel shield 707. In FIG. 7*g*, the grout or concrete forming the plug 712 has set and has achieved sufficient strength to form a seal and allow the drill bit 706 to be withdrawn back into the shaft. At this time, the seal between drilling rig and the steel shield may be broken. FIG. 7*h* shows the completed recess. The steel shield 707 is secured to the wall flange (flange 704 in FIG. 7*a*) by a threaded or welded flange 715 attached to the end of the steel shield 707. The gasket 709 (gasket 705 in FIG. 7*a*) forms a seal between the shaft wall 701, the shaft liner wall 701 and the formation. Another gasket (not shown) may be placed between the flange 715 and the wall flange (flange 704 in FIG. 7*a*). A steel end plate 716 is installed inside the steel shield 707 and threaded or welded in place, up against the concrete plug 712. The steel plate 716 contains a threaded steel plug 717 which may be removed to install a blow-out preventer apparatus (see FIG. 5). Once the blow-out preventer apparatus is installed, a well drilling rig may be positioned to drill through the blow-out preventer apparatus and through the concrete or grout plug 712 and into the formation.

The drill bit shown in FIG. 7 may comprise a pilot probe that leaves a smaller diameter short hole in the grout or concrete plug. This would allow well-head equipment to be installed in the steel end plate in place of the threaded steel plug. Alternately, the steel plug can be removed to allow a short hole to be drilled into the grout or concrete plug and then the well-head equipment can be installed. Both methods allow the well-head equipment to be installed without being exposed to formation pressure.

The sequence of operations shown in FIG. 7 illustrates one embodiment of the present invention. The same installation procedure can be accomplished, for example, using a modified micro-tunneling machine which has been suitably modified to allow the cutting head to be removed at the end of the excavation cycle. In the presence of formation fluids and formation pressure, the recesses may also be formed by other known methods. For example, the ground around the proposed recess can be frozen so that the frozen ground will provide temporary ground support for a recess hole to be drilled, lined and sealed. If the formation fluids and formation pressures are not substantial, soil mixing is another procedure that may be used to provide temporary ground support for a recess hole to be drilled, lined and sealed. Alternately, a steel pipe can be pipe-jacked or pile driven into the formation to form the liner for a recess. The material within the recess pipe can then be excavated and an end plate installed to provide a sealed recess.

Drilling Patterns

FIG. 8 is a plan view showing a well 803 being drilled from a recess 802 located in a shaft 801. Once the main well 803 is completed, the driller can drill any number of offshoot wells such as 804 and 805 by well-known directional drilling methods. As shown in FIG. 8, the offshoot wells 804 and 805 are directionally drilled to ultimately follow radial paths where the radials emanate from the center of the shaft diameter. Thus, although there are a limited number of recesses that can be installed in a shaft of a given diameter, any number of wells can be drilled from the shaft to form a dense radial network of installed wells. As can be appreciated, the offshoot wells can be drilled to follow any trajectory and do not have to form a radial network as shown.

Figure 9A:
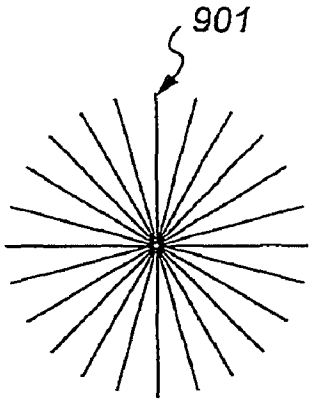
FIG. 9 shows plan views of example well patterns drilled from a shaft.
Figure 9B:
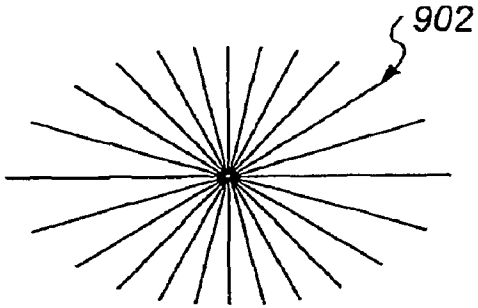
Figure 9C:
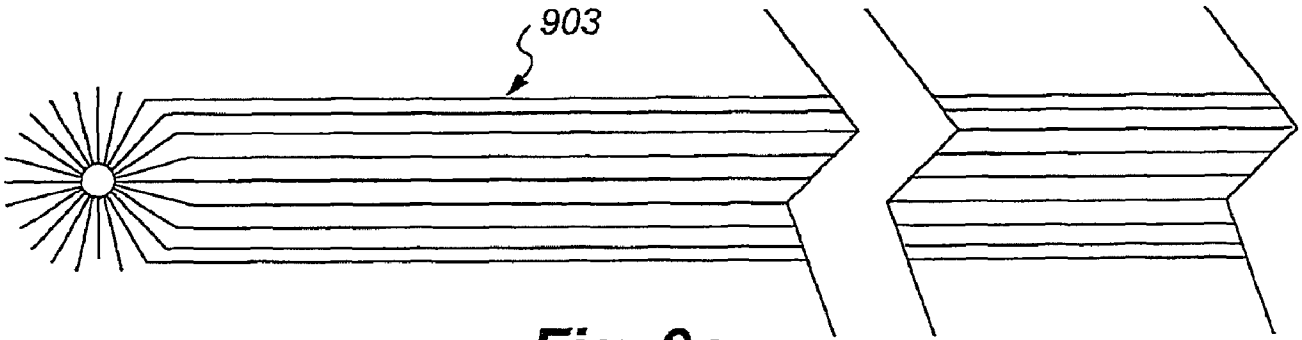

FIG. 9*a* is a plan view of a circular well pattern drilled from a shaft. Wells such as 901 may be drilled out approximately radially as shown to drain a circular area of reservoir. Many wells may be drilled from a limited number of recesses as described in FIG. 8. For example, if the wells are approximately 700 meters long, the pattern shown in FIG. 9*a* would be capable of draining approximately 375 acres of reservoir. As can be appreciated, additional wells can be drilled from other levels within the shaft such as shown for example in FIG. 4. FIG. 9*b* is a plan view of an elliptical well pattern drilled from a shaft. Wells such as 902 may be drilled out approximately radially with variable lengths as shown, to drain an elliptical area of reservoir. For example, if the shortest wells are 400 meters long and the longest wells are 1,000 meters in length, then the area drained is approximately 310 acres of reservoir. FIG. 9*c* is a plan view of a well pattern drilled from a shaft into a long narrow hydrocarbon deposit. In this example, a shaft is sunk at one end of the reservoir and a number of wells 903 are directionally drilled from a few recesses on one side of the shaft, primarily in one direction as shown Such a pattern might be employed, for example, to drain a reservoir that is located under a river or a reservoir that follows, for example, an ancient river bed.

Robotic Excavators

Shaft costs are diameter dependent so deep, large diameter shafts (shafts with diameters in the range of about 10 to 35 meters) can be very costly. A shaft for oil recovery needs a large diameter workspace near or at the bottom to accommodate drilling and well-head equipment. As described above, one method of providing space for drilling and well-head equipment is to install recesses such as described above. Another method is to enlarge the bottom of a shaft as described in subsequent figures. As with the previous method, these installations are not straightforward when in the presence of formation pressures and fluids. Robotic excavators have been used for a variety of excavation operations under water, including deep-sea operations. Robotic excavators can be used to enlarge the bottom of a shaft in a cost-effective and safe manner.

Figure 10:
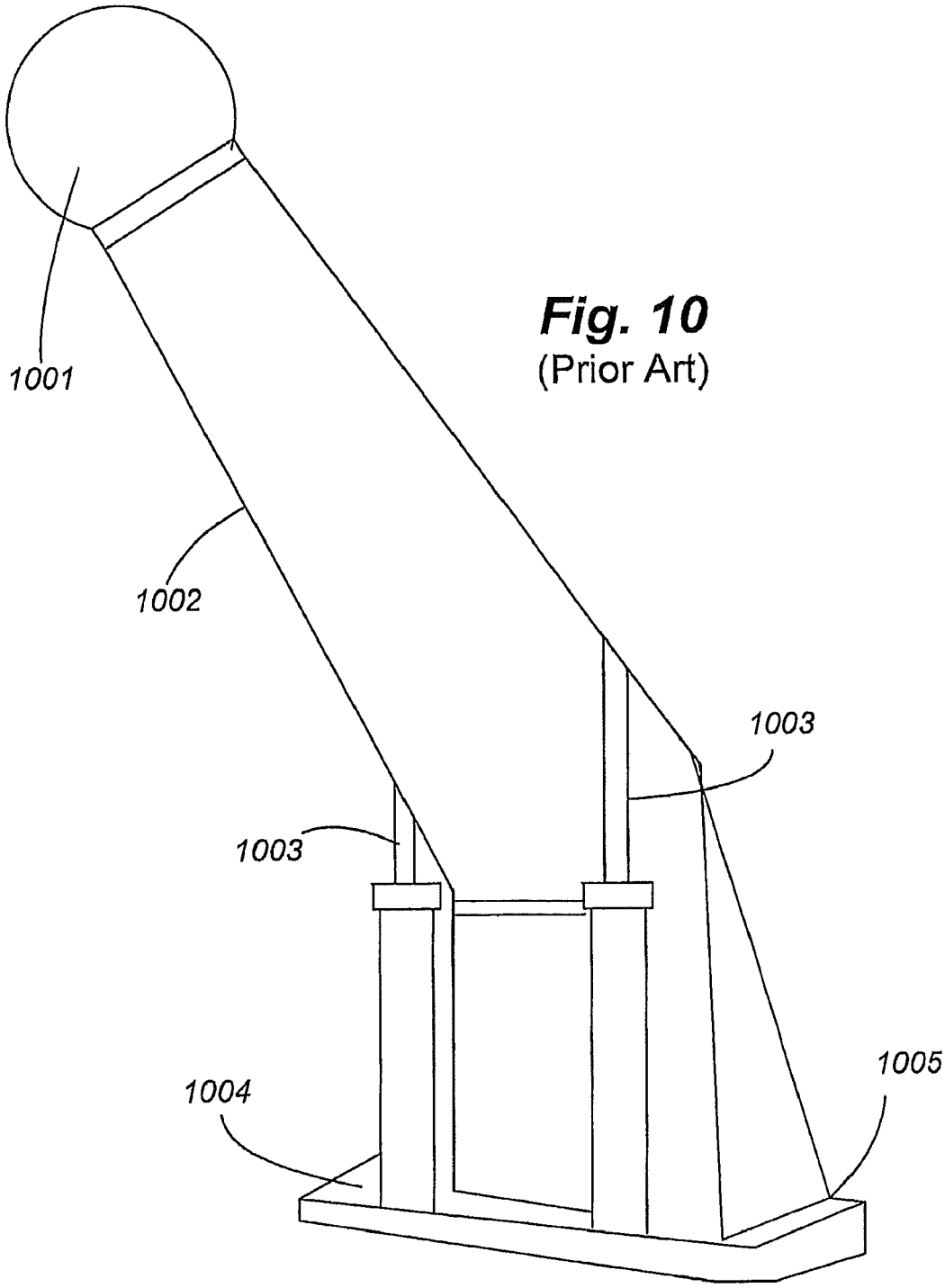
Fig. 10 (Prior Art)
FIG. 10 is an example of a robotic excavator which is prior art.

FIG. 10 is an example of a robotic excavator which is prior art. This figure shows a road-header type cutting head 1001 that cuts by rotating at the end of a hydraulically extendable arm 1002. The angle of the arm is controlled by hydraulic cylinders 1003. The excavating machine can rotate about its base using a mechanical rotary table 1005 and can move back and forth using hydraulic cylinders 1004. As can be appreciated, all of these mechanical and hydraulic subsystems can be operated remotely using various means such as a communications bundle and on-board camera systems to allow an operator to remotely control an excavation process with such a machine.

Figure 11:
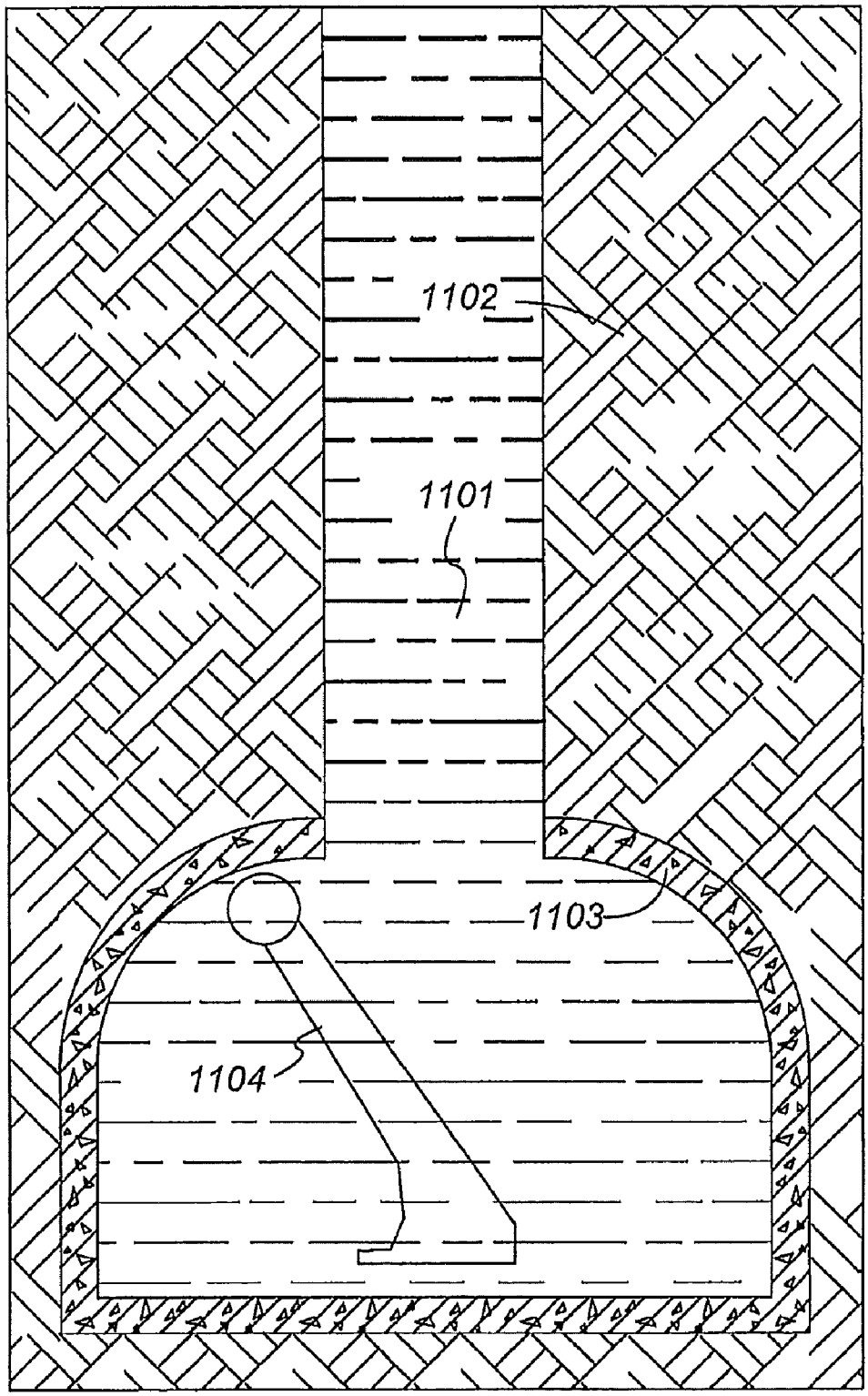
FIG. 11 is an example of a room excavated at the bottom of a shaft using a robotic excavator.

FIG. 11 is an example of a room 1103 formed by concrete and excavated at the bottom of an unlined shaft using a robotic excavator 1104. The unlined shaft is in soft ground 1102 and is kept open by drilling fluid 1101. The process by which the shaft and room are formed is described in more detail in FIG. 14.

Figure 12:
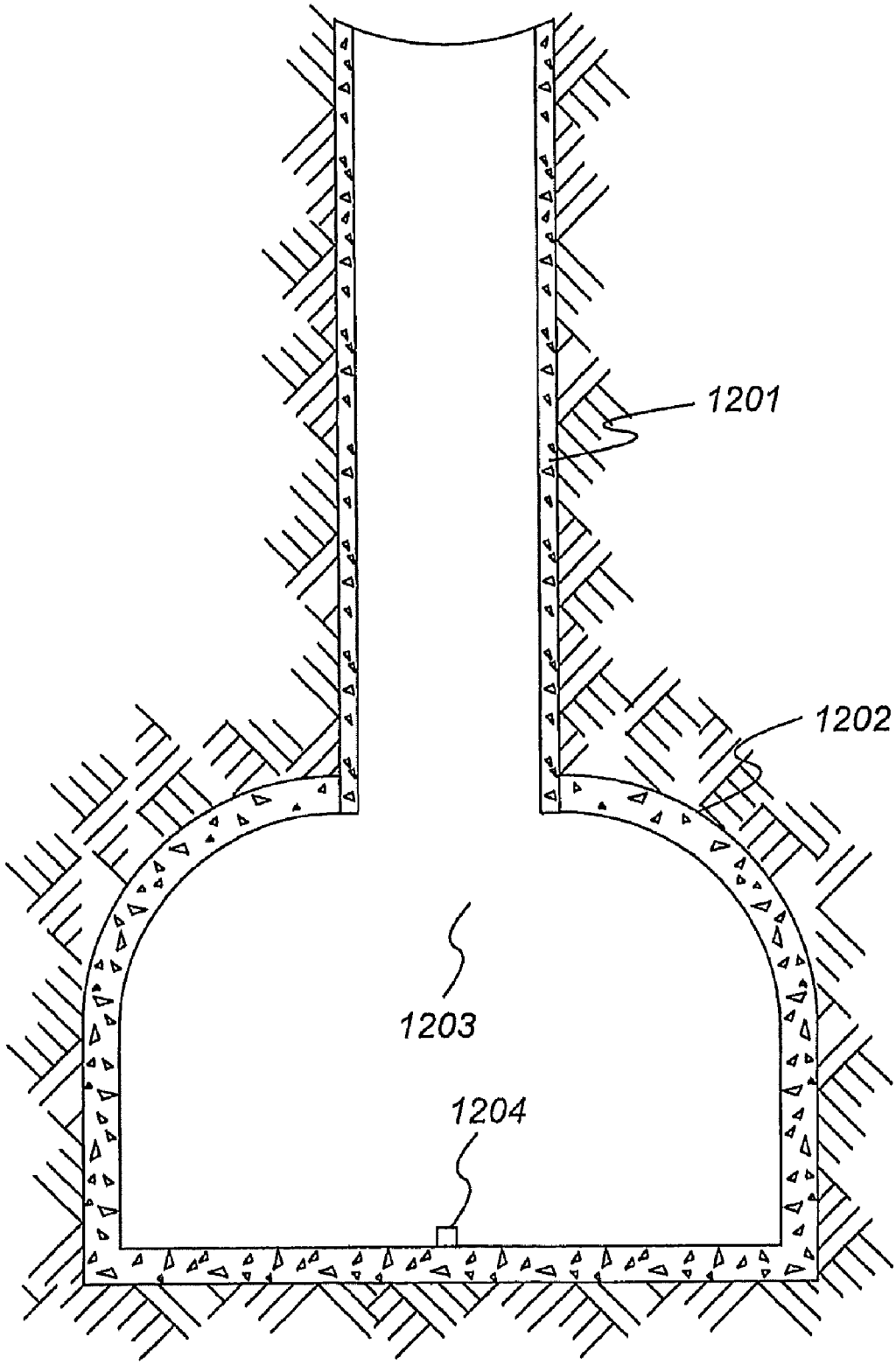
FIG. 12 is an example of a finished room excavated at the bottom of a shaft based on the method of the present invention.

FIG. 12 is an example of a finished room 1202 excavated at the bottom of a lined shaft 1201 based on the present invention. The interior 1203 of the shaft 1201 and room 1202 is filled with air in preparation for workers to begin well drilling operations from the room 1202. The pin 1204 is left over from the construction of the room 1202 and was used as a reference marker for the robotic excavator described in FIGS. 11 and 12. The process by which the lined shaft 1201 and lined room 1202 are formed is described in more detail in FIG. 21. The shaft 1201 envisioned in this embodiment has a diameter in the approximate range of 3 to 5 meters. The room 1202 is envisioned to have a diameter in the range of about 10 to 35 meters.

Figure 13:
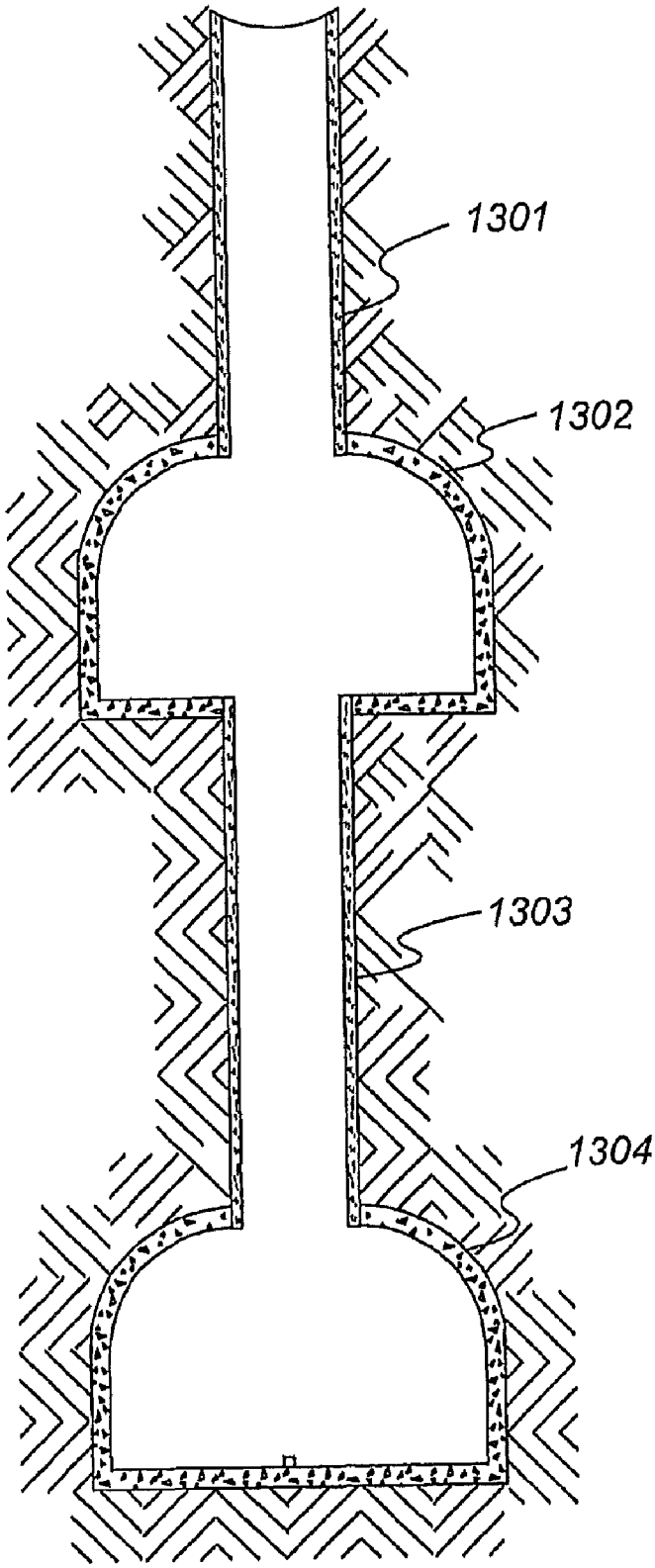
FIG. 13 is an example of a multiple rooms excavated at different levels of a shaft.

FIG. 13 is an example of a multiple rooms excavated at different levels of a shaft using the same methods as described above. This figure shows a lined shaft 1301 with an upper lined room 1302; and a continuation of a lined shaft 1303 terminating in a bottom lined room 1304. Once outfitted with utilities working platforms, elevators, ventilation ducts et cetera, such a room/shaft configuration could be used, for example, to drill wells into different horizons of a hydrocarbon formation. As can be appreciated, more than 2 rooms can be excavated. As can further be appreciated, this method of forming rooms allows most of the shaft to be drilled or sunk with a small, less costly diameter, in the approximate diameter range of 3 to 5 meters, and still provide room where the other work, such as for example, drilling can be carried out. This is a less costly approach than drilling a large diameter shaft where the diameter may be in the range of about 12 to 35 meters, which is the approximate diameter range of drilling rooms required for installing multiple wells. As can be further appreciated, a non-robotic shaft drilling machine can be used in the finished upper room to drill the lower section of shaft as long as the column of drilling mud, now only up to the upper room floor level, is sufficient for ground support of the lower unlined section of shaft.

FIG. 14 is a sequence of principal operations to drill a lined shaft and lined room under formation pressure. In this example, the ground through which the shaft is drilled and the room is excavated is assumed to be soft ground. That is the walls of excavations are not self supporting such as they would be , for example, in hard rock. Therefore the walls of the shaft and room must be supported at all times during excavation until the walls can be finished and lined, typically with concrete for lasting ground support. This is particularly important in soft-ground where there may be gas and/or water zones and the potential for large fluid in-flows.

Figure 14C:
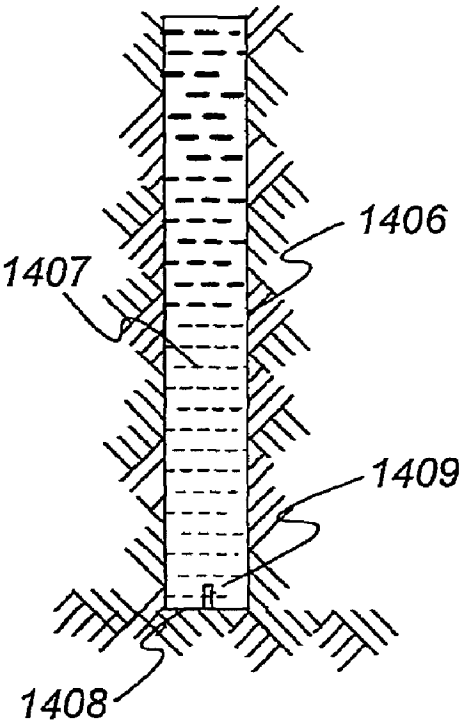
FIG. 14 is a sequence of principal operations to drill a shaft and room under formation pressure.
Figure 14B:
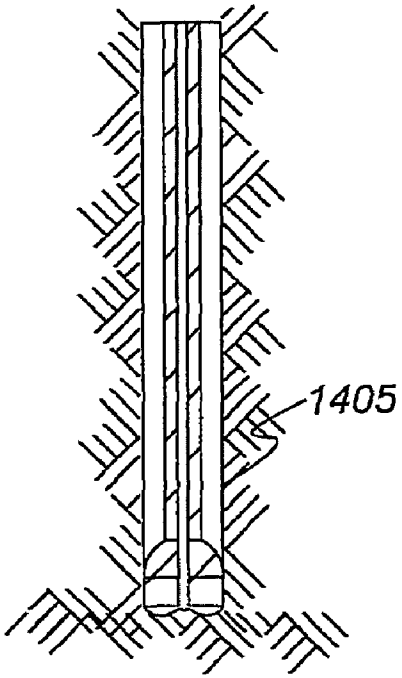
Figure 14A:
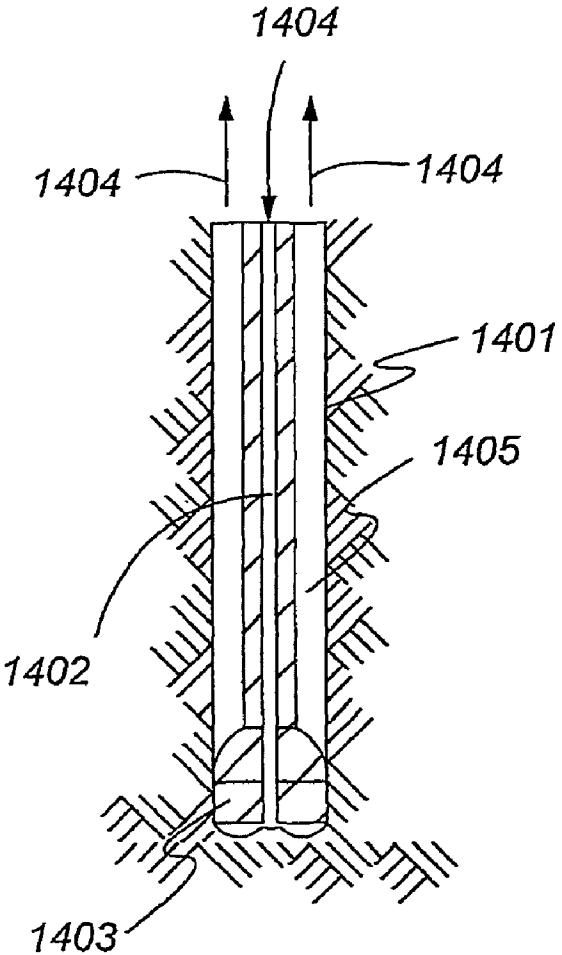

FIG. 14*a* shows a shaft 1401 being drilled by a large rotary bit 1403. Drilling mud 1404 is forced down the center of drill rod 1402 and re-circulates up the annulus between the drill rod 1402 and the open shaft wall 1401 as indicated by the flow arrows. This procedure is well-known and used to drill soft-ground shafts in the approximately 3 to 5 meter diameter range.

FIG. 14*b* shows the shaft 1405 at its maximum depth. FIG. 14*c* shows the unlined shaft 1406 with the drill assembly withdrawn. The shaft walls are held in place by the pressure of the column of drilling mud 1407. Also shown is a reference pin or marker 1409 at the bottom 1408 of the shaft 1406.

Figure 14E:
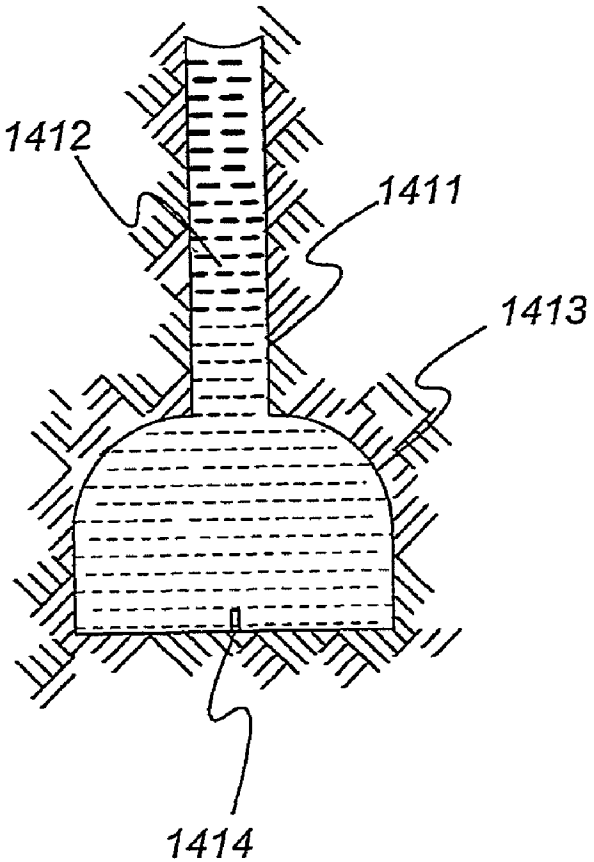
Figure 14D:
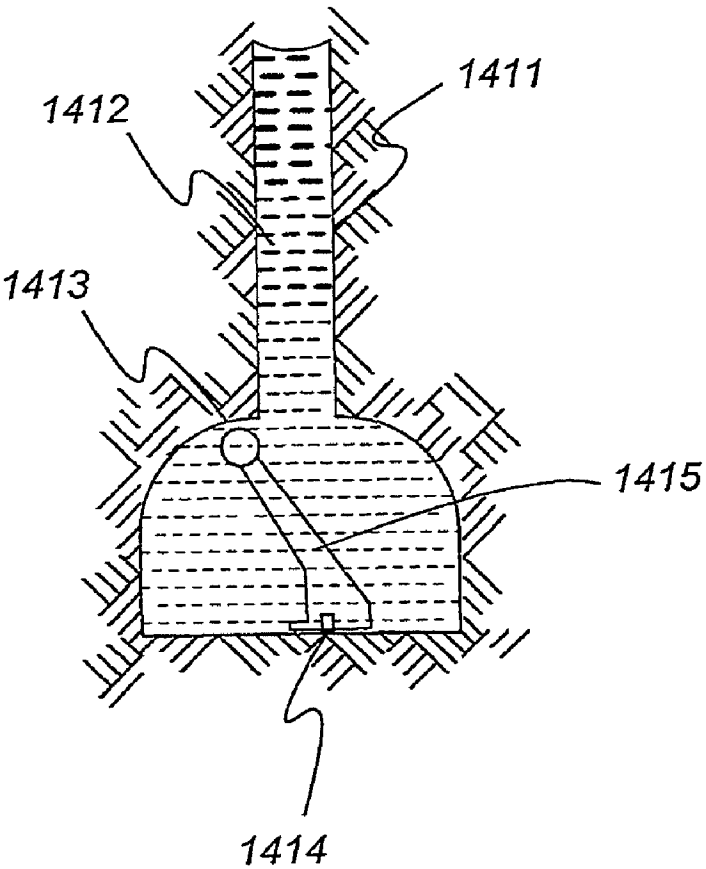

FIG. 14*d* shows a robotic excavator 1415 which has been positioned at the bottom of an open shaft 1411. The excavator 1415 is excavating a room 1413 at the bottom of shaft 1411 while immersed in drilling mud 1412 whose pressure is providing stability for the walls of both the shaft 1411 and room 1413. The excavator 1415 is attached to reference pin 1414 at the bottom of the shaft to provide a known reference point for the remotely located operator to guide the progress of the room excavation. As can be appreciated, it may require more than one excavator to complete the room excavation. For example, a small robotic excavator may be used to form an excavation slightly larger in diameter than the shaft so that a large robotic excavator can continue to enlarge the room. Excavation cuttings are carried away by circulating mud.

FIG. 14*e* shows the finished but unlined room 1413 and the unlined shaft 1411 where both are stabilized by the column of drilling fluid 1412. Reference pin or marker 1414 is also shown at the bottom of the shaft.

Figure 14G:
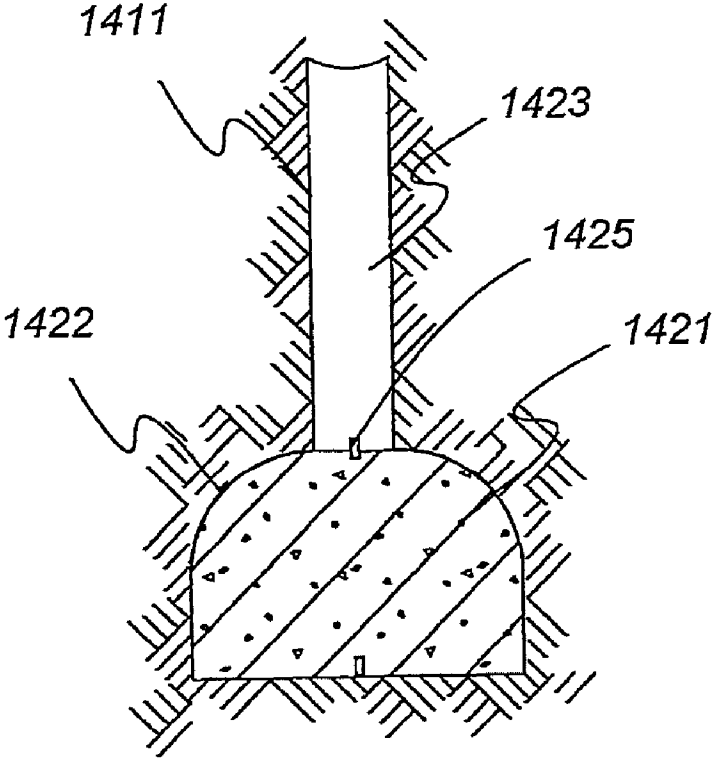
Figure 14F:
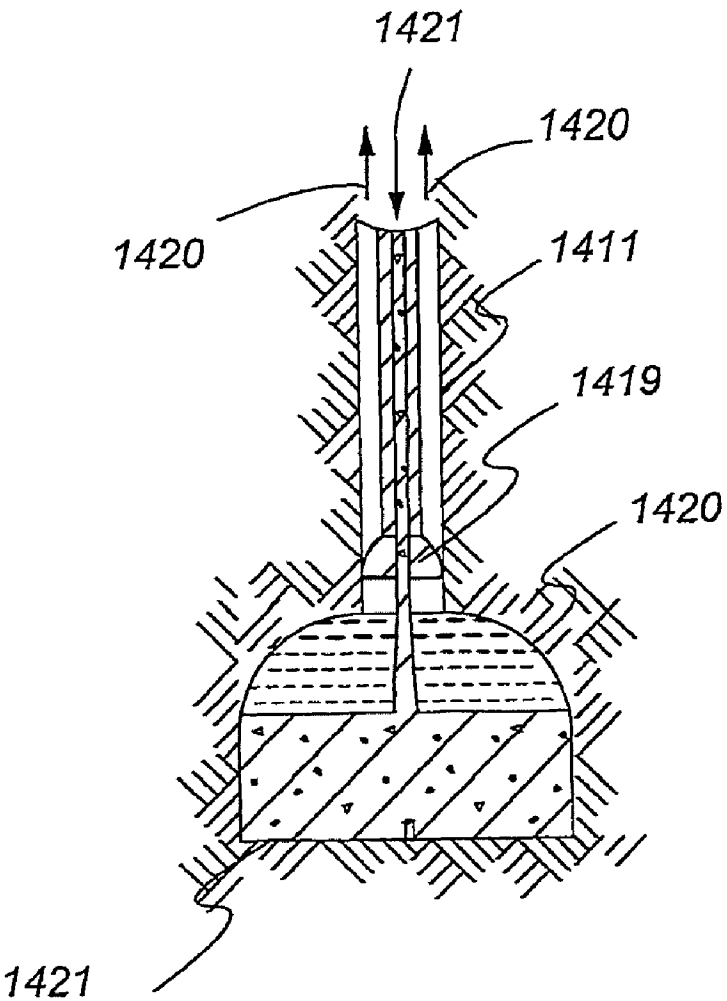

FIG. 14*f* shows a drilling bit 1419 lowered to the top entrance to the excavated room. A weak mix of concrete (for example a 2 sack mix) is injected down the center conduit of the drill rod and drill bit and displaces the drilling fluid 1420 back up the annulus between the drill rod and the shaft walls and replaces the drilling fluid 1420 in the room with weak concrete 1421. As can be appreciated, another specially designed apparatus can be used to inject the concrete and displace the drilling fluid.

FIG. 14*g* shows the drilling apparatus or other specially designed apparatus withdrawn, leaving the room 1422 full of weak concrete 1421 while the shaft 1411 remains open with its walls supported by the pressure of mud column 1423. A second reference pin or marker may be installed in the top portion of the concrete as shown.

Figure 14I:
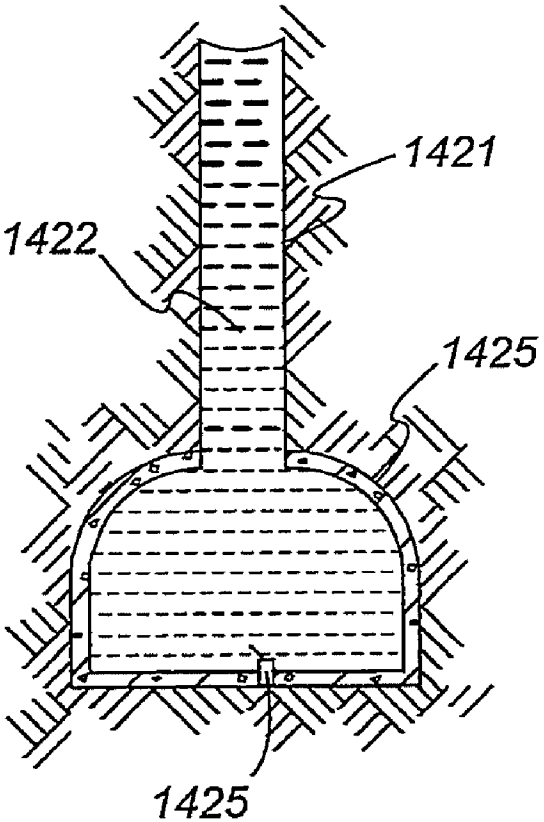
Figure 14H:
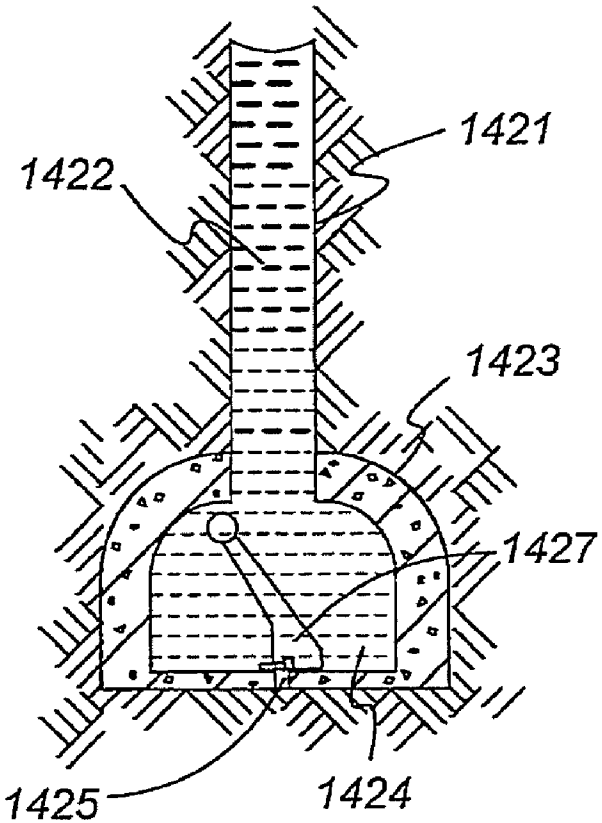

FIG. 14*h* shows a robotic excavator 1427 now excavating a room in the concrete 1423. The open or unlined shaft 1411 and the excavated portion of the concrete continue to be filled with drilling mud 1422 for support. The excavator is attached to reference pin or marker at the bottom of the shaft so that it can excavate within the concrete and leave walls of a desired sufficient thickness to provide ground support when the drilling fluid is removed.

FIG. 14*i* shows the room excavation completed with concrete walls 1425. Unlined shaft 1411 continues to be filled with drilling mud 1422 for support.

Figure 14K:
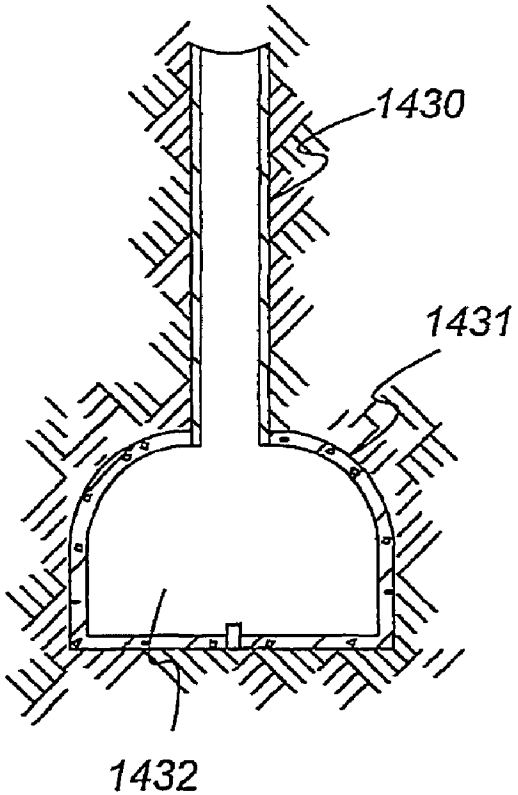
Figure 14J:
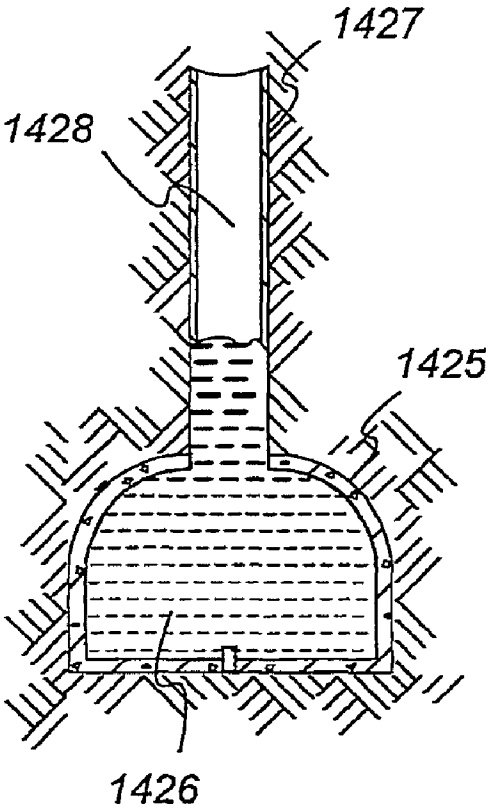

FIG. 14*j* shows a concrete liner 1423 being installed in the shaft. The liner is installed by any of several well known methods. As shown in FIG. 14*j*, for example, a slip form lining rig is utilized to pour cast-in-place concrete from the surface to the bottom of the shaft, one section at a time. The drilling mud 1426 in the shaft is removed a little at a time during the lining operation and replaced by air 1428 for the shaft liner installation workers.

FIG. 14*k* shows the process of lining the shaft completed so that a lined shaft 1430 is not connected and sealed to a lined room 1431. The interior 1423 of the shaft and room can now be purged of all drilling mud and filled with air. The system is now ready for installation of the remaining shaft utilities and equipment and the room is ready for well-drilling operations to begin.

FIGS. 14*a* through 14*k* illustrate a method of forming a room at the bottom of a shaft in soft-ground. As can be appreciated, any number of rooms of any of a number of shapes can be formed in this way. It is also possible to form the shaft liner by displacing the drilling mud in the shaft with a weak concrete and re-drilling the shaft into the concrete column, leaving concrete shaft walls of a desired thickness.

Figure 15B:
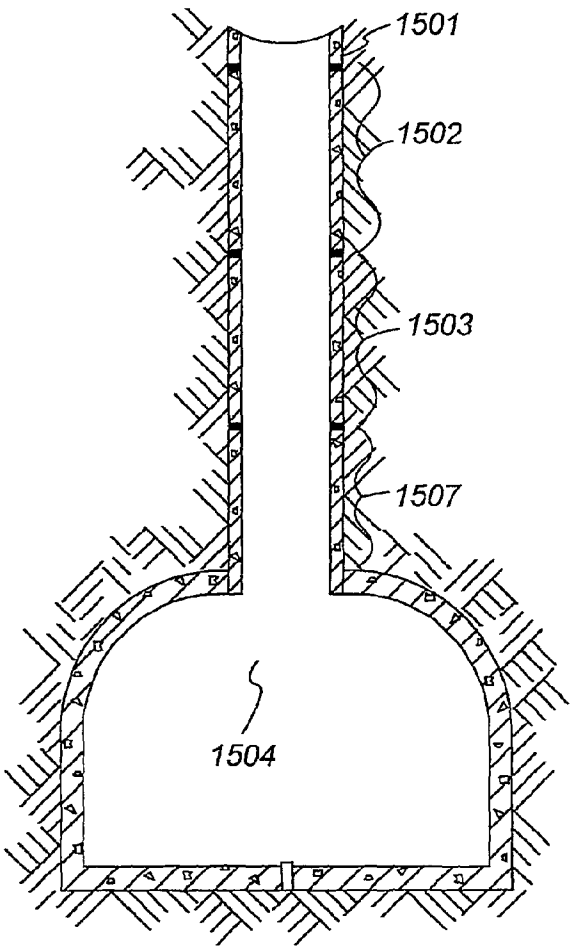
FIG. 15 shows a prior art shaft lining method in more detail.
Figure 15A:
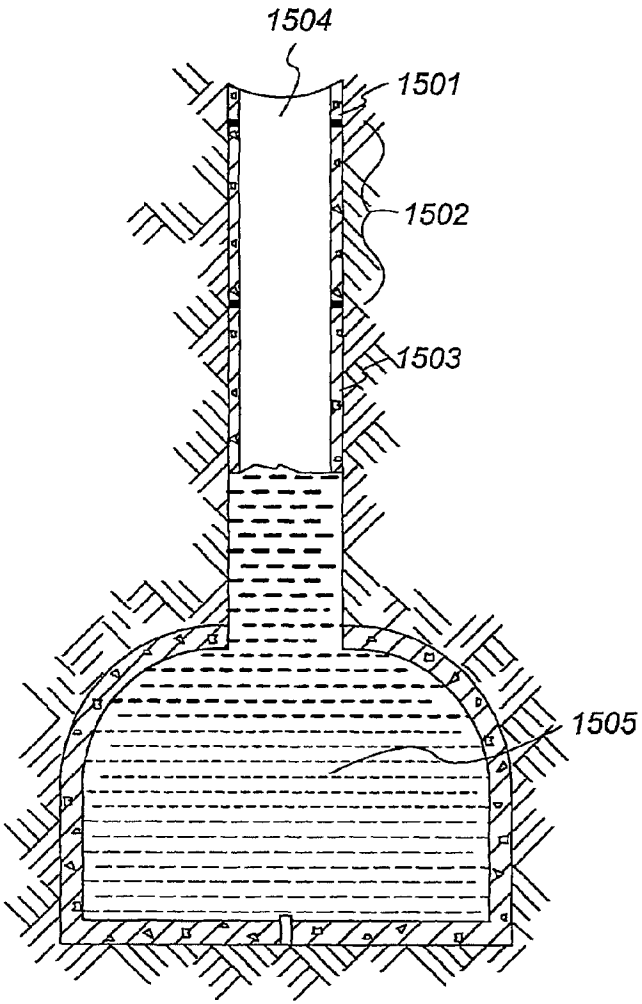

FIG. 15 shows a prior art shaft lining method in more detail. FIG. 15*a* shows shaft liner sections 1501, 1502 and 1503 installed. Below the liner sections, the unlined portion of the shaft remains filled with drilling mud 1505 for support of the unlined shaft walls. The lined section of the shaft can be filled with air 1504. FIG. 15*b* shows the completed shaft now lined down to the lined room at the bottom. The shaft liner sections 1501, 1502, 1503 and the connecting liner section 1504 are shown. The entire interior of the shaft and room can be filled with air 1506 and is now ready for equipping the shaft and room and moving into well drilling operations (or whatever other operations or equipment operation the room is to be used for).

Horizontal Secant Pile Method

Figure 16B:
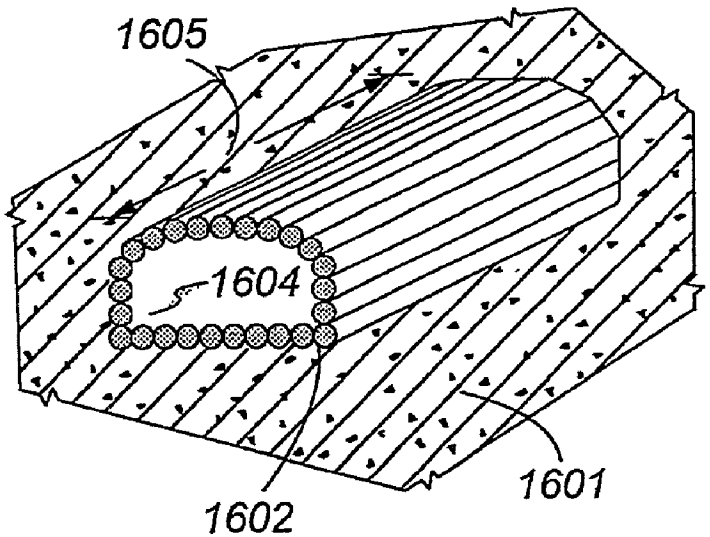
FIG. 16 is an isometric view of a drilling room formed by the secant pile method.
Figure 16A:
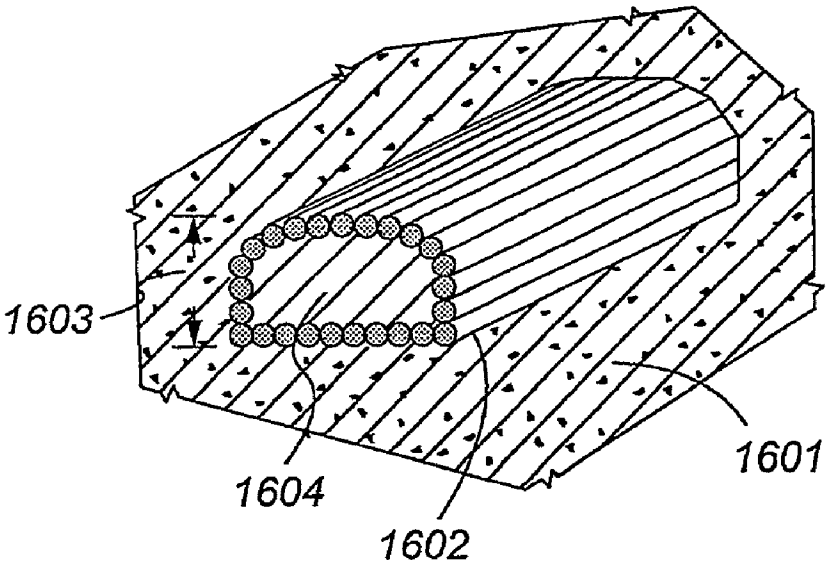
Figure 17A:
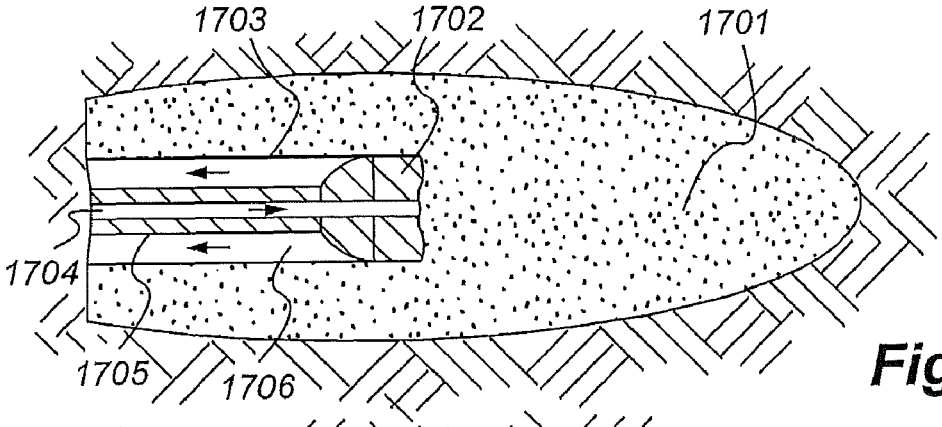
FIG. 17 is a schematic illustrating a sequence of forming a concrete pile in a formation.
Figure 17B:
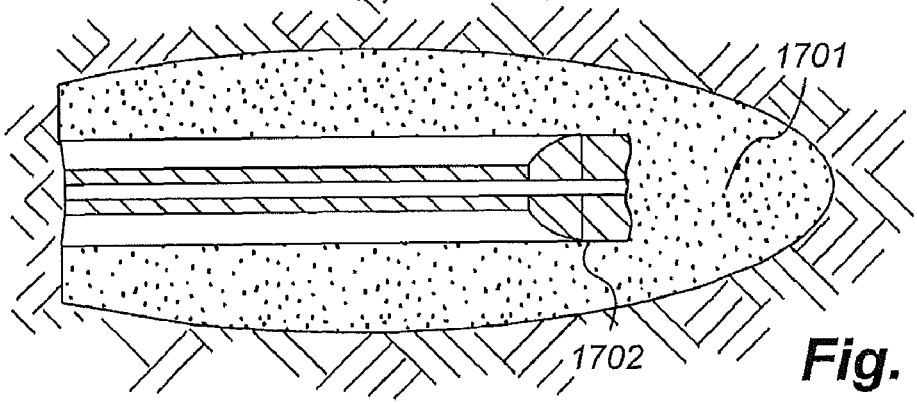
Figure 17C:
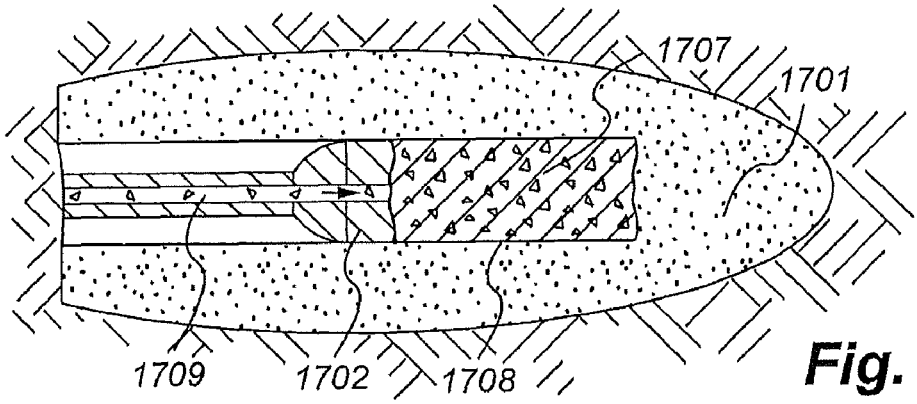
Figure 17D:
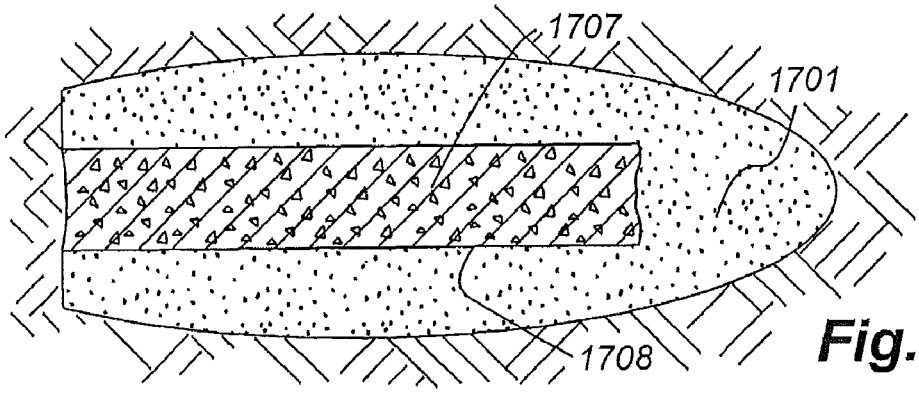

FIG. 16 is an isometric view of a drilling room 1604 having a height 1603 and length 1605 formed by the secant pile method (sometimes called the tangent pile method). The secant pile method is expected to reliably install guided borings 1602 in, for example, oil sands 1601 to diameters of at least about 0.33 meters and lengths up to about 800 m. To support tunnel construction, similar bores could reliably be increased to diameters of about ½ to 1½ meters and then be filled with concrete. Groups of these horizontal concrete-filled bores could be used to create temporary support for construction of tunnel floors, walls and ceiling arches. A method for installing concrete piles with the accuracy required to form a secant pile structure such as shown in FIG. 16 using drilling techniques is described in FIG. 17. The pile can be formed from material such as concrete, with the strength of the concrete dictated by the strength requirements of the drilling room 1601 walls. For example the piles can be formed from lean concrete to full strength concrete. When thermal recovery operations are planned, the concrete can be made with the required thermal properties to maintain strength at elevated temperatures (typically in the range of about 200C. to about 300C. in thermal recovery operations).

Compared to jet grouting or other soil mixing techniques, this approach would anticipate the following advantages:

- Uniform mechanical characteristics (e.g., compressive and tensile strength, permeability, heat transfer, susceptibility to thermal degradation) over the entire length of the concrete-filled bore.
- Superior material strength when required.
- Able to precisely project as far as the currently anticipated incremental tunnel drives of about 250 m (and probably to about 800 meters or more if needed).
- Favorable cost characteristics.

FIG. 17 is a schematic illustrating a sequence of forming a concrete pile in a formation. This figure represents operations for implementing an innovative means of forming a concrete pile in, for example, an oil sand formation which has gases dissolved in the bitumen component of the oil sands. As shown in FIG. 17*a*, a well 1703 is drilled into the oil sand 1701 from the main access tunnel (not shown) by conventional means such as a rotary drill using circulated mud to lubricate the bit 1702 and support the hole 1703. Either forward circulation as shown or reverse circulation drilling techniques can be used. In forward or conventional circulation, drilling mud is pumped down a conduit 1704 in the drill rod 1705 and returns via the annulus 1706 formed by the drill rod 1705 and the well bore 1703. FIG. 17*b* shows the drill bit 1702 at the end of drilling into the oil sand deposit 1701. FIG. 17*c* shows the drill bit 1702 being withdrawn down drill hole 1708 and a low strength concrete being pumped into the hole 1708 via the drill rod conduit 1709. As shown by FIG. 17*d*, when the drill bit is fully withdrawn, the hole 1708 is filled with low strength concrete. The diameter of the open hole 1708 is in the range of about 0.5 meters to about 2 meters. The compressive strength of the concrete is in the range of 500 to 1,000 psi.

Method of Selecting Underground Drilling Workspace Method

There are many conventional and unconventional hydrocarbon reservoirs that have yet to be exploited because of surface restrictions or because of the economics of recovery. For example, a reservoir may lay under, for example, a large lake, a town, a national park or a protected wildlife habitat. If the reservoir can be accessed from underground, it is possible to remove most of the surface footprint of a recovery operation to an underground workspace and therefore bypass most if not all the surface restrictions. Some reservoirs may require a dense network of wells to achieve an economically viable recovery factor. It may be less expensive to develop underground drilling workspace where a large number of short wells can be installed rapidly rather than to drill all the wells from the surface through unproductive overburden to reach the reservoir.

There are many factors that go into determining whether a recovery operation should be carried out from the surface or from underground. There are even more factors that go into determining how a recovery operation should be carried out once underground access is achieved. The following decision processes illustrate a method of making these complex decisions based on first on initial delineation of the reservoir to subsequent adaptation to foreseen or unforseen conditions once underground access to the reservoir is achieved. The following decision process is one of many that can be taken and is illustrative primarily of a decision process that might apply to an underground reconvey operation.

Figure 18:
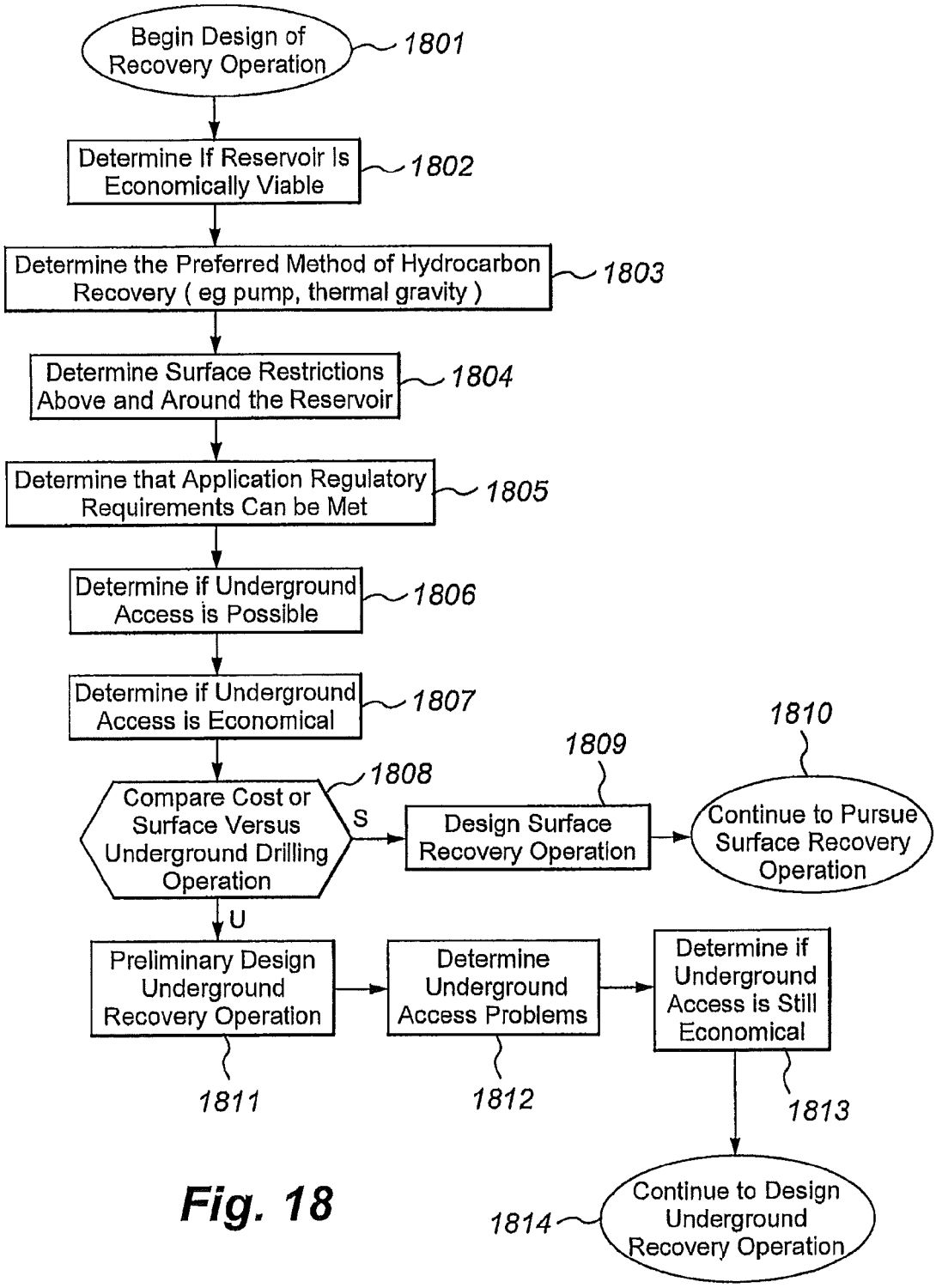
FIG. 18 is a flow diagram for selecting surface or underground recovery of hydrocarbons.

FIG. 18 is a flow diagram for selecting surface or underground recovery of hydrocarbons. The design of a hydrocarbon recovery operation 1801 is initiated with an estimate of the economic viability 1802 of the target hydrocarbon reservoir. This includes, for example, some knowledge of the reservoir size, barrels of hydrocarbon in place, quality of the hydrocarbon, availability of infrastructure, potential difficulties in recovery and of course, the expected price of oil over the duration of the recovery operation. This preliminary analysis 1802 leads to a preferred method of recovery 1804 which can be pumping using conventional well recovery methods, gravity drain in certain permeable reservoirs with high API oil or thermal methods, typically using steam or diluent to mobilize a heavy oil or bitumen. In addition, the possibility of secondary and other tertiary recovery methods may be considered in step 1803. In step 1804, the various surface restrictions above and around the reservoir are considered. These include, for example, access limited by weather, ownership of hydrocarbon rights or restrictive surface rights by others, restriction due to various animal mating seasons, towns, lakes, parks and other existing impediments to drilling operations. If restrictions determined in step 1804 eliminate a surface operation 1805, the feasibility of an underground operation may be considered in step 1806 and its economic feasibility estimated 1807. If both surface and underground recovery are possible, the various factors including cost are weighed and a decision is made in step 1808 to go with either (S) a surface operation which would follow steps 1809 and 1810 and be carried out in any of many well-known surface-based drilling and recovery projects; or by an underground recovery operation (U). If the decision is made to go with an underground recovery operation (U), then a preliminary design is initiated 1811 in which the problems associated with developing underground access are estimated 1812 and the economic viability of the various approaches is confirmed 1813. Once the decision has been made to go with an underground recovery operation, a more detailed design process is initiated 1814.

Figure 19:
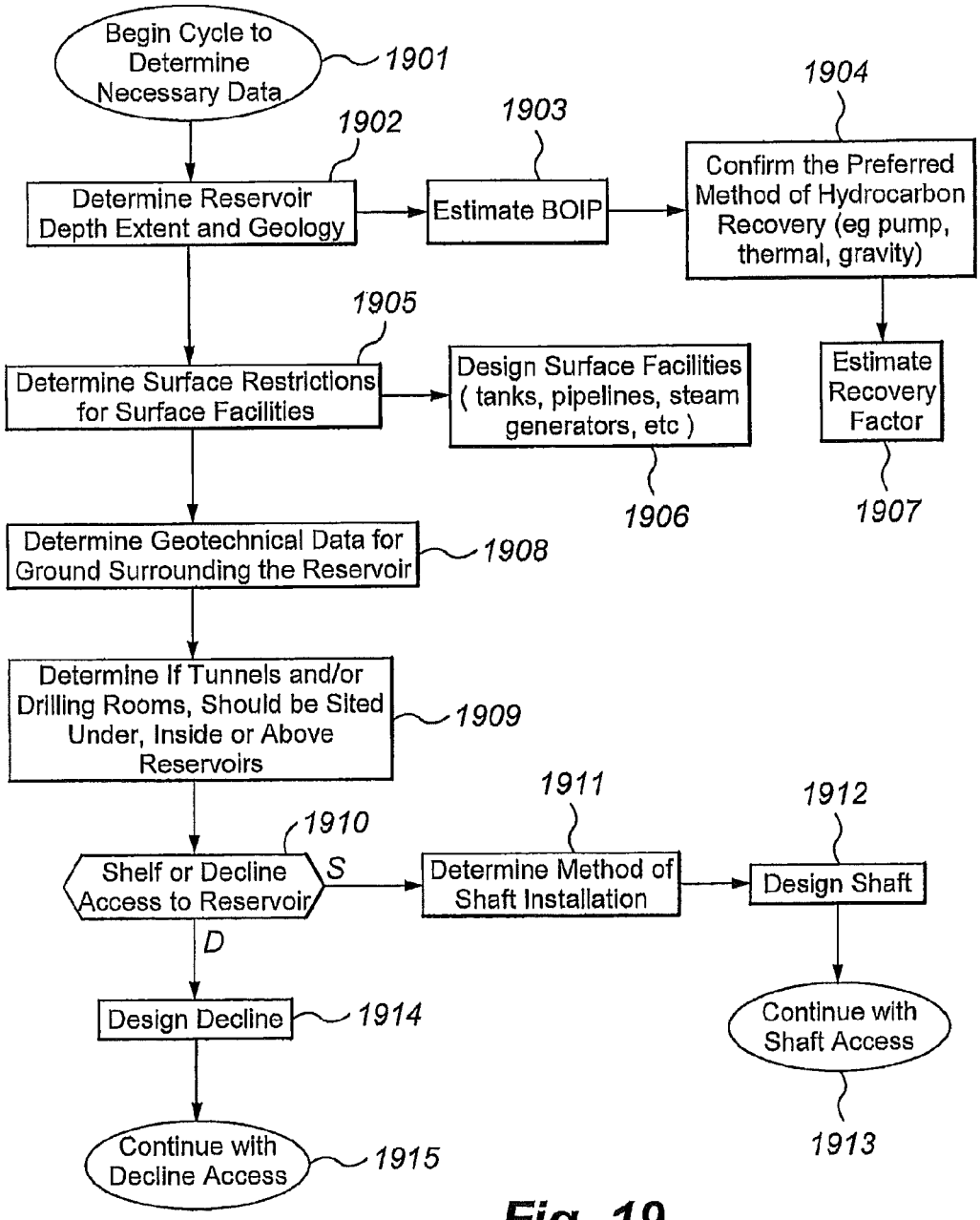
FIG. 19 is a flow diagram for obtaining data for design of the access method for an underground recovery operation.

FIG. 19 is a flow diagram for obtaining more precise data 1901 for selection of an underground access method for a recovery operations of hydrocarbons. This involves a determination of reservoir depth, thickness, number of pay zones, geology of the pay zones and zones between, above and below the pay zones in step 1902. The geology includes estimates of porosity, permeability, oil-water ratio and the like. This data leads to an estimate of barrels-of-oil-in-place 1903. A next step 1904 is to revisit the preliminary analysis described in FIG. 18 and confirm the preferred recovery method (pumping using conventional well recovery methods, gravity drain or thermal methods, typically using steam or diluent to mobilize a heavy oil or bitumen. In addition, the possibility of secondary and other tertiary recovery methods may be considered). From this analysis, the recovery factor can be estimated 1907 which, when multiplied by the barrels-of-oil-in-place estimate yields the recoverable barrels. A next step 1905 is to determine the surface restrictions that affect installation of surface facilities (for example, storage tanks, equipment storage areas, offices, steam generating facilities in the case of a thermal recovery operation). As can be appreciated, some or even all of these facilities can be installed underground if surface restrictions are too severe. If not, then the surface facilities are designed 1906. The next step 1908 is to obtain geotechnical data for the ground between the surface and the reservoir and any ground around the reservoir. This data is required to design the method of underground access (shaft or decline). This data 1908 along with that the method of recovery established in step 1904 may be used to determine if the underground drilling workspace should be installed in the reservoir, below the reservoir or above the reservoir 1909. For example, the drilling workspace would be sited below the reservoir for a gravity drain operation or a thermal recovery operation, inside the reservoir if a cold heavy oil recovery operation in a sand reservoir or above the reservoir for a conventional well recovery operation if the geology were preferable to that inside or below the reservoir (for example, if the formation below the reservoir was mixed ground with mobile gas or water aquifers). In step 1910, the decision is made to access the reservoir by shaft (S) or decline (D). For example, a shaft may be selected for moderately deep reservoirs while a decline may be appropriate for shallower reservoirs or for reservoirs with surface restrictions requiring a more distant surface entry point. If a shaft access (S) is selected the method of shaft installation is then determined in step 1911. This may be a shaft sunk be any of the well-known shaft sinking methods where workers may operate in the shaft or it the shaft may be drilled by a large drill and circulating mud method where ground stability is a concern. In step 1912 the shaft is designed. If a decline entry (D) is selected then the decline is designed 1914. As can be appreciated, underground access may be designed using both a shaft and decline. Steps 1913 and 1915 lead to the next level of design for the selected entry method.

Figures 20A, 20B:
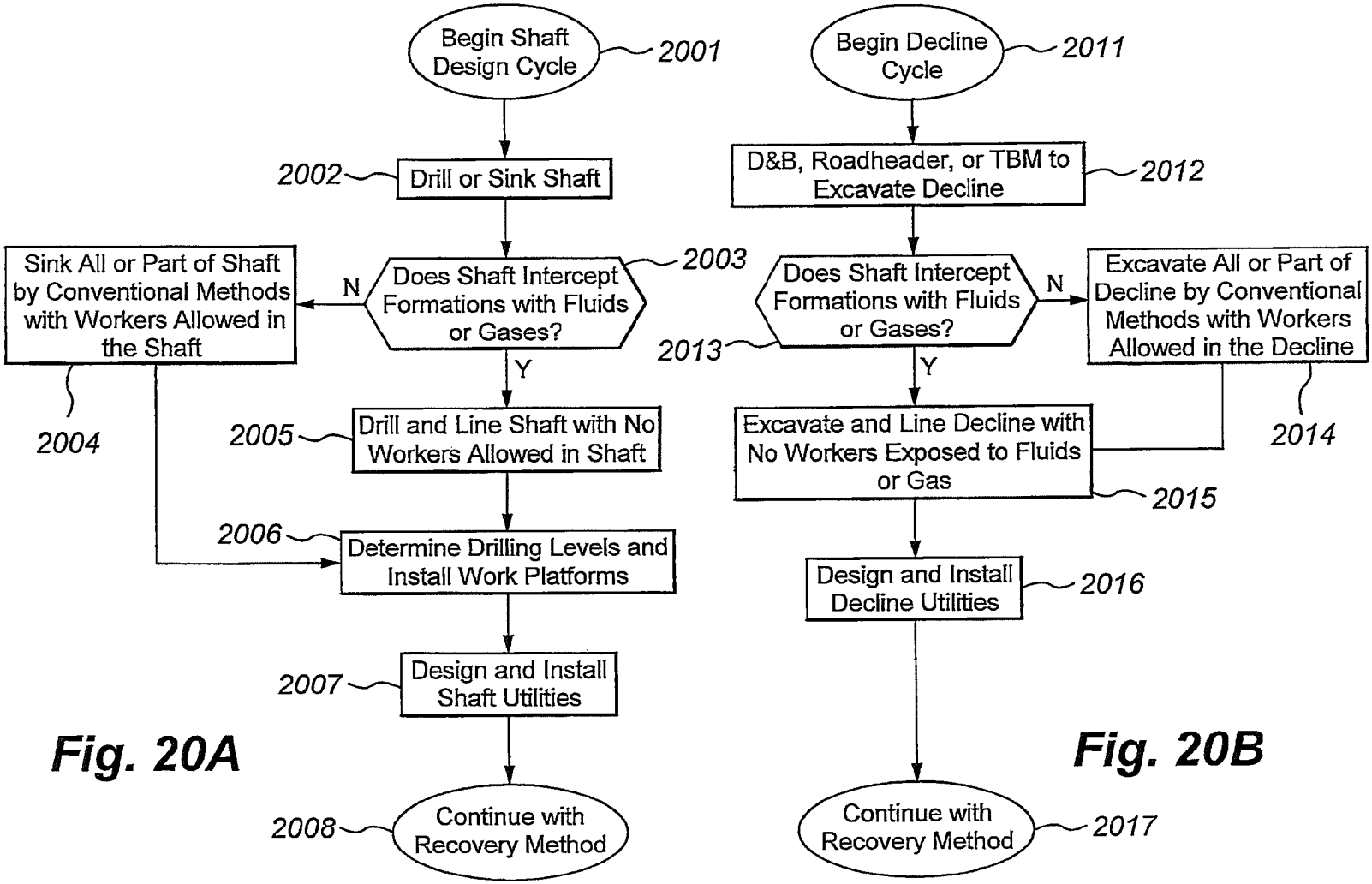
FIG. 20 is a flow diagram designing the selected method of access for underground recovery of hydrocarbons.

FIG. 20 is a flow diagram designing the selected method of access for underground recovery of hydrocarbons. For a shaft access 2001, the first step is to design the selected method of shaft installation 2002. A determination is made in step 2003 whether the shaft is expected to go through unstable ground or ground that may contain zones of mobile fluids. If the shaft is expected to go through ground that may contain mobile fluids, then the shaft would be drilled Y with no manned entry 2005 required until the shaft and its lining is completed. If the shaft is expected to go through stable ground N, then it can be sunk by conventional shaft sinking methods where workers are permitted in the shaft during construction 2006. If there are a number of pay zones that are to be drilled, then the number of working platforms in the shaft are determined in step 2006. The shaft utilities are designed in step 2007 (elevators, ventilation, electrical, pipelines, pumps etc). The procedures for designing a decline access are similar to those of the shaft procedure. If unstable ground is anticipated, a slurry TBM or other method such as NATM may be used 2015 to install a liner through these zones. Otherwise the decline can be installed using 2014 by other methods such as unpressurized TBMs, roadheaders, drill&blast or the like.

Figure 21:
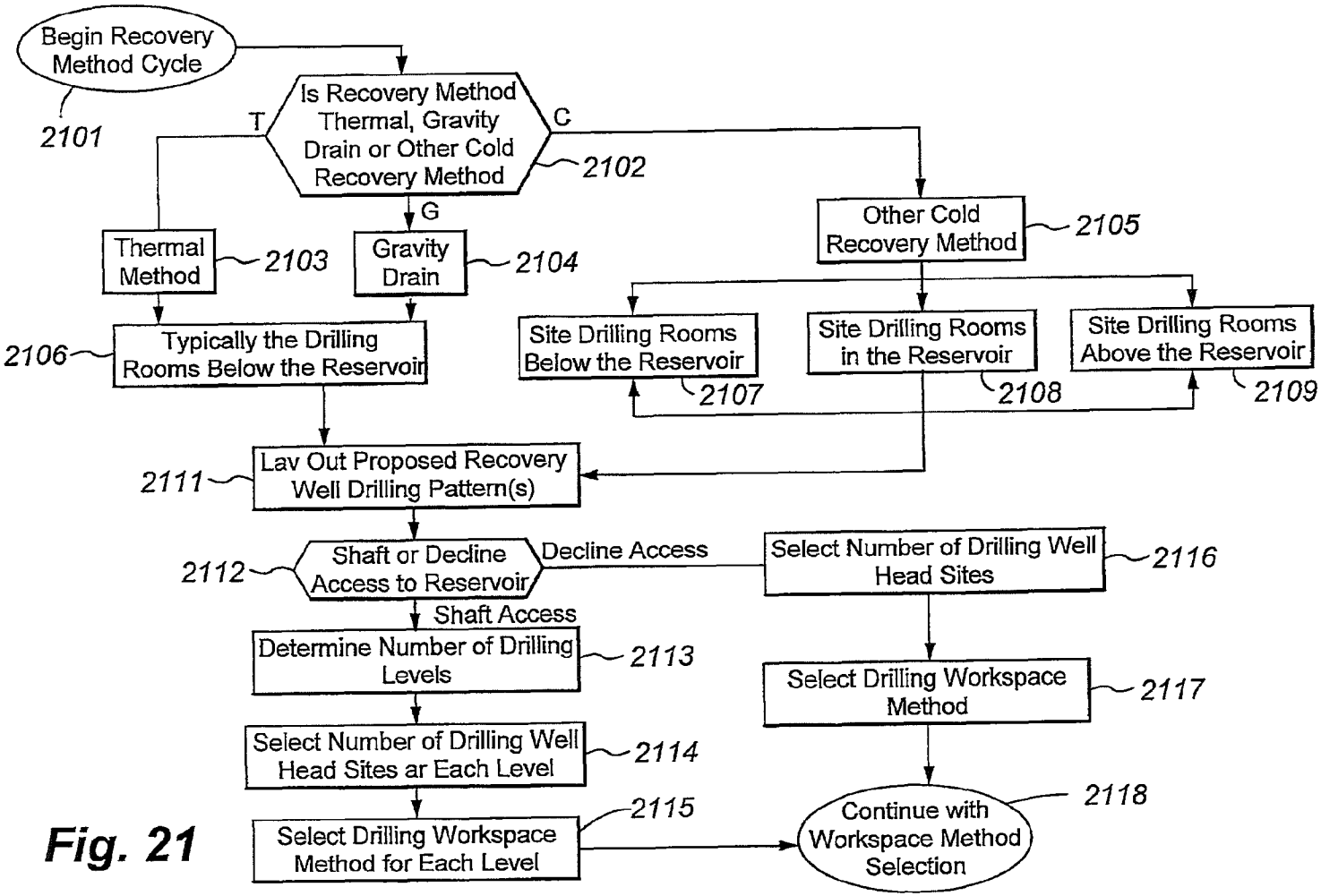
FIG. 21 is a flow diagram for selecting a location for drilling locations for underground recovery of hydrocarbons.

FIG. 21 is a flow diagram for selecting 2101 a location for drilling locations for underground recovery of hydrocarbons. If the selected recovery method 2102 is gravity drain 2104, then the drilling rooms are almost always sited under the reservoir 2106. If the selected recovery method is thermal 2103, then the drilling rooms are usually sited under the reservoir 2106 to avoid overheated from steam, for example, injected into the reservoir to mobilize a heavy oil or bitumen resource. If the selected recovery method is cold recovery method 2105, then the drilling rooms may be sited below 2107, inside 2108 or above 2109 the reservoir depending on geology of the formations (especially those with mobile gas or aquifers) and on the type of water or gas flood that may have to be used to increase production. Once the drilling room sites are selected, the drilling patterns may be laid out 2111. If shaft access is planned, then the number of drilling levels are determined 2112 and the number of drilling well head sites are selected 2114 for each level 2113. A drilling well head site is a location where the drill head equipment such as blow out preventers are installed. As described in FIG. 8, several wells can be drilled from a single well head site. The selected method 2115 of forming the workspace for each drill head site may be different for each level or may be different at the same level. If a decline access is planned, then the selection of drilling well head sites 2116 and selection of drilling workspace method 2117 is somewhat simpler because the decline access is generally only to a single pay zone level.

Figure 22:
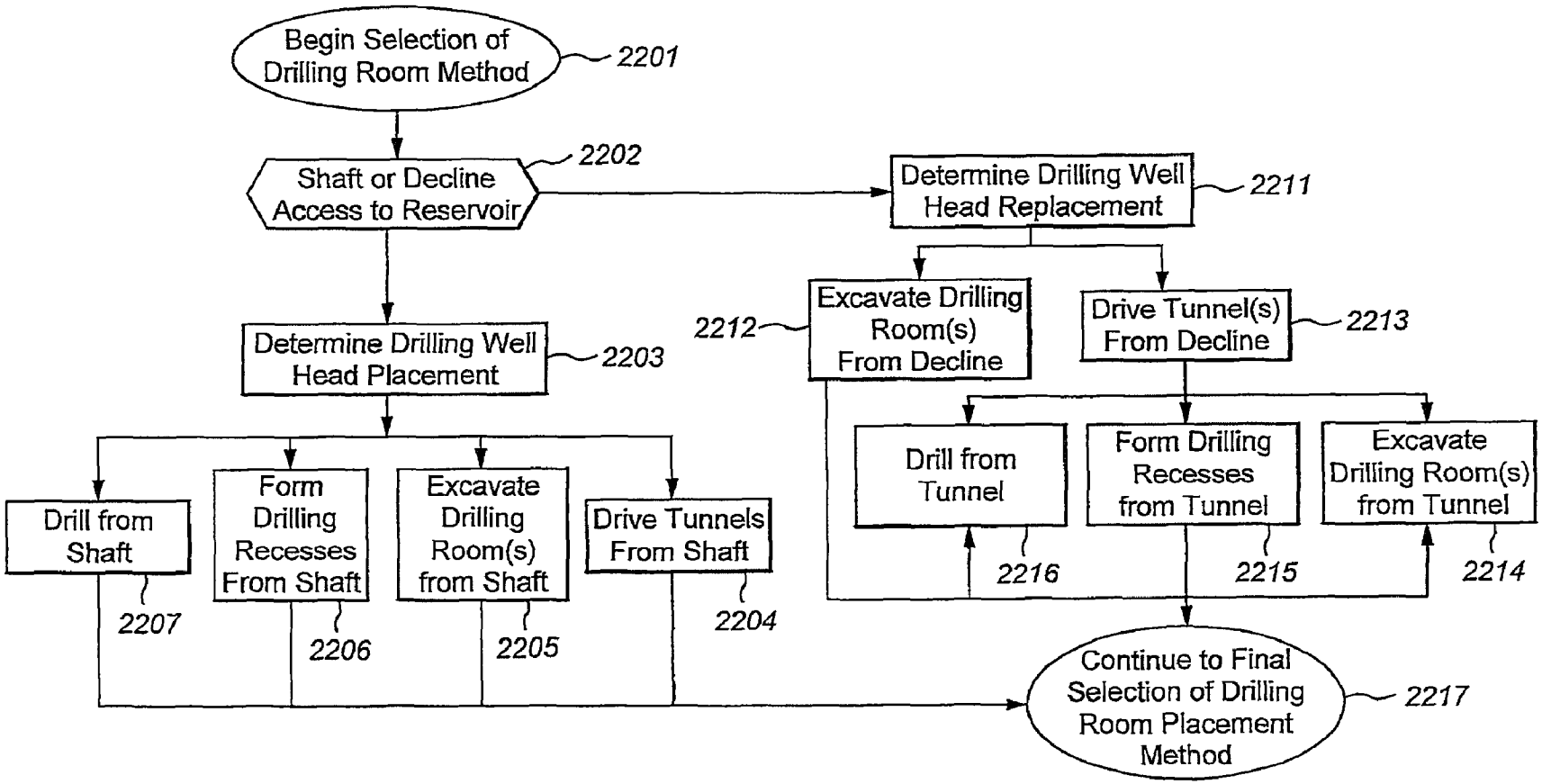
FIG. 22 is a flow diagram for selecting a workspace location for drilling for underground recovery of hydrocarbons.

FIG. 22 is a flow diagram for selecting a workspace type for drilling for underground recovery of hydrocarbons 2201. If the access is by shaft, then well head placement 2203 may be directly through the shaft liner 2207 (for example if only a few wells are planned); well head recesses (such as shown in FIGS. 2 through 6) may be installed 2206 so that more space is available so that wells can be installed; a drilling room may be installed 2205; or a tunnel may be driven from the shaft 2204 into the formation. As pointed out previously, a tunnel is essentially a very long drilling room and is usually formed by different methods. If the access is by decline, drilling rooms can be installed from the decline 2212 or a tunnel can be driven below, into or above the reservoir 2213. Well heads may be established through the tunnel liner 2216; well head recesses may be installed 2215; or a drilling room may be installed 2214. As can be appreciated, any combinations of establishing well head work spaces may be used.

Figure 23:
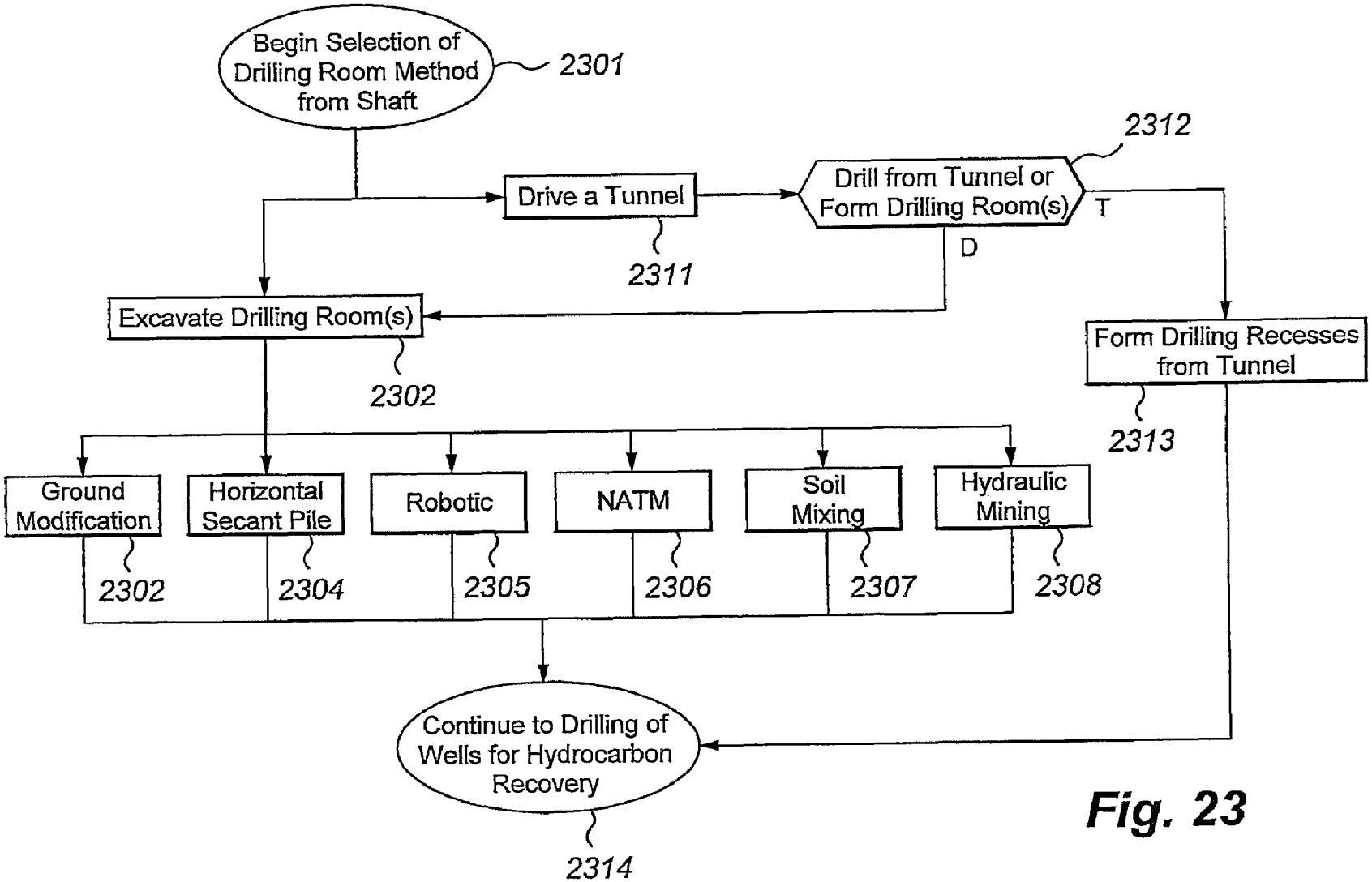
FIG. 23 is a flow diagram for selecting a workspace method for drilling from a shaft for underground recovery of hydrocarbons.

FIG. 23 is a flow diagram for selecting a workspace method for drilling from a shaft for underground recovery of hydrocarbons 2301. If the main access is a shaft, then either a tunnel can be driven from the shaft 2311 or drilling rooms can be installed directly from the shaft 2302. If a tunnel is driven from the shaft, drilling recesses can be installed through the tunnel liner 2313 (recesses are necessary to avoid protruding well head equipment into the tunnel) or drilling rooms can be installed from various locations along the tunnel 2302. Several methods are available for installing drilling rooms through a shaft or tunnel liner. All of these methods are capable of being used when there is formation pressure or fluids in the ground where the drilling rooms are to be located. One selection is ground modification 2303 wherein the ground is frozen to provide temporary ground stability until the excavation can be lined, for example with shotcreting or installing a concrete or metal liner. Another selection is to form a drilling room excavation using a horizontal secant pile method 2304 such as described in FIGS. 16 and 17. Yet another selection is to form a drilling room excavation using robotic technology such as described in FIGS. 11 through 15. Yet another selection is to form a drilling room excavation using the well known NATM method 2306 adapted if necessary for soft ground. Yet another selection is to form a drilling room excavation using well known soil mixing techniques 2307 to form a volume of ground with higher strength than the in-situ material. This is a less preferred method if the drilling rooms are to be installed in the hydrocarbon formation and may be better suited to install drilling rooms in the formations above or below the reservoir. Yet another selection is to form a drilling room excavation using hydraulic mining methods 2308 such as described by Johns in U.S. Pat. No. 4,076,311 or as disclosed by the present inventors in U.S. Provisional Patent Application 60/867,010. If hydraulic mining methods are used, the mined volume may have to be backfilled with a concrete so that a drilling room can be safely excavated within the volume of concrete. Once a drilling room has been excavated, well head equipment can be installed through the lined drill room walls or recesses such as described in FIGS. 2 through 7. Thereupon drilling producer, injector, sequestering or water management wells can begin.

Figure 24:
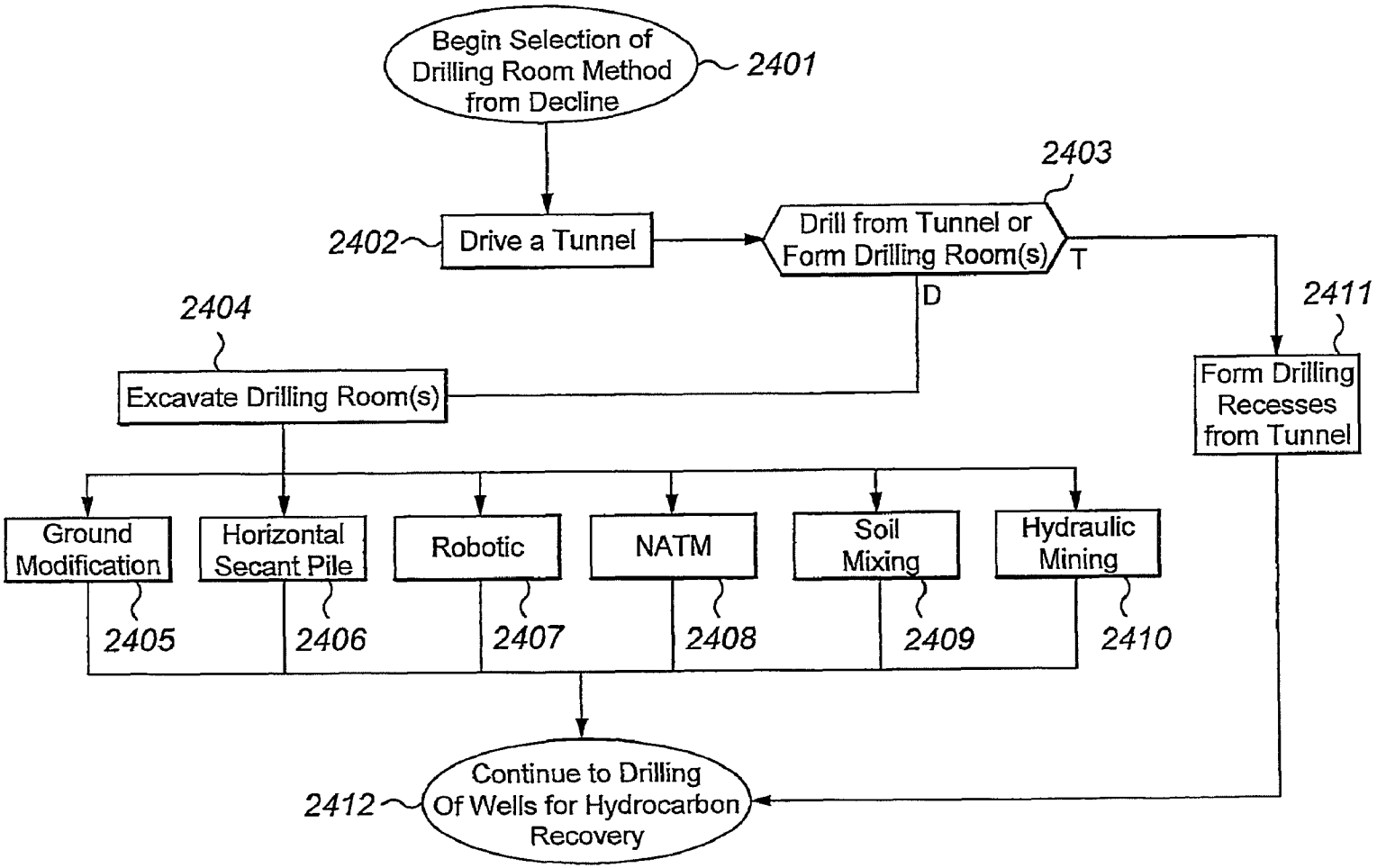
FIG. 24 is a flow diagram for selecting a workspace method for drilling from a decline for underground recovery of hydrocarbons.

FIG. 24 is a flow diagram for selecting a workspace method for drilling from a decline for underground recovery of hydrocarbons. This procedure is nearly identical to that described in FIG. 23 where a tunnel is driven from the access decline and drilling rooms are installed from the tunnel by all the methods that can be used from a shaft access.

Figure 25:
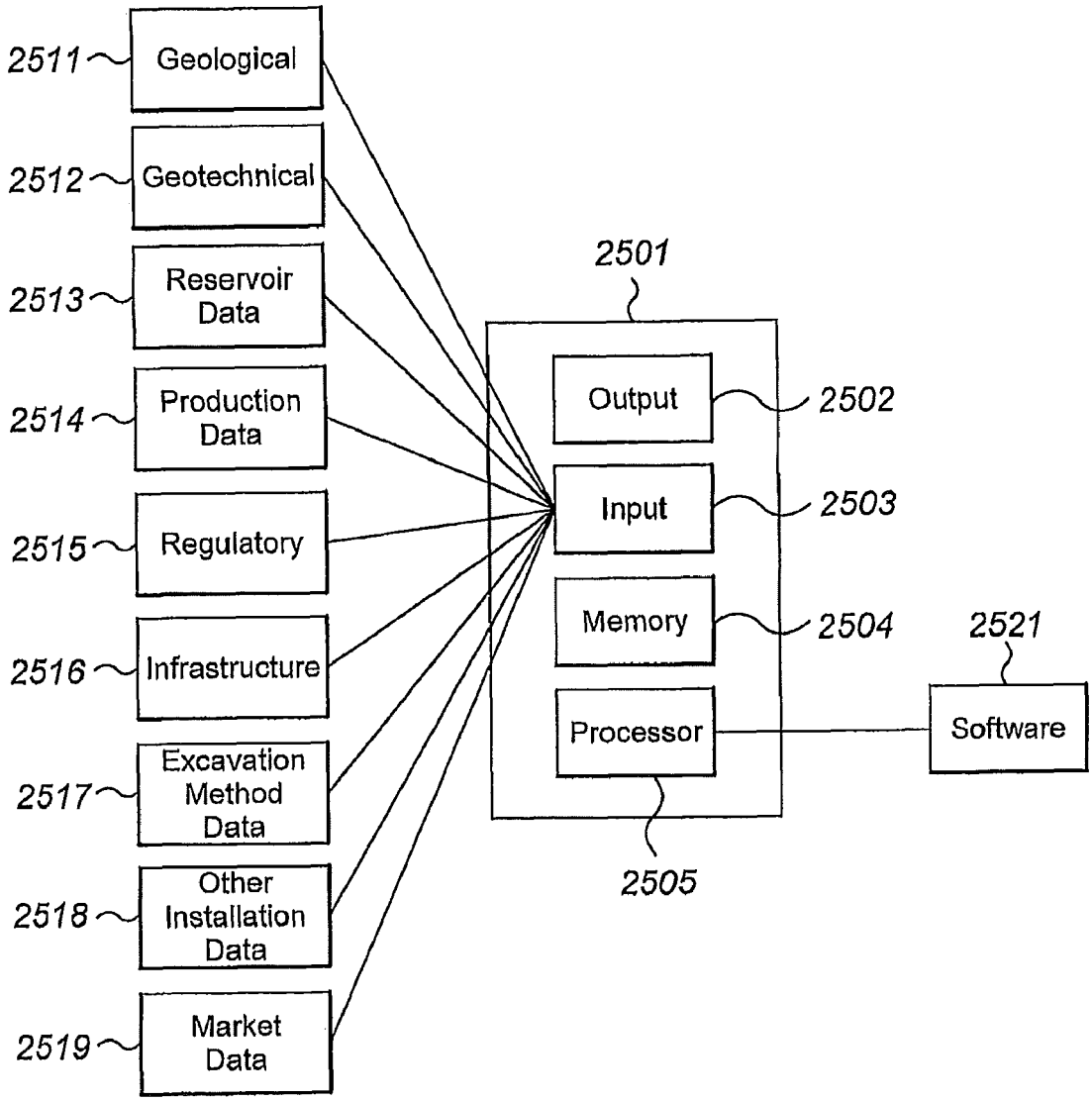
FIG. 25 is a schematic representation of a computerized process for implementing the example decision process shown in FIGS. 18 through 24.
Figure 26A:
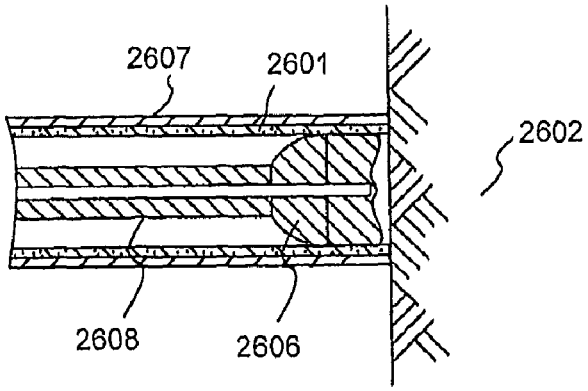
FIGS. 26*a-c* illustrate a sequence illustrating installing a recess by pipe-jacking. The method is applicable when a recess is to be installed from inside a lined shaft into the surrounding formation when the surrounding formation has or is thought to have a formation pressure and/or the possibility of substantial water or gas inflow. The ground formation in which the recess is sunk is on the side 2602.
Figure 26B:
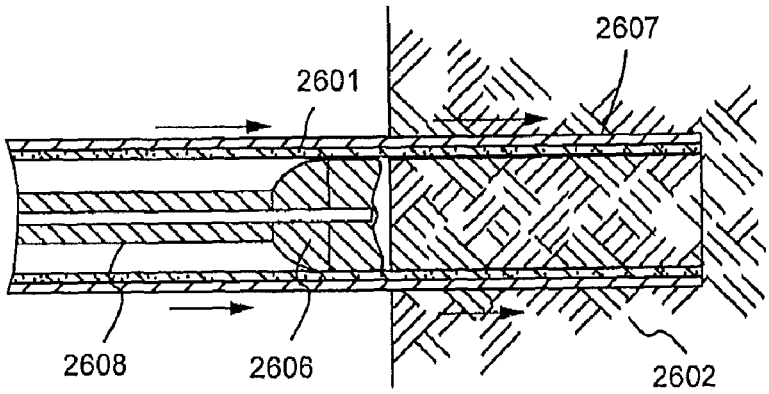
Figure 26C:
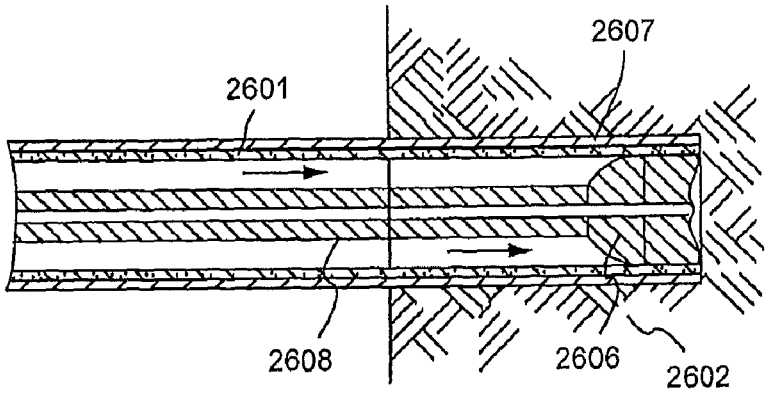

FIG. 25 is a schematic representation of a computerized process for implementing the example decision process shown in FIGS. 18 through 24. FIG. 25 shows a computer 2501 comprised of an input 2503 which may be for example, a keyboard, a touch screen, mouse, a stylus or the like, an output 2502 which may be for example, printout, transmittable files, plots and the like, computer memory 2504 which may include storage on memory chips, hard drives, CD-ROMs and the like, and computer processor(s) 2505. The computer 2510 is directed by a software program 2521 which is typically implemented by processor(s) 2505. The software program 2521 acts on various data bases that may be input 2503 into the computer memory 2504. Data bases may include, for example, geological data on the hydrocarbon deposits 2511; geotechnical data on the overburden, hydrocarbon deposits and basement formations; reservoir data on the hydrocarbon producing zones 2513; production data 2514; regulatory requirements 2515; infrastructure data 2516; excavation method data 2517; other installation data 2518 and market data 2519. The software 2521 utilized these and other data bases to execute a selection algorithm such as described, for example in FIGS. 18 through 24. As can be appreciated, such a program can be of valuable assistance to those developing a plan to install and operate an underground hydrocarbon recovery facility.

Figure 27:
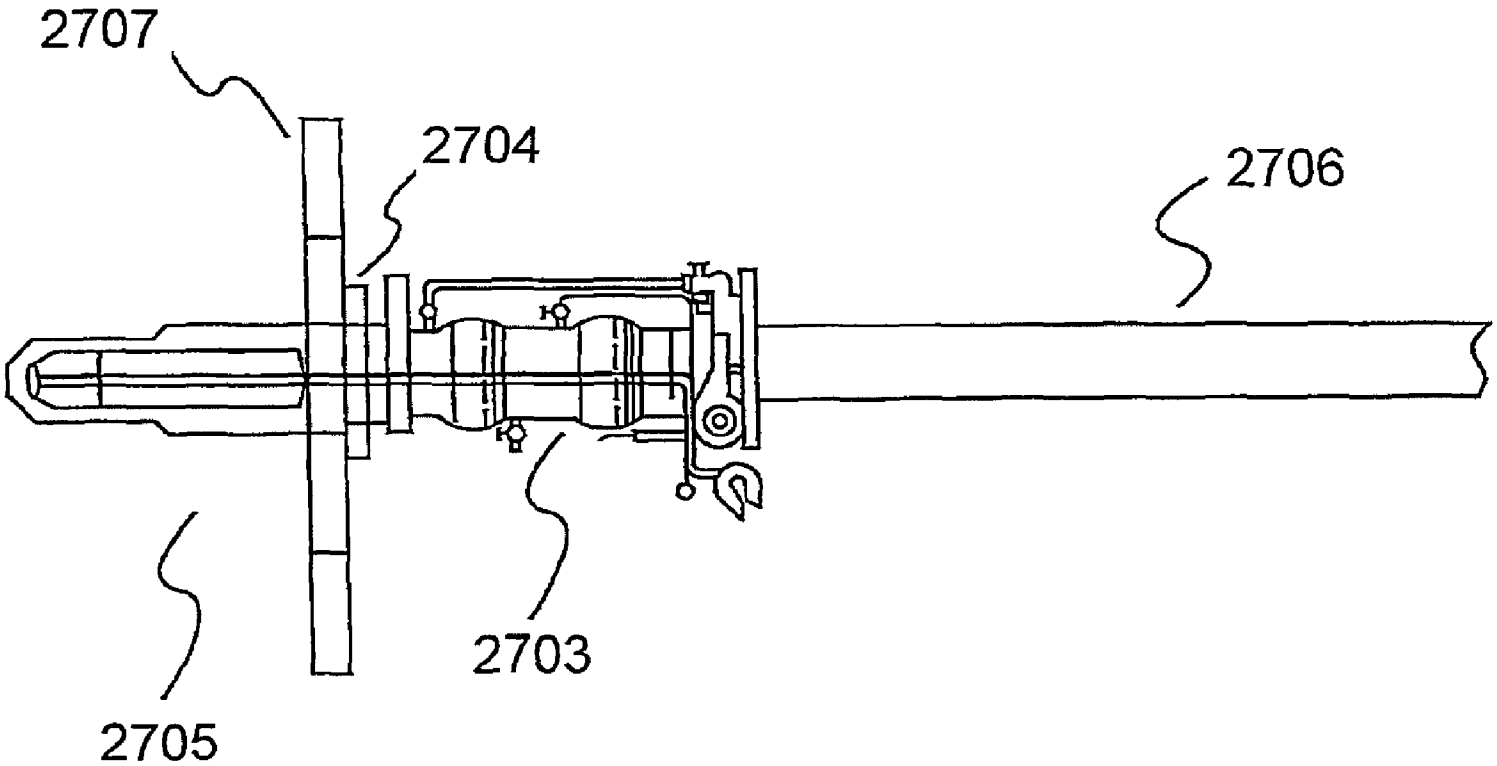
FIG. 27 shows a schematic side view of wellhead control equipment installed in a tunnel or shaft liner.

FIG. 27 is a schematic side view of wellhead control equipment installed in a tunnel or shaft liner and provides a close up cutaway side view of a tunnel liner wall 2707 with well-head equipment 2703 installed. The well-head equipment 2703 is attached and sealed to the tunnel liner 2707. Well-head equipment 2703 is secured, for example, to a flange 2704 pre-cast into the tunnel liner wall 2707. A portion of the well-head equipment 2703 is set into the formation 2705. As shown, that portion is typical of well-production operations and collects hydrocarbons and delivers them to a piping system 2706. The equipment shown is a wellhead control assembly which includes blow-out preventers. Equipment such as this allows drilling, logging, casing and servicing of wells to be carried out while the interior workspace is fully sealed from the formation. A drill rig can be used with well-head equipment as shown in FIG. 27 to initiate and complete a well while maintaining a seal between the interior workspace and the formation.

Figure 28B:
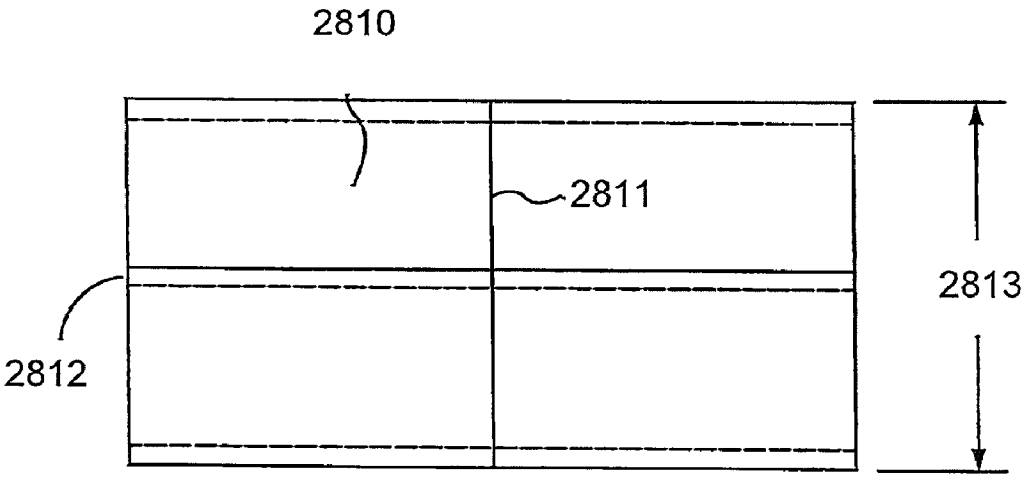
FIG. 28 illustrates features of tunnel liner sealing.
Figure 28C:
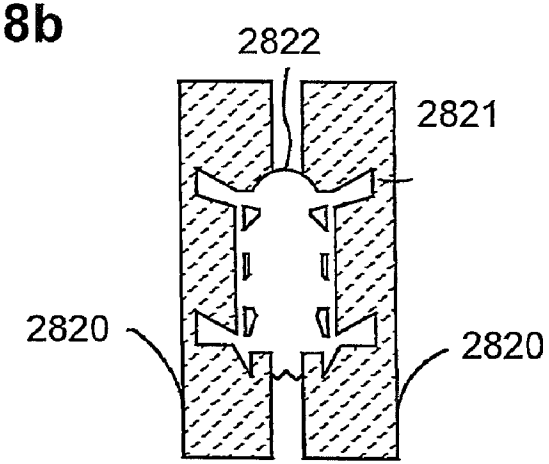
Figure 28A:
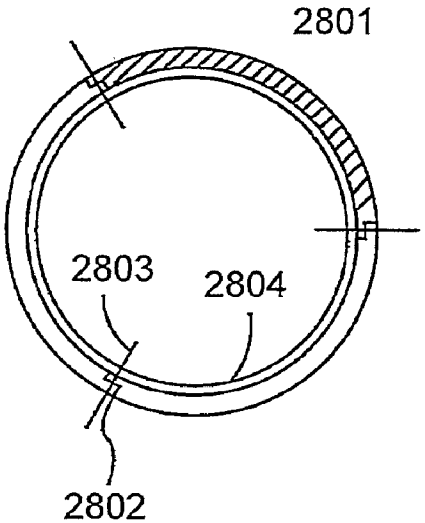

FIG. 28 illustrates features of tunnel liner sealing. A soft-ground tunnel liner is commonly comprised of short cylindrical liner sections. The sections are in turn comprised of segments. Alternately, a tunnel liner may be formed by continuously extruding a concrete liner, a newer method that does not require as much sealing as a liner assembled from segments and sections. An end view of a typical tunnel liner is shown in FIG. 28*a* showing three segments 2801 joined together at joints 2802 which may include sealing gaskets (not shown) and may be bolted 2803. The segments are typically pre-cast and made from a high strength material such as for example concrete or fibre-reinforced concrete. An additional optional sealing liner 2804 may be installed to provide additional sealing. This sealing liner may be made of rubber, urethane or another tough sealing material. A side view of the tunnel liner is shown in FIG. 28*b* illustrating two sections 2810 of outer diameter 2813 joined together by a joint 2811. A longitudinal segment joint 2812 such as described in FIG. 28*a* is also shown. Once each section 2810 is assembled inside the TBM shield, it is compressed against the previously installed section by the action of the TBM propelling itself forward by its hydraulic rams against the end of the tunnel liner. A seal is formed at section joints 2811 by a sealing gasket such as shown in FIG. 28*c* which illustrates a close-up section view between two liner sections 2820 and their joint surfaces. Typically a sealing gasket mounting assembly 2821 is cast into the liner segments 2820. A compressible sealing material 2822 is installed in at least one of the sealing gasket mounting assemblies 2821. When the liner sections 2820 are compressed by the propelling action of the TBM, the sealing material 2822 is compressed forming a seal between adjacent tunnel liner sections.

Once a lined shaft or lined tunnel is installed, wells can be drilled through the shaft or tunnel wall liners by first attaching a wellhead control assembly (used for drilling, logging, operating and servicing wells, for example, at the well-head of a surface-drilled well) and then using this assembly to drill through the liner wall while maintaining a seal between the formation from the inside of the shaft or tunnel liner as illustrated for example in FIG. 27. This is also a well-known practice.

The present invention includes a method of recovering hydrocarbons by developing an underground workspace that is isolated from the formation both during installation and operations. This requires means of sealing the excavating machines, drilling machines, and working spaces at all times. The principal points of sealing include that between the shaft walls and the formation. Beginning a tunnel from a shaft is known practice. The shaft wall must be thick enough that the TBM can be sealed into place before it actually starts to bore.

There are other advantages of the present invention not discussed in the above figures. For example, the logic embodied in FIGS. 18 through 24 can be implemented by an automated computer program, manually or a combination of both methods.

A number of variations and modifications of the invention can be used. As will be appreciated, it would be possible to provide for some features of the invention without providing others. The present invention, in various embodiments, includes components, methods, processes, systems and/or apparatus substantially as depicted and described herein, including various embodiments, sub-combinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, for example for improving performance, achieving ease and\or reducing cost of implementation.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover though the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. An excavation method, comprising:

(a) providing a substantially vertically inclined shaft, at least a portion of the substantially vertically inclined shaft being lined to inhibit entry, into an interior of the at least a portion of the substantially vertically inclined shaft, of a formation fluid from a hydrocarbon-containing formation;

(b) at a selected level of the at least a portion of the substantially vertically inclined shaft forming, while maintaining a pressure and fluid seal between the shaft interior and the formation, a plurality of recess cavities extending approximately radially outward from the at least a portion of the substantially vertically inclined shaft, the selected level being adjacent to or near the hydrocarbon-containing formation; and (c) drilling, while maintaining the pressure and fluid seal between the at least a portion of the substantially vertically inclined shaft interior and the formation to inhibit entry of the formation fluid into the shaft interior, at least one well outward from a face of each of the recess cavities, the at least one well penetrating at least a portion of the hydrocarbon-containing formation and wherein the seal is maintained continuously during a duration of formation and operation of the at least one well;

wherein the forming step (b) comprises:

from the at least a portion of the substantially vertically inclined shaft, pipe-jacking and/or pile-driving a rigid tube into the hydrocarbon-containing formation;

from the at least a portion of the substantially vertically inclined shaft, thereafter excavating a formation material positioned interiorly of the rigid tube; and after the excavating step, forming a sealed end to the rigid tube.

2. The method of claim 1, wherein each of the recess cavities has a diameter ranging from about 1 to about 2 meters and a length ranging from about 4 to about 10 meters.

3. The method of claim 1, wherein the recess cavities are lined with a formation fluid impervious liner, wherein the at least a portion of the substantially vertically inclined shaft comprises one or more spaced apart levels, and wherein each of the one or more spaced apart levels comprises a plurality of approximately radially outwardly extending recess cavities.

4. The method of claim 3, wherein the liner in the recess cavity is in physical contact with the hydrocarbon-containing formation along substantially an entire interface between the at least a portion of the substantially vertically inclined shaft and the formation.

5. The method of claim 3, wherein a rigid tube lining the at least one well is in physical contact with the hydrocarbon-containing formation along substantially an entire interface between the rigid tube and the formation.

6. The method of claim 1, wherein the rigid tube has an inner diameter that is substantially the same as an outer diameter of a drill bit.

* * * * *